United States Patent [19]

Minamitaka

[11] Patent Number: 4,982,643

[45] Date of Patent: Jan. 8, 1991

[54] AUTOMATIC COMPOSER

[75] Inventor: Junichi Minamitaka, Fussa, Japan

[73] Assignee: Casio Computer Co., Ltd., Tokyo, Japan

[21] Appl. No.: 494,919

[22] Filed: Mar. 13, 1990

Related U.S. Application Data

[63] Continuation of Ser. No. 288,001, Dec. 20, 1988, abandoned.

[30] Foreign Application Priority Data

Dec. 24, 1987 [JP] Japan ..... 62-325176
Dec. 24, 1987 [JP] Japan ..... 62-325177
Dec. 24, 1987 [JP] Japan ..... 62-325178

[51] Int. Cl.[5] ..... G10H 1/38; G10H 7/00

[52] U.S. Cl. ..... 84/613; 84/637; 84/638; 84/470 R; 84/DIG. 22

[58] Field of Search ..... 84/613, 637, 638, 650, 84/669, 715, 716, DIG. 22, 470 R, 477 R, 478, 610, 651, 652, 666

[56] References Cited

U.S. PATENT DOCUMENTS 3,889,568 6/1975 Amaya .
4,327,622 5/1982 Aoki ..... 84/1.03
4,399,731 8/1983 Aoki .
4,450,742 5/1984 Sugiura .
4,489,636 12/1984 Aoki et al. .
4,539,882 9/1985 Yuzawa .
4,664,010 5/1987 Sostero .

FOREIGN PATENT DOCUMENTS 58-87593 5/1983 Japan .
62-187876 8/1987 Japan .
WO86/05616 9/1986 World Int. Prop. O. .

*Primary Examiner*—Stanley J. Witkowski
*Attorney, Agent, or Firm*—Frishauf, Holtz, Goodman & Woodward

[57] ABSTRACT

An automatic composer comprises an input unit which inputs a melody forming part of a music piece and a chord progression of music, a melody analyzer which extracts parameters characterizing the input melody and a melody generator which develops a melody forming the remainder of the music piece. There is further provided a database of musical knowledge which is used by both of the melody analyzer and generator. Because the common musical knowledge is applied to both of melody analysis and synthesis, the synthesized melody will be well fit for the input melody. The knowledge in the database is managed by an editor through which a user may change the stored knowledge to what is desired. In order to take the full advantage of the chord progression for music composition, there is provided a musical structure extracting device which determines key and hierarchic structures in music from the chord progression. The key structure serves to control a tonality of melody whereas the hierarchic structure functions to control a melodic line.

20 Claims, 75 Drawing Sheets

OVERALL ARRANGEMENT

CONCEPT OF ENTIRE SYSTEM

FUNCTIONAL ARRANGEMENT OF PRODUCTION SYSTEM

GENERAL FLOW OF MUSIC COMPOSER

GENERAL FLOW OF MUSIC ANALYZER

GENERAL FLOW OF MUSICAL KNOWLEDGE EDITOR

< MELODY >

MDi MOTIF (MELODY) PITCH
MRi MOTIF (MELODY) TONE DURATION
MEDi VMEDi PITCH (TEMPORARILY STORED)
MERi TONE DURATION
MELDi MELODY PITCH
MELRi MELODY TONE DURATION

< MELODY FEATURING PARAMETER >

LLi ARPEGGIO PATTERN
PCi FEATURE OF LLi
RSi FEATURE OF NONHARMONIC TONE
RR RHYTHM PATTERN

< CHORD >

CDi CHORD NAME
CRi CHORD DURATION

< CHORD FEATURING PARAMETER >

HIEi HIERARCHIC STRUCTURE
KEYi KEY STRUCTURE
NOTE SCALE

< MISCELLANEOUS >

Li,Xi,Ui,Yi,Ni,Fi PRODUCTION RULE DATA
PSCALEi PULSE SCALE
BEAT NUMBER OF ELEMENTARY UNITS OF LENGTH PER SEGMENT (e,g,BAR)
PULS STRUCTURE OF PULSE SCALE
ISCALE INITIAL NOTE SCALE

FIG.7

LIST OF VARIABLES

〈MELODY〉
PITCH DATA : 16-BIT INTEGER
LOWER 8 BITS : PITCH NAME
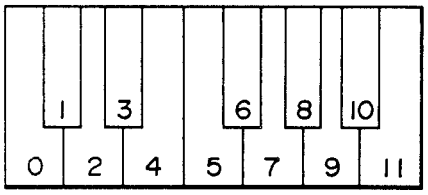
HIGHER 8 BITS : OCTAVE NUMBER
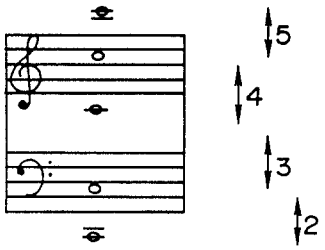
TONE DURATION DATA : REPRESENTED BY AN INTEGER
MULTIPLE OF ELEMENTARY LENGTH
〈CHORD〉
LOWER 8 BITS : ROOT DATA
0:C, 1:C#, 2:D, 3:E$^b$, 4:E, 5:F, 6:F#
7:G, 8:A$^b$, 9:A, 10:B$^b$, 11:B
HIGHER 8 BITS : TYPE DATA
0:maj 1:min 2:dim 3:aug 4:sus4 5:7th
6:m7th 7:m6th 8:6th 9:M7th
*DATA FORMAT OF CHORD DURATION IS
IDENTICAL TO THAT OF MELODY TOME DURATION
FIG. 8
DATA FORMAT (1)

<MELODY FEATURING PARAMETER>

LLi (ARPEGGIO PATTERN)

LOWER 8 BITS : VERTICAL ORDINAL POSITION IN THE CHORD MEMBERS WITHIN AN OCTAVE

HIGHER 8 BITS : OCTAVE NUMBER

EXAMPLE

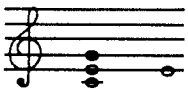

Cmaj MELODY

| | (Hex) |
|---|---|
| CHORD | 0000 |
| MELODY | 0404 |
| LLi | 0402 |

PCi (FEATURE OF LLi)

$PC_1$ : NUMBER OF LLi $PC_2$ : MAXIMUM OF LLi $PC_3$ : MINIMUM OF LLi $PC_4$ : MAXIMAL DIFFERENCE BETWEEN ADJACENT LLi $PC_5$ : MINIMAL DIFFERENCE BETWEEN ADJACENT LLi

RSi (FEATURE OF NONHARMONIC TONE)

| | | | |
|---|---|---|---|
| SUSPENDED APPOGGIATURA | ----1 | ? | ----5 |
| APPOGGIATURA | ----2 | PASSING | ----6 |
| ANTICIPATION | ----3 | AUXILIARY | ----7 |
| ESCAPE | ----4 | NOTA CAMBIATA | ----8 |

PR (RHYTHM PATTERN)

16-BIT DATA INDICATIVE OF PRESENCE/ABSENCE OF TONES AT RESPECTIVE POINTS IN SEGMENT (BAR)

EXAMPLE

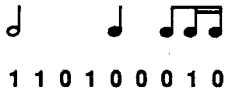

1 1 0 1 0 0 0 1 0 0 0 0 0 0 0 0 1

D 1 0 1 (Hex)

FIG. 9

DATA FORMAT (2)

CHORD FEATURING PARAMETER

HIEi 0,1, 2,4 CORRESPOND RESPECTIVELY TO
a,a',b,c IN CONVENTIONAL MISICAL NOTATION

KEYI KEY OF C = 0
KEY OF C# = 1
⋮
KEY OF B = 11
NO DISTINCTION BETWEEN MODES
(E.G.) C MAJOR = A MINOR = 0 )

scale DATA
1 0 1 0 1 0 1 1 0 1 0 1
(SI) (MI) (RE)(DO)

= OAB5 (HEX)
= DIATONIC SCALE (DO,RE,MI,FA,SOL,LA,SI)

PRODUCTION RULE DATA

EACH RULE CONSISTS OF
CONDITION PART : Li ≤ Fxi ≤ UI , AND
CONSEQUENT PARTS : YI,NI
IF Fxi ( VALUE OF F OF TYPE xi
COMPUTED FROM POSITION OF BAR LINE
AND ASSOCIATE MELODY TONES ) IS
GREATER THAN OR EQUAL TO Li
AND LESS THAN OR EQUAL TO UI,
THEN, THE RESULT IS YI.
OTHERWISE, THE RESULT IS NI,
IF YI OR NI HAS A NEGATIVE
VALUE, THE ABSOLUTE VALUE IDENTIFIES
TYPE OF NONHARMONIC TONE. IF NOT,
IT POINTS TO THE NEXT PRODUCTION RULE
TO BE EXAMINED.

FIG.10
DATA FORMAT (3)

PSCALEi = PULSE SCALE

EXAMPLE

| | | | | |
|---|---|---|---|---|
| 1. NORMAL | 1111 | 1111 | 1111 | 1111 |
| | 0101 | 0101 | 0101 | 0101 |
| | 0001 | 0001 | 0001 | 0001 |
| | 0000 | 0001 | 0000 | 0001 |
| | 0000 | 0000 | 0000 | 0001 |
| 2. SAMBA | 1111 | 1111 | 1111 | 1111 |
| | 0001 | 1010 | 1011 | 0101 |
| | 0001 | 1000 | 0001 | 1000 |
| | 0000 | 0001 | 0000 | 0001 |

DATA FORMAT (4)

MELODY :

CHORD : Cmaj

| | |
|---|---|
| $MD_1$ = 0400 | $MR_1$ = 2 (HEXADECIMAL) |
| $MD_2$ = 0402 | $MR_2$ = 2 |
| $MD_3$ = 0404 | $MR_3$ = 2 |
| $MD_4$ = 0405 | $MR_4$ = 2 |
| $MD_5$ = 0407 | $MR_5$ = 4 |
| $MD_6$ = 0500 | $MR_6$ = 4 |
| $CD_1$ = 0000 | $CR_1$ = 10 |
| $LL_1$ = 0401 | $PC_1$ = 4 |
| $LL_2$ = 0402 | $PC_2$ = 0501 |
| $LL_3$ = 0403 | $PC_3$ = 0401 |
| $LL_4$ = 0501 | $PC_4$ = 1 |
| | $PC_3$ = 1 |
| RR = 1155 | |

EXAMPLE OF DATA

INITIALIZE

| BARNO(i) | CHORD | CDi | CRi | ADDRESS |
|---|---|---|---|---|
| 1 | Cmaj | 0 | 10 | 0 |
| 2 | Cmaj | 0 | 10 | 2 |
| 3 | Fmaj | 5 | 10 | 4 |
| 4 | G7th | 507 | 10 | 6 |
| 5 | Cmaj | 0 | 10 | 8 |
| 6 | C#dim | 201 | 10 | 10 |
| 7 | Dim7th | 602 | 10 | 12 |
| 8 | G7 | 507 | 10 | 14 |
| 9 | Cmaj | 0 | 10 | 16 |
| 10 | B♭ maj | a | 10 | 18 |
| 11 | Fmaj | 5 | 10 | 20 |
| 12 | G7 | 507 | 10 | 22 |
| 13 | Cmaj | 0 | 10 | 24 |
| 14 | Cmaj | 0 | 10 | 26 |
| 15 | Fmaj | 5 | 10 | 28 |
| 16 | Cmaj | 0 | 10 | 30 |
| | | HEXA-DECIMAL | HEXA-DECIMAL | DECIMAL |

maj : 0
min : 1
dim : 2
aug : 3
sus4 : 4
7th : 5
m7th : 6
m6th : 7
6th : 8
M7th : 9

FIG.14

EXAMPLE OF CHORD PROGRESSION DATA

READ CHORD DATA

| ADDRESS | DATA |
|---|---|
| 0 | 10 |
| 1 | 20 |
| 2 | 30 |
| 3 | 40 |
| ⋮ | |
| 10 | 5, FFFF, 5555, 1111, 0101, 0001 (NORMAL) |
| 20 | 5, FFFF, AAAA, EEEE, FEFE, FFFE (REVERSE) |
| 30 | 4, FFFF, 1AB5, 1818, 0101 (SAMBA) |
| 40 | 5, 5555, 1B11, 1111, 1010, 4000 (NOW) |
| 50 | 4, FFFF, 1249, 5B6D, 0001 (SWING) |

FIG.16

EXAMPLES OF PULSE SCALES

READ PULSE SCALE DATA

| RULE NO | L | X | U | Y | N | ADDRESS |
|---|---|---|---|---|---|---|
| 1 | 0 | 2 | 0 | 2 | 3 | 0 |
| 2 | 0 | 8 | 0 | -1 | -2 | 5 |
| 3 | 0 | 1 | 0 | 4 | 5 | 10 |
| 4 | 0 | 7 | 0 | -3 | -4 | 15 |
| 5 | 0 | 4 | 0 | 9 | 6 | 20 |
| 6 | 1 | 6 | 1 | 7 | 12 | 25 |
| 7 | 3 | 8 | ∞ | -2 | 8 | 30 |
| 8 | -∞ | 8 | -3 | -3 | -6 | 35 |
| 9 | 1 | 3 | 1 | -7 | 10 | 40 |
| 10 | 1 | 5 | 1 | -7 | 11 | 45 |
| 11 | 4 | 5 | 4 | -7 | -8 | 50 |
| 12 | 1 | 7 | 2 | -2 | 13 | 55 |
| 13 | -2 | 7 | -1 | -2 | 14 | 60 |
| 14 | 1 | 8 | 2 | -4 | 15 | 65 |
| 15 | -2 | 8 | -1 | -4 | -5 | 70 |

FIG. 18

EXAMPLE OF PRODUCTION RULE DATA

READ PRODUCTION RULE DATA

| No. | PITCH | DURATION | MDI | MRI | ADDRESS |
|---|---|---|---|---|---|
| 1 | $C_4$ | ♪ | 0400 | 2 | 0 |
| 2 | $D_4$ | ♪ | 0402 | 2 | 2 |
| 3 | $E_4$ | ♪ | 0404 | 2 | 4 |
| 4 | $F_4$ | ♪ | 0405 | 2 | 6 |
| 5 | $G_4$ | ♩ | 0407 | 4 | 8 |
| 6 | $C_5$ | ♩ | 0500 | 4 | 10 |

EXAMPLE OF MELODY DATA

GENERATE ESSENTIALS

READ MELODY DATA

FEATURES OF ARPEGGIO PATTERN

FEATURES OF NONHARMONIC TONES

EVALUATE RHYTHM

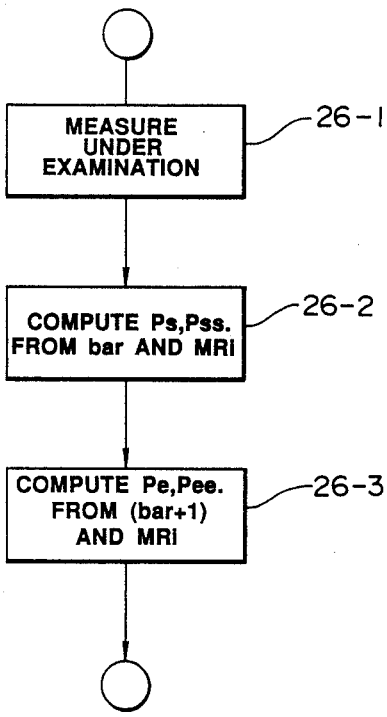

Ps : LOCATION OF THE FIRST NOTE OF THE MEASURE RELATIVE TO THE WHOLE MELODY.

Pss : PART OF THE DURATION OF THE FIRST NOTE THAT EXTENDS IN THE PREVIOUS MEASURE IF ANY.

Pe : LOCATION OF THE NOTE IN FRONT OF THE FIRST NOTE OF THE NEXT MEASURE.

Pee : PART OF THE DURATION OF THE NOTE (Pe+1) THAT EXTEND IN THE CURRENT MEASURE IF ANY.

(EXAMPLES)

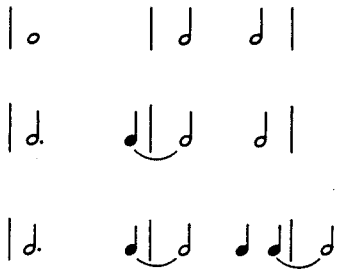

bar=2 Ps=2 Pe=3 Pss=0 Pee=0 bar=2 Ps=2 Pe=3 Pss=4 (LENGTH OF ♩) Pee=0 bar=2 Ps=2 Pe=3 Pss=4 (LENGTH OF ♩) Pee=4

FIG.26

COMPUTE Ps,Pe,Pss,Pee

COMPUTE Ps,Pss

COMPUTE Pe,Pee

EXTRACT ARPEGGIO PATTERN FROM MOTIF

| NO. | DATE | |
|---|---|---|
| 0 | 0 0 9 1 | maj |
| 1 | 0 0 8 9 | min |
| 2 | 0 0 4 9 | dim |
| 3 | 0 1 1 1 | aug |
| 4 | 0 0 a 1 | sus4 |
| 5 | 0 4 9 1 | 7th |
| 6 | 0 4 8 9 | m7th |
| 7 | 0 2 8 9 | m6th |
| 8 | 0 2 9 1 | 6th |
| 9 | 0 8 9 1 | M7th |

DATA OF CHORD MEMBERS

GENERATE FEATURES OF ARPEGGIO PATTERN

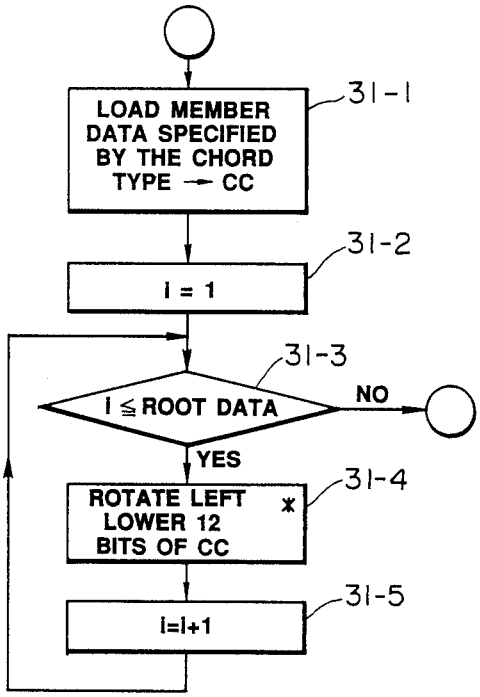
*. ROTATE LEFT LOWER 12 BITS
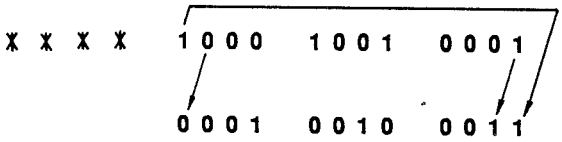
FIG. 31
DISINTEGRATE CHORD INTO MEMBER

GENERATE FEATURES
OF NONHARMONIC TONES

DISTINGUISH BETWEEN HARMONIC AND NONHARMONIC TONES

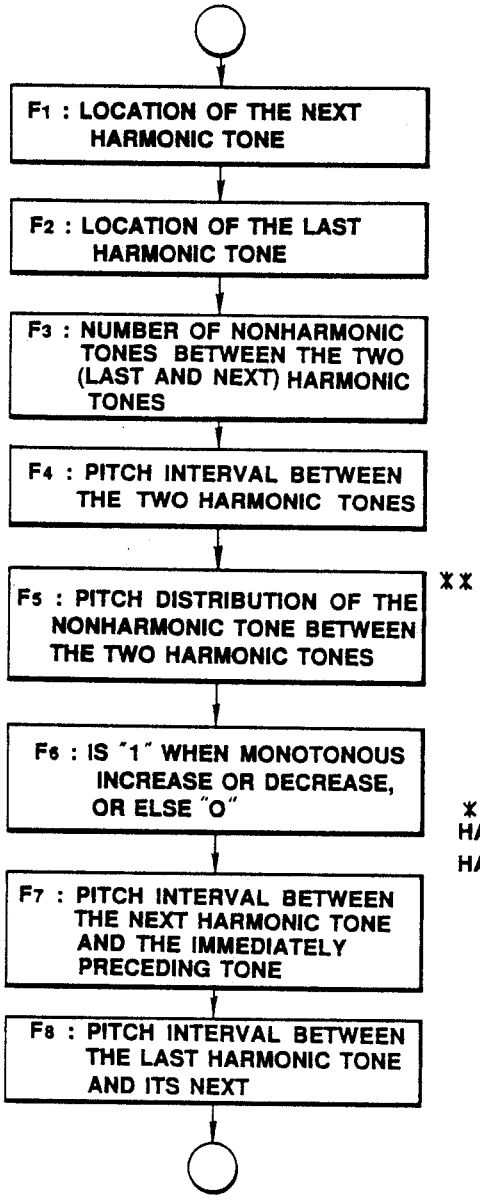
(EXAMPLE)
CHORD : Cmaj
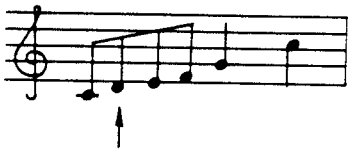
F1 = 1
F2 = -1
F3 = 1
F4 = 0404-0400 = 4
F5 = 2
F6 = 1
F7 = 0404-0402 = 2
F8 = 0402-0400 = 2
**
| | | | | | | | | |
|---|---|---|---|---|---|---|---|---|
| HARMONIC TONE 1 | * | | | * | | * | | * |
| HARMONIC TONE 2 | | | * | * | | | * | * |
| | | | | | * | * | * | * |
| F5 | 0 | 1 | 2 | 3 | 4 | 5 | 6 | 7 |
**
FIG. 35
COMPUTE F

F1 : LOCATION OF THE NEXT HARMONIC TONE

F2 : LOCATION OF THE LAST HARMONIC TONE

F3 : THE NUMBER OF NONHARMONIC TONES BETWEEN THE TWO HARMONIC TONES

F4 : PITCH INTERVAL BETWEEN THE TWO HARMONIC TONES

F5 : PITCH DISTRIBUTION OF NONHARMONIC TONES

F6 : WHETHER PITCH CHANGES MONOTONOUSLY BETWEEN HARMONIC TONES

F7 : PITCH INTERVAL BETWEEN THE NEXT HARMONIC TONE AND ITS PREVIOUS TONE
F8 : PITCH INTERVAL BETWEEN THE LAST HARMONIC TONE AND ITS NEXT TONE

F1~ Fn(n=8) TEMPORARILY STORE

REASON FORWARD

FIG. 45 COMPUTE MATCHING FUNCTION AMONG BLOCKS

GENERATE HIERARCHIC STRUCTURE

DATA CONVERSION OF HIERARCHIC STRUCTURE

KEY STRUCTURE (1) DISTANCE OF KEY
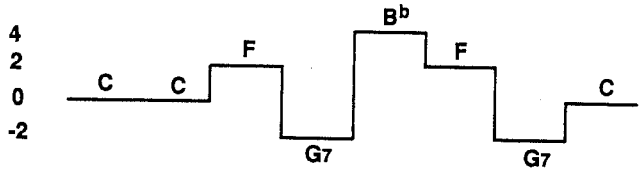
CORRECT DISTANCE OF KEY ASSUMING NO CHANGE OF KEY FOR -2 ≦ DISTANCE OF KEY ≦ +2
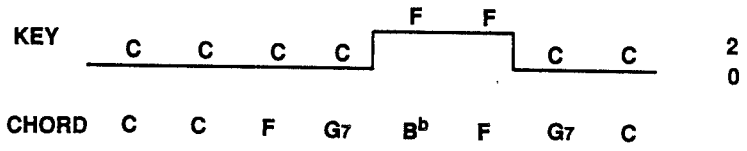
(3) CONVERT DATA OF KEY DISTANCE TO DATA OF KEYNOTE
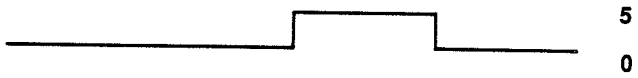
FIG. 49

DISTANCE OF KEY
BETWEEN CD1 AND CDi

SCALE

GENERATE MELODY

GENERATE,SAVE,LOAD ARPEGGIO PATTERN

| ADDRESS | DATA |
|---|---|
| 0 | NUMBER OF PATTERNS(=N) |
| 1 | ADDRESS OF 1-ST PATTERN(=$A_1$) |
| 2 | ADDRESS OF 2-ND PATTERN(=$A_2$) |
| ⋮ | |
| N | ADDRESS OF N-TH PATTERN(=$A_N$) |

| | |
|---|---|
| $A_1$ | HEADER |
| $A_{1+1}$ | PATTERN LENGTH |
| $A_{1+2}$ ⋮ | PATTERN DATA |
| $A_2$ | HEADER |

☆ EXAMPLE OF HEADER

F F F F (Hex)

- F → HIERARCHY IDENTIFIER(HIEI)
- F → BAR NO OF PATTERN IN THE MOTIF
- F → LENGTH OF MOTIF

FIG. 55

ARPEGGIO PATTERN(LL) BUFFER

GENERATE ARPEGGIO PATTERN (LL)

* DIFFERENCE BETWEEN TWO LL ELEMENTS
(EXAMPLE)
FOR ckno=4

| | | | | |
|---|---|---|---|---|
| 0 | 3 | 0 | 1 | 1 |
| 0 | 3 | 0 | 2 | 1 |
| 0 | 3 | 0 | 3 | 1 |
| 0 | 3 | 0 | 4 | 1 |
| 0 | 4 | 0 | 1 | |

CHECK

CONVERT LL INTO MELODY DATA FORMAT

ADD NONHARMONIC TONES

ADD NONHARMONIC TONES(2)

NOTE:ADDITION/SUBTRACTION OF MED DATA (EXAMPLE) 0 4 0 a
0 4 0 b
0 5 0 0
0 5 0 1
0 5 0 2

040a+4=0502

SET CANDIDATES

COMPUTE F

| ADDRESS | DATA | (BINARY) | | | | | | | | | | | | |
|---|---|---|---|---|---|---|---|---|---|---|---|---|---|---|
| 0 | $AB5_{16}$ | 1 | 0 | 1 | 0 | 1 | 0 | 1 | 1 | 0 | 1 | 0 | 1 | (DIATONIC) |
| 1 | $295_{16}$ | 0 | 0 | 1 | 0 | 1 | 0 | 0 | 1 | 0 | 1 | 0 | 1 | (PENTATONIC) |
| 2 | $A31_{16}$ | 1 | 0 | 1 | 0 | 0 | 0 | 1 | 1 | 0 | 0 | 0 | 1 | (PENTATONIC MINOR) |
| 3 | $555_{16}$ | 0 | 1 | 0 | 1 | 0 | 1 | 0 | 1 | 0 | 1 | 0 | 1 | (WHOLE-TONE) |
| | | | | | | | | | | | ↑ RE | | ↑ DO | |

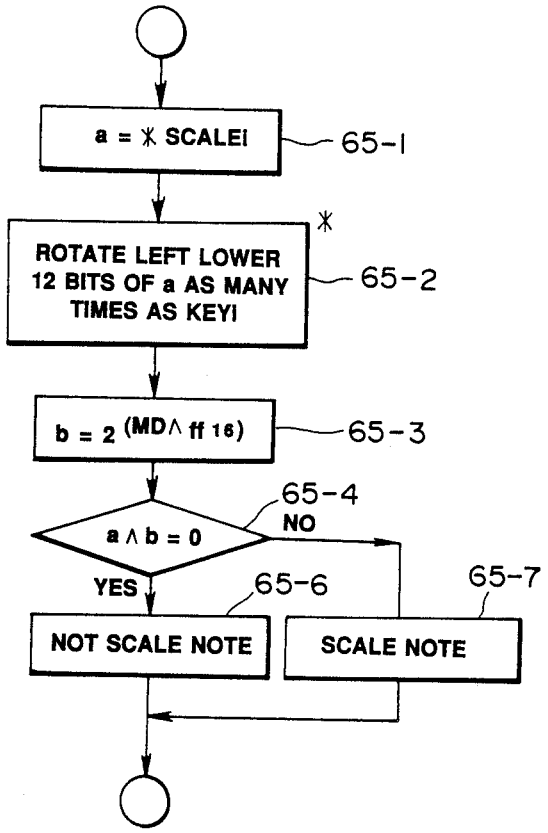
✳ (EXAMPEL) FOR SCALEI = 0 , a = AB5$_{16}$
KEYI = 5
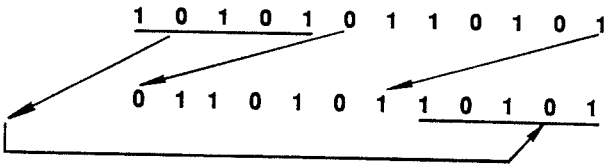
FIG. 65
DISTINGUISH SCALE TONE

GENERATE TONE DURATIONS (RHYTHM)

JOIN NOTES

DISJOIN NOTE

CONVERT INTO MER DATA FORMAT

CONNECT MEMORY SEGMENT

FORWARD REASONING WITH EXPLANATION

DISPLAY EXPLANATION $XDOC_4$ = "PITCH INTERVAL BETWEEN TWO HARMONIC TONES"

$XDOC_6$ = "MONOTONOUS PITCH INCREASE/DECREASE IDENTIFIER"

$XDOC_7$ = "PITCH INTERVAL BETWEEN NEXT HARMONIC TONE AND PRECEDING TONE"

$RDOC_1$ = "CONCLUSION : AUXILIARY(1)

$RDOC_2$ = "CONCLUSION : AUXILIARY(2)

$RDOC_3$ = "CONCLUSION : PASSING $RDOC_4$ = "CONCLUSION : APPOGGIATURA $DEARU_1$ = "IS TRUE"

$DEARU_0$ = "IS FALSE"

FIG.73

EXAMPLE OF EXPLANATION

<RULE DATA>

| | L | X | U | Y | N |
|---|---|---|---|---|---|
| 1 | 0 | 4 | 0 | 2 | 3 |
| 2 | 1 | 7 | ∞ | -1 | -2 |
| 3 | 1 | 6 | 1 | -3 | -4 |

EXAMPLE OF RULE DATA

FOR $MD_1$ = "DO" CHORD ; Cmaj $MD_2$ = "RE"

$MD_3$ = "MI"

⟨DISPLAY⟩

0 ≦ PITCH INTERVAL BETWEEN TWO HARMONIC TONES ≦ 0 IS FALSE $\underbrace{1}_{LP}$ $\underbrace{\leq \text{ MONOTONOUS PITCH INCREASE/DECREASE IDENTIFIER}}_{XDOC_6}$ $\leq \underbrace{1}_{UP}$ $\underbrace{\text{IS TRUE}}_{DEARUtru}$ $\underbrace{\text{CONCLUSION : PASSING}}_{RDC\text{-}p}$

FIG. 75

EXAMPLE OF EXPLAINING REASONING

ADD NODE

ADD NODE

DELETE NODE

DELETE NODE

CORRECT CONCLUSION

MONITOR MUSICAL KNOWLEDGE IN TREE STRUCTURE

MONITOR MUSICAL KNOWLEDGE

AUTOMATIC COMPOSER

This application is a continuation of application Serial No. 07/288,001, filed Dec. 20, 1988, and now abandoned.

BACKGROUND OF THE INVENTION

The present invention relates an apparatus for automatically composing a music piece.

One of the important considerations of an automatic composer is that the automatic composer in question is capable of composing a music piece familiar to a human i.e. not merely mechanical but full of musicality.

For example, U.S. Pat. No. 4,339,731 issued to E. Aoki on Aug. 23, 1983 discloses an automatic composer comprising means for randomly sampling individual pitch data from a set of pitch data such as a twelve note scale data and means for checking whether the sampled data satisfies limited musical conditions. When the sample satisfies the conditions, it will be accepted as a melody note. If not, the sample is rejected as a melody note and a new sample is taken out for further checking. Accordingly, the basic process by this automatic composer is a trial and error. At the stage where pitch data are randomly sampled, they constitute a totally disordered sequence of pitches, which is remotest from good music: a chance of obtaining a melodic piece would be negligible; as low as once in an astronomical number of times. Hence, the above apparatus provides means for checking sampled data as to their musical conditions, or selecting data by means of a condition filter. The selection standard is, therefore, a key factor. If the selection were too restrictive, generated melodies would lack in variety. If the selection were too wide, the original disorder would be predominant in the melodies generated.

The above-mentioned automatic composer is more suitable for generating a melody remote from any existing music style rather than one familiar to a human, and is primarily useful for music dictation i.e. solfeggio and/or performance exercise, because novel or unfamiliar music is difficult to read or play. The above automatic composer lacks, therefore, in the ability as mentioned at the beginning.

Other techniques of automatic composition are disclosed in USP 4,664,010 to A. Sestero, May 12, 1987 and WO 86/05616 by G. B. Mazzola et. al. Sept. 25, 1986. The former patent relates to a technique of converting a given melody into a different melody by performing a mirror or symmetry transformation of given melody with respect to particular pitches. According to the latter patent application, a given melody is graphically represented by a set of locations in a two dimensional space having a pitch axis (Y axis) and a time axis (X axis). A suitable transformation is carried out over the given melody with respect to the two axis, thus developing a new melody formed with a sequence of pitches and a sequence of tone durations.

Either of the above techniques only employs mathematical transformations such as a symmetry conversion, and cannot be said to contemplate musical properties of melody; thus, the chance of achieving good music compositions would be relatively low as compared to the present invention.

Another automatic composer is disclosed in Japanese Patent laid open (Kokai) 62-187876 by the present inventor, Aug. 17, 1987. This apparatus comprises a table representing frequencies of pitch transitions and a random number generator. In operation, tone pitches are successively developed from the outputs of the frequency table and the random number generator to form a melody. The frequency table makes it possible to compose music which accords with the musical style designated by a user. Even this arrangement cannot be said, however to do analysis and evaluation of musical properties of melody for music composition.

Other relevant techniques are disclosed in USP 3,889,568 issued June 17, 1978 concerning a system of chord progression programs, Japanese patent laid open (Kokai) 58-87593, May 25, 1983 and U.S. Pat. No. 4,539,882, Sept. 10, 1985 concerning an apparatus for automatically assigning chords to a melodic line.

An automatic composer solving the problems in the prior techniques cited above has been recently proposed by the present inventor (U. S. patent application Ser. No. 177,592, filed on Apr. 4, 1988). The automatic composer comprises a melody analyzer means for analyzing a melody (motif) provided by a user and a melody synthesizer for synthesizing a melody from a given chord progression and the result of the melody analysis. The melody analyzer includes nonharmonic tone classifying means for classifying nonharmonic tones contained in the input melody. The melody synthesizer has an arpeggio generator for generating arpeggio tones in accordance with the chord progression and nonharmonic tone adding means for adding nonharmonic tones to the generated arpeggio tones. Therefore, the features of the melody (motif) input by the user are expanded in the melody generated by the automatic composer. In addition, the automatic composer regards a melody as a row of harmonic tones mixed with nonharmonic tones: First, the arpeggio generator completes a succession of tones consisting of only harmonic tones. Then, the nonharmonic tone addition means combines nonharmonic tones with the succession of harmonic tones, thus completing a melodic line. This approach increases the chance of obtaining a good music piece.

However, the automatic composer still leaves room for improvement which is the primary object of the present invention. Disadvantages of the automatic composer are:

(a) a synthesized melodic line following the input melody tends to deviate from the input melody because of incomplete reversibility between the melody analysis and the melody synthesis;

(b) interaction between the hierarchic structure in melody and that in chord progression is ignored;

(c) because the musical knowledge applied in the automatic composer is permanently built in the system, the knowledge is difficult to change; and (d) tonality of music can be deceived or vague because there is no means preventing the melody synthesizer from using a tone other than scale notes.

SUMMARY OF THE INVENTION

The present invention is applied to an automatic composer employing melody input means for providing a melody, chord progression input means for providing a chord progression, melody analyzer means for analyzing the melody provided by the melody input means and melody synthesizer means for synthesizing a melody from the chord progression provided by the chord progression input means and the result of analysis from the melody analyzer means. The melody analyzer means includes nonharmonic tone classification means for classifying nonharmonic tones contained in the melody provided by the melody input means. The melody synthesizer means comprises arpeggio generator means for producing arpeggio tones in accordance with the chord progression provided by the chord progression input means and nonharmonic tone addition means for adding nonharmonic tones to the arpeggio tones produced by the arpeggio tone generator means.

In accordance with the invention, the automatic composer further comprises knowledge base means for storing knowledge of classifying nonharmonic tones in a melody. The nonharmonic tone classification means and the nonharmonic tone addition means are adapted to execute the classification and addition of nonharmonic tones, respectively, by applying the knowledge stored in the knowledge base means as a common source of musical knowledge.

Preferably, the knowledge in the knowledge base means forms a net of a plurality of rules. Each rule consists of a condition part and two alternative consequent parts branching out from the condition part. One of the consequent parts (then-part) points to a rule to be applied next, if any, for forwarding inference when the condition part is satisfied or indicates a nonharmonic tone identifier concluded by the inference if there is no more rules to be applied. The other consequent part (else-part) points to a rule to be applied next, if any, for forwarding inference when the condition part is not satisfied or indicates a nonharmonic tone identifier if there is no more rule to be applied.

In order to determine whether the condition part is satisfied, it is necessary to understand the situation of a melody under test. In an embodiment, the situation of melody is represented by a plurality of functions which are computed by function calculator means. Using the computed situation, the nonharmonic tone classification means and the nonharmonic addition means proceed with the reasoning by testing one condition after another in the knowledge base means.

In adding a nonharmonic tone to arpeggio tones, if there is an exceedingly large pitch interval between harmonic and nonharmonic tones, the resultant melody will be heard unnatural. To avoid this, an embodiment employs conditional means which sets pitch limits to a nonharmonic tone from the neighboring arpeggio tones.

In accordance with another aspect of the invention, the automatic composer comprises knowledge management means for correcting the knowledge of classifying nonharmonic tones stored in the knowledge base means according to input correction data. Thus, the automatic composer is provided with the ability of "learning" musical knowledge so that the data stored in the knowledge base means are updated to what is desired by the user. As a result, the automatic composer can analyze and synthesize a melody based on various musical knowledge. A single composer unit virtually functions as a plurality of different automatic composers.

In an embodiment, knowledge management means (knowledge editor) comprises condition adding means for adding a condition for an nonharmonic tone of any particular type (for example, a passing tone) to the knowledge base means, condition deleting means for deleting a condition for an nonharmonic tone of any particular type from the knowledge base means and conclusion changing means for changing the type of a nonharmonic tone concluded when a set of condition are met.

In a further aspect, the invention is applied to an automatic composer employing chord progression providing means for providing a chord progression, melody featuring parameter generating means for generating featuring parameters of a melody and melody synthesizer means for synthesizing a melody from the chord progression and the melody featuring parameters. The automatic composer is characterized in that the featuring parameter generating means comprises hierarchic structure extraction means for extracting a hierarchic structure from the chord progression and featuring parameter control means for controlling the featuring parameters based on the extracted hierarchic structure.

With this arrangement, the hierarchic structure hidden in the chord progression will be present in a melody automatically produced whereby the consistency and variety of melody is controlled. In an embodiment, the hierarchic structure extraction means comprises matching evaluation means for evaluating (phrase-to-phrase) similarities among segments of the chord progression for respective phrases of a music piece and structure assigning means for assigning hierarchic structure identifiers to the respective phrases.

The featuring parameter control means may control a pattern of arpeggio tones and/or range of a melody for the melody synthesizer means.

The featuring parameter generating means may comprise melody input means for inputting a melody and featuring parameter extraction means for analyzing the input melody to extract featuring parameters which are, in turn, modified by the featuring parameter control means according to the extracted hierarchic structure.

For example, using the hierarchic structure data, the pattern of arpeggio tones is controlled as follows. For a phrase whose structure is identical or similar to that of the input melody, the pattern of the arpeggio tones contained in the input melody (one of the featuring parameters extracted by the featuring parameter extraction means) is used without any change. For a phrase having a different structure, the pattern of the arpeggio in the input melody is modified by using parameters featuring the arpeggio pattern in the input melody to control a arpeggio pattern for the phrase in question.

The extracted hierarchic structure data may also be used to control other parameters of melody (e.g., rhythmic parameter such as a pulse scale).

In a further aspect of the invention, there is provided an apparatus for analyzing a chord progression. The apparatus comprises chord progression providing means for providing the chord progression and key determining means for maintaining a key in the current chord interval unchanged from the key in the preceding interval whenever all the members of the chord in the current interval (as supplied from the chord progression providing means) are included in a scale having the key in the preceding interval and for successively changing a key to related keys when the chord in the current interval contains a member outside the scale of the key in the preceding interval until a changed key is found whose scale contains all the members of the chord in the current interval, whereby the found key specifies the key in the current interval.

This arrangement can be applied to an automatic composer employing melody generator means for generating a melody in accordance with a chord progression. In this application, the melody generator selects a melody tone from the scale having the key determined by the key determining means.

In this manner, musical knowledge about tonality is implemented by the key determining means. Therefore the key determining means can provide key structures having properties that are appropriate to music.

BRIEF DESCRIPTION OF THE DRAWING

The above and other objects, features and advantages of the invention will become more apparent from the following description in connection with the drawing in which:

FIG. 7 shows a list of main variables used in the embodiment;

FIGS. 8, 9, 10, 11 and 12 show a data format used in the embodiment;

FIG. 14 shows an example of chord progression data stored in a chord progression memory;

FIG. 16 shows an example of pulse scale data stored in a pulse scale memory;

FIG. 18 shows an example of production rule data stored in a production rule memory;

FIG. 26 is a flowchart for computing Ps, Pe, Pss and Pee;

FIG. 31 is a flowchart for decomposing a chord into members;

FIG. 35 is a flowchart for computing functions P representing the situation of a melody under examination;

FIG. 49 illustrates a process of extracting a key structure from a chord progression;

FIG. 55 exemplifies an arpeggio pattern buffer;

FIG. 65 is a flowchart for distinguishing between scale and non-scale notes;

FIG. 73 shows examples of explanations;

FIG. 75 shows a displayed example of explaining reasoning;

DETAILED DESCRIPTION OF A PREFERRED EMBODIMENT

Figure 1:
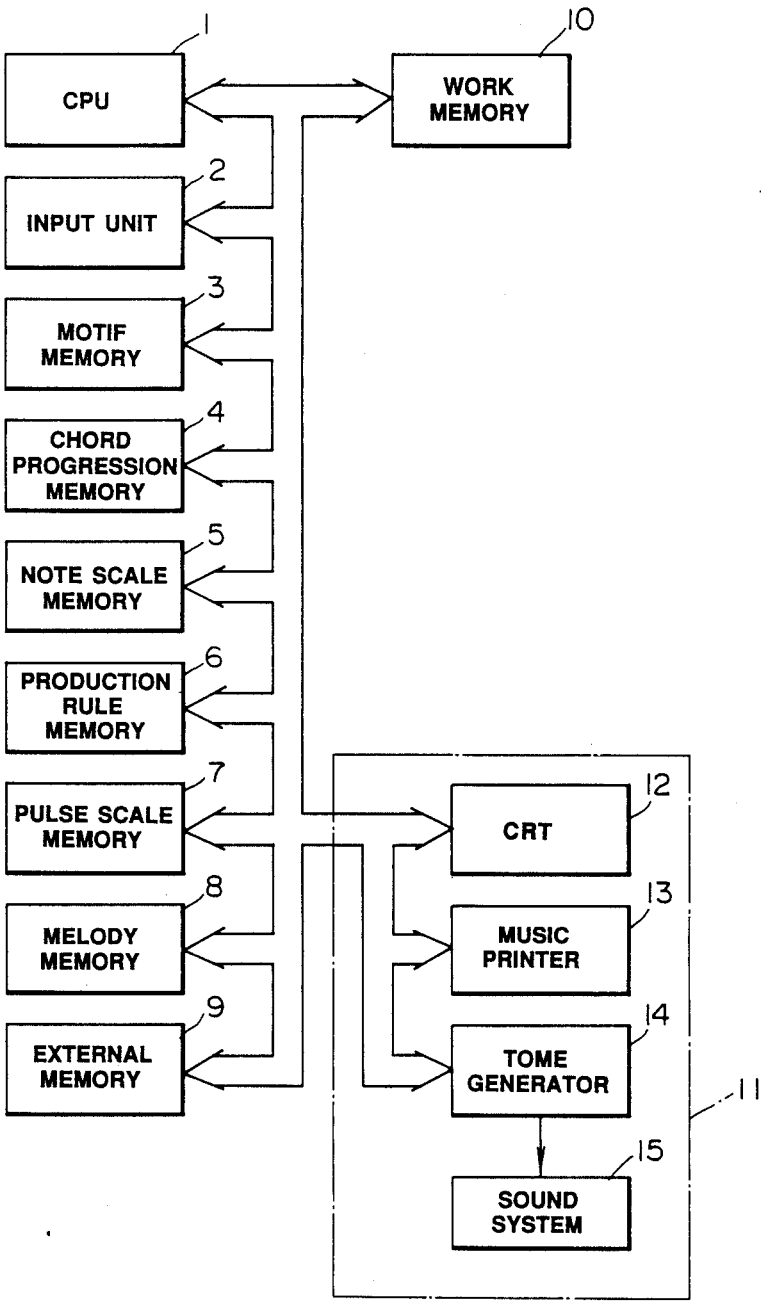
FIG. 1 shows an overall arrangement of an automatic music composer and analyzer embodying the present invention.

An illustrated embodiment of the invention is comprised of a system which can function as a music composer, a melody analyzer and a musical knowledge editor. In the musical composer mode, the system takes an approach in which harmonic tones are first produced and nonharmonic tones are subsequently combined with the harmonic tones to form a melody. Basic data for musical composition are given, which include a chord progression, a motif (melody input by the user), a pulse scale used for controlling the rhythm or a series of tone durations of a melody to be produced and the type of a reference note scale. The individual tones contained in the motif are distinguished between harmonic and nonharmonic tones according to chord data used for each motif segment. The motif deprived of the nonharmonic tones constitutes an arpeggio of the motif. From the arpeggio, its pattern and feature (featuring elements contained in the pattern) are derived. After separating the motif into harmonic and nonharmonic tones, the respective types or characters of the individual nonharmonic tones are identified by utilizing musical knowledge of classifying nonharmonic tones (which is stored in a production rule memory to be described later). Thus, data describing what kinds of nonharmonic tones are contained in the motif and how they are distributed (i.e., features of the nonharmonic tones) are obtained. Further, the hierarchic structure and key structure in music are extracted from the chord progression.

The process of melody generation comprises steps of generating an arpeggio, adding nonharmonic tones to the arpeggio and generating a tone duration series. In the arpeggio generation step, the generation of arpeggio is controlled according to the hierarchic structure extracted from the chord progression data. When the hierarchic structure is instructive of the generation of a new arpeggio, a pattern of the new arpeggio is first generated from features of arpeggio pattern (as obtained or modified from the motif), and the generated pattern is converted into an arpeggio in the form of a tone pitch series by using a chord corresponding to the pattern. Thereafter, nonharmonic tones are added to the generated arpeggio. The musical knowledge noted above is again utilized for adding nonharmonic tones. In the inference or reasoning of the addition of nonharmonic tones, the nonharmonic tones which can be added should satisfy the features of the nonharmonic tones and also be scale notes. A scale note is a note contained in a scale which is obtained from rotating or shifting the keynote or tonic of the reference scale according to the key structure extracted from the chord progression. In both the classification and addition of nonharmonic tones, the reasoning is effected using the common musical knowledge. Therefore, the system can provide "reversibility" between the analysis and generation of melody. Perfect reversibility means that when some results are obtained from the analysis of an original melody, the same analysis results are in turn synthesized into a melody identical to the original melody. The tone pitch series of the melody is completed by adding nonharmonic tones to the arpeggio. On the other hand, the tone duration series is obtained by optimally joining or disjoining notes in a reference rhythm (reference tone duration series) using a pulse scale until a desired number of notes (e.g., sum of the numbers of harmonic and nonharmonic tones) has been reached. Which notes are joined or disjoined at which positions depends on the weight of each pulse point of the selected pulse scale. This provides a consistent rhythm control.

In the melody analyzer mode, the embodiment system utilizes the melody analysis function in the music composer mode. Particularly, the musical knowledge noted above is utilized for classifying nonharmonic tones contained in the melody under examination.

In the musical knowledge editor mode, the system provides a man-machine interface which permits the user to correct musical knowledge that is used for music composition and analysis.

[OVERALL ARRANGEMENT]

FIG. 1 shows the overall arrangement of the embodiment of the music composer/melody analyzer. CPU 1 serves as a controller for realizing the music composer function, melody analyzer function and musical knowledge editor function of the embodiment. In the music composer and melody analyzer modes, such data as motif (melody), chord progression, type of pulse scale used and type of note scale used are supplied from an input unit 2. In the musical knowledge editor, such data as request for correction and contents of correction are supplied from the input unit 2. A chord progression memory 4 stores chord progression data which are used by the CPU 1 when analyzing the chord progression or when extracting or generating an arpeggio. A note scale memory 5 stores note scale data representing various note scales. Prior to the composition, the user may select a specific note scale to be used from the set of note scales stored in the memory 5. Production rule memory 6 stores musical knowledge of classifying nonharmonic tones. The stored knowledge is utilized when classifying nonharmonic tones contained in a motif or when adding nonharmonic tones to an arpeggio. Further, when the user wishes to correct the musical knowledge stored in the memory 6, the desired correction is made in the musical knowledge editor mode. Thus, in the composition of music, analysis and generation of melody are performed according to the corrected musical knowledge. A pulse scale memory 7 stores various pulse scales. At the commencement of musical composition, the user can select a desired pulse scale from the pulse scale set by considering the features of the rhythm provided to the intended music. The selected pulse scale is utilized for the generation of the rhythm (i.e., tone duration series) of melody. A melody memory 8 stores completed melody data. An external memory 9 is utilized for copying the melody data stored in the melody memory 8 and also as a source of different musical knowledge and different composition programs. A work memory 10 stores various data such as key structure, hierarchic structure and various variables to be used during the operation of the CPU 1. The music composer further comprises a monitor 11 having a CRT 12, a music printer 13, a tone generator 14 and a sound system 15. The results of composition or analysis can be displayed, sounded or printed through the monitor system. Further, in the musical knowledge editor mode, the musical knowledge is displayed either entirely or partly on the CRT 12. Further, when a correction of musical knowledge is requested from the input unit 2 and effected by the CPU 1, the corrected musical knowledge is displayed.

[OVERALL CONCEPT]

Figure 2:
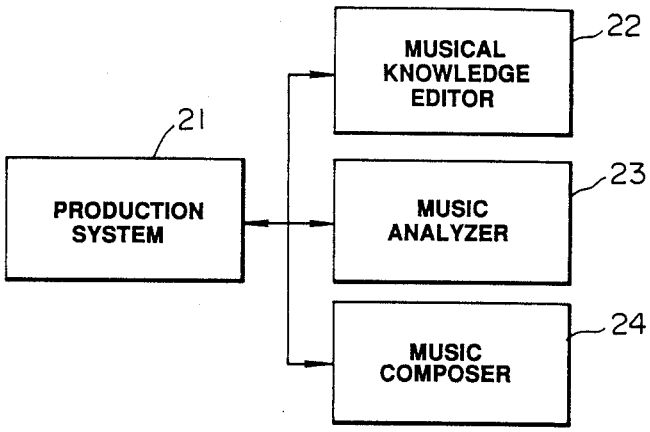
FIG. 2 is a conceptual diagram of the present apparatus viewed from a production system.

As has been shown above, the embodiment of the music composer system can be used as a music composer, a melody analyzer and a musical knowledge editor. FIG. 2 shows the overall concept of the embodiment taken in the aspect of a production system. The illustrated system 21 comprises production rules representing musical knowledge of classifying nonharmonic tones and an inference engine for executing inference or reasoning by using the production rules to solve a problem. A musical knowledge editor 22, a music analyzer 23 and a music composer 24 shown on the right side of FIG. 2 are units which utilize the production system 21 as a resource. For example the music composer 24 utilizes the production system 21 when inserting nonharmonic tones between harmonic tones of arpeggio. The musical knowledge editor 22 serves as a device for correcting musical knowledge represented by the production rules in the production system 21.

[OVERALL FUNCTIONS OF PRODUCTION SYSTEM]

Figure 3:
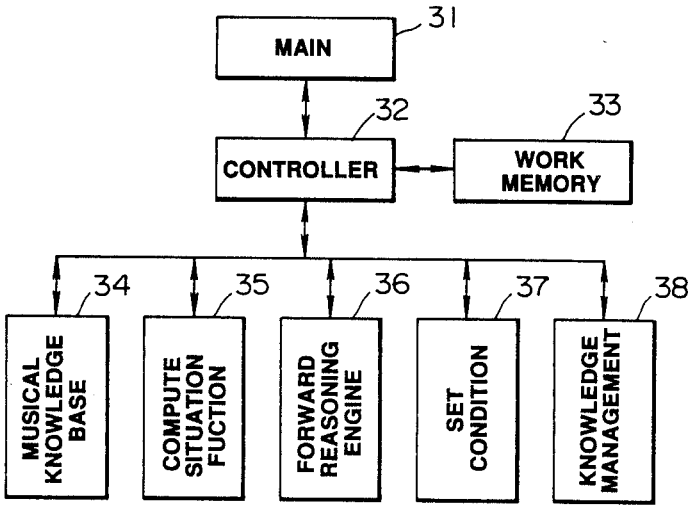
FIG. 3 shows a functional arrangement of the production system.

FIG. 3 shows a functional arrangement of the production system. A main 31 instructs a kind of process to be executed (for instance the classification or insertion of nonharmonic tones) to a controller 32. As a result, the controller 32 selectivity uses other elements for the execution of the instructed process. A work memory 33 stores intermediate results of the process being executed by the controller 32. A musical knowledge base 34 corresponds to the production rule memory shown in FIG. 1, and stores musical knowledge of classifying nonharmonic tones. A function calculator 35 computes various functions from a melody tone series when classifying or inserting nonharmonic tones. A forward reasoning engine 36 executes reasoning for classifying nonharmonic tones in a melody or adding nonharmonic tones to an arpeggio. The same musical knowledge base 34 is utilized for both of the classification and addition of nonharmonic tones. A condition setter 37 is provided for setting conditions for adding nonharmonic tones to an arpeggio. A feature of nonharmonic tones distributed in a melody, a range of a nonharmonic tones and other conditions are set in the condition setter 37. A knowledge management unit 38 serves to manage knowledge accumulated in the musical knowledge base 34. The correction of musical knowledge is done by the user through the knowledge management unit 38.

[GENERAL FLOW OF MUSIC COMPOSER]

Figure 4:
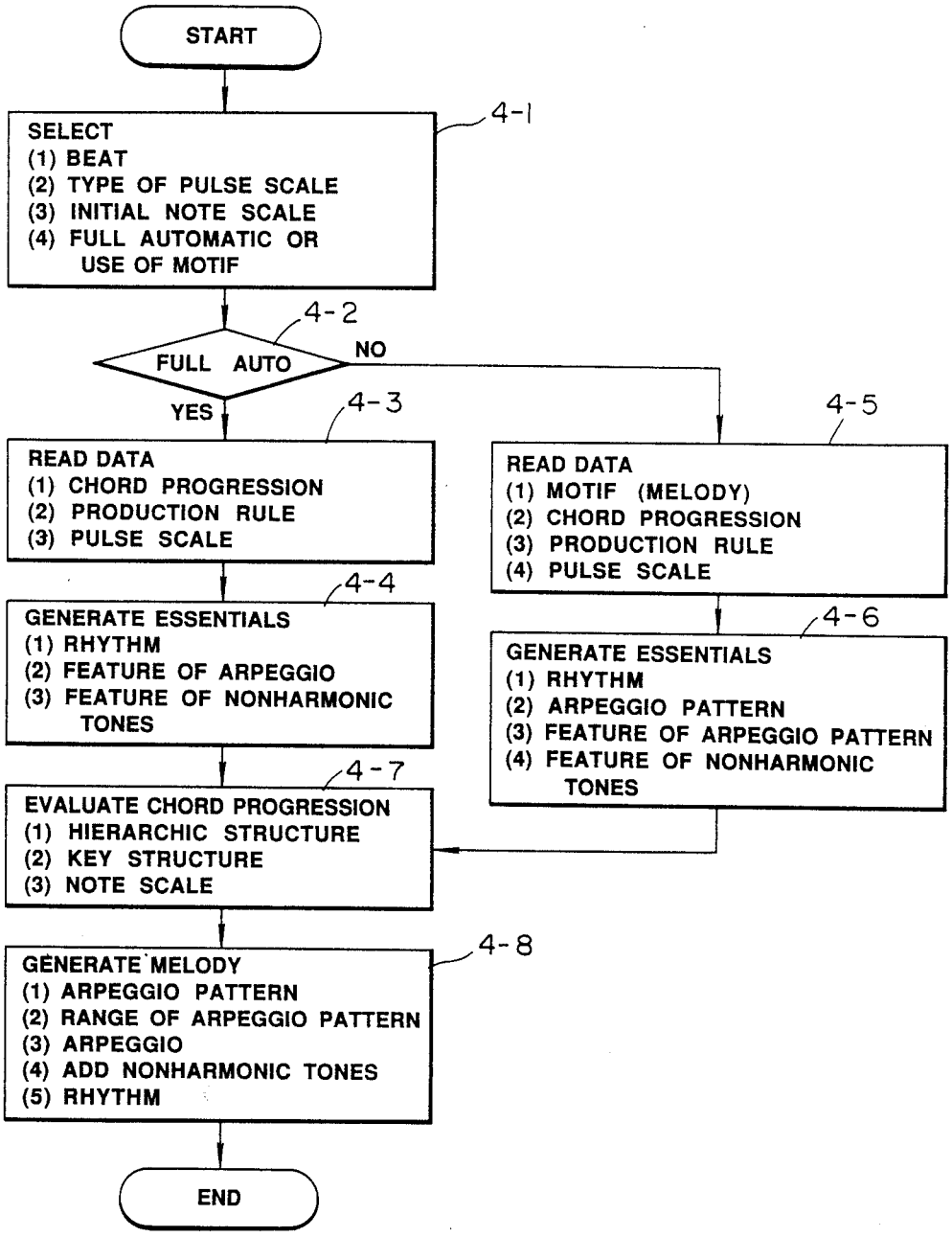
FIG. 4 is a general flowchart of the composer.

FIG. 4 shows of the operation of the music composer. In an initialization step 4-1, basic data for music composition are supplied to the music composer by the user. These data include (1) BEAT, (2) type of pulse scale, (3) initial note scale and (4) selection of whether the composition is fully automatic or based on the use of a motif. BEAT is the duration of one bar in terms of the number of elementary times each defining the shortest note. Thus, it defines the musical time. For example, with 4-time music, if BEAT is set to 16 assuming that the elementary time is a sixteenth note duration, one bar amounts to four times. The pulse scale selected in the initialization step 4-1 serves to primarily control the rhythm of music composed by the music composer. The pulse scale has a weight representing the likelihood of joining or disjoining notes at each of pulse points spaced apart at an interval corresponding to the elementary time (see FIGS. 11 and 16). Using the pulse scale, the tone duration series of a melody is controlled. Therefore, selection of a pulse scale means selection of a rhythmic feature of music composed by the music composer. The note scale that is selected in the step 4-1 (for instance, the diatonic scale) is used by the music composer for the composition. Further, in the initialization step 4-1 the user makes a decision as to whether music is to be composed fully automatically or by using a motif. When music is composed fully automatically, (1) chord progression, (2) production rule and (3) pulse scale are read as necessary data for the composition into the work memory 10 in a step 4-3. In a step 4-4, (1) a reference rhythm (i.e., tone duration pattern), (2) features of arpeggio pattern (PCi, see FIG. 9) and (3) features of nonharmonic tones (RSi, see FIG. 9) are generated according to user's instructions. When music is composed by using a motif, a motif (i.e., input melody) is read in addition to the data noted above (step 4-5). In a step 4-6, essential data, i.e., (1) a rhythm, (2) an arpeggio pattern, (3) features of arpeggio patterns and (4) features of nonharmonic tones, are extracted from the motif. In particular, the features of nonharmonic tones are extracted by means of inference using the production rules. In either of the full automatic and motif utilization modes, the chord progression is evaluated in a step 4-7, in which (1) a hierarchic structure, (2) a key structure and (3) a note scale are generated from the chord progression data. The hierarchic structure expresses the consistency and variety of music inherent in the chord progression. The key structure defines the keynote or tonic of the note scale used in each melody segment. A process shown as "note scale" is provided to use a specific note scale for a segment corresponding to a certain specific chord irrespective of the initially selected note scale. Up to the step 4-7, an "analytic work" for the composition is completed. For example, features of arpeggio pattern are data necessary for the generation of the arpeggio pattern, and features of nonharmonic tones characterize the nonharmonic tones which are added to the arpeggio. The production rules are used to verify the nonharmonic tones added to the arpeggio. The key structure limits melody tone candidates in each segment. The hierarchic structure can be utilized for making a decision as to whether a new arpeggio pattern is to be generated. The pulse scale is utilized for the generation of a rhythm. In a melody generation step 4-8, (1) selective generation of an arpeggio pattern (LLi, see FIG. 9), (2) setting of an arpeggio pattern pitch range, (3) generation of an arpeggio in the form of pitches, (4) addition of nonharmonic tones and (5) generation of a rhythm are effected.

The music composer mode will be described later in detail with reference to FIGS. 13 to 70.

[GENERAL FLOW OF MELODY ANALYZER]

Figure 5:
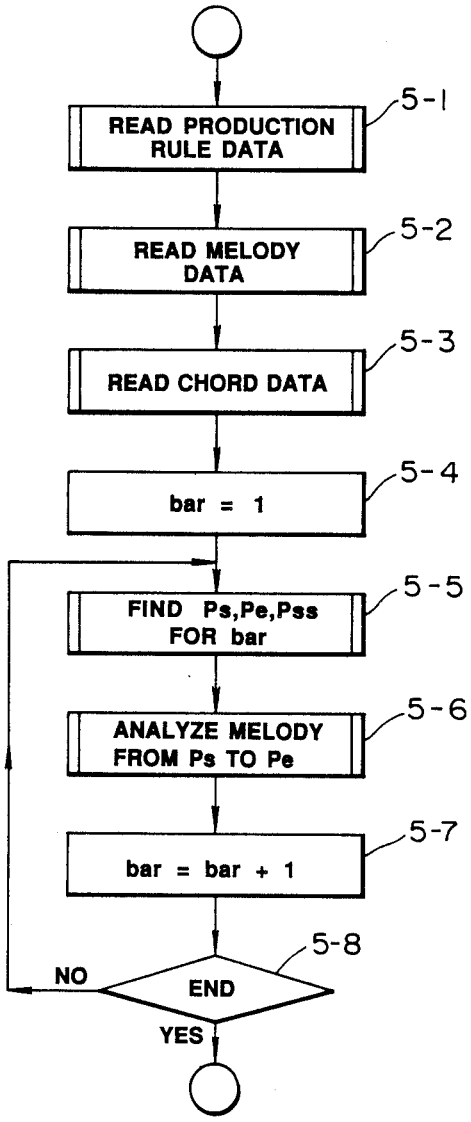
FIG. 5 is a general flowchart of the music analyzer.

FIG. 5 shows a general flow of operation of the system in the melody analyzer mode.

The illustrated flow is designed to analyze an input melody bar after bar. In the Figure, "bar" represents the bar number, Ps the data number of the first note in a bar under consideration, Pe the data number of the last note of a bar under consideration, and Pss the duration, by which the first note extends in the preceding bar. The essence of this flow is a melody analysis which is executed in a step 5-6. In this step, the character of each melody tone in a bar under consideration is analyzed by reasoning using the production rules.

While the illustrated flow is designed to analyze a melody in respect of classification of nonharmonic tones, it is readily possible to modify the flow such that the hierarchic structure and key structure are also analyzed.

The melody analysis will be described later in detail with reference to FIGS. 71 to 75.

[GENERAL FLOW OF MUSICAL KNOWLEDGE EDITOR]

Figure 6:
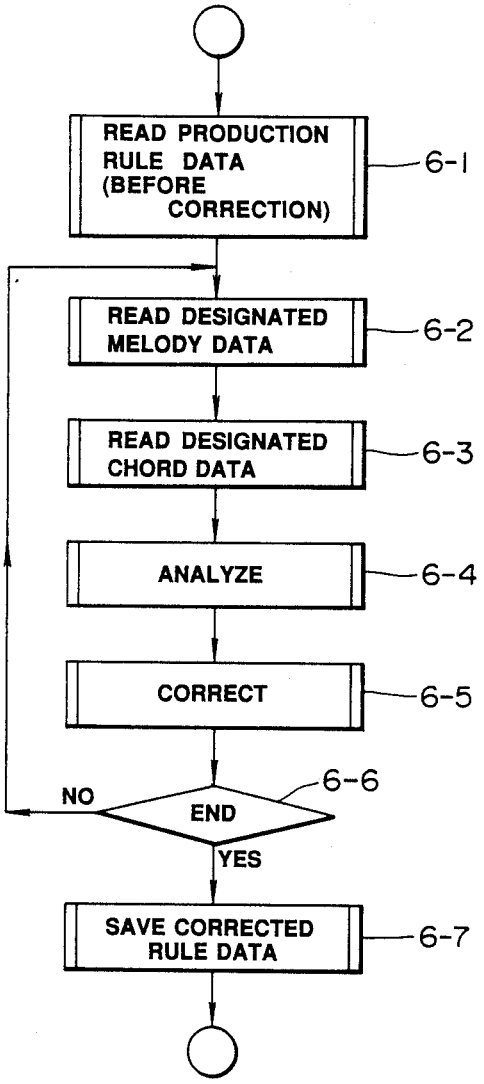
FIG. 6 is a general flowchart of musical knowledge editor.

FIG. 6 shows a general flow of operation of the system in the musical knowledge editor mode.

The purpose of the musical knowledge editor is to provide an interface for correcting musical knowledge (i.e., knowledge of classifying nonharmonic tones) represented by the production rules according to the user's decision. One of effective means for providing a readily understandable correction involves analyzing a specific case by reasoning on the basis of the existing production rules, letting the user make a decision as to whether the results of analysis are satisfactory. If the results of analysis are undesired by the user, correct the musical knowledge of the production rules such that subsequent analysis results in what is desired by the user. This is realized by the flow shown in FIG. 6. In a step 6-4 of the flow, a nonharmonic tone analysis of a specified melody is executed according to the production rules, and the results of analysis and reasoning used to obtain the analysis results are displayed. In a step 6-5, a correction of the production rules as desired by the user is effected as necessary.

The operation of the musical knowledge editor shown in FIG. 6 will be described later in detail with reference to FIGS. 76 to 88.

The entirety of the production rules forms a tree of knowledge, and to let the user monitor the production rule tree is thought to be effective means for the knowledge correction. This will be described in detail with reference to FIGS. 81 and 82.

[VARIABLE LIST, DATA FORMAT]

FIG. 7 shows a list of main variables used in flowcharts to be described later, and FIGS. 8 to 12 show data formats. The illustrated data formats are given as an example, and it is possible to select other data formats as well.

[[MUSIC COMPOSER MODE]]

Now the music composer mode of the embodiment will be described in detail.

[INITIALIZATION]

Figure 13:
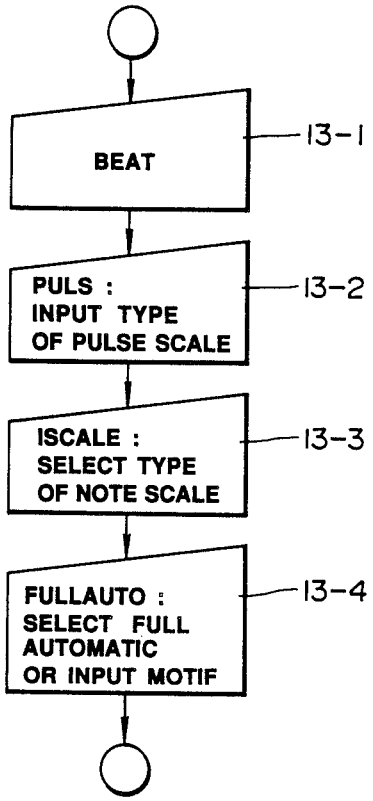
FIG. 13 is a flowchart for initialization.

FIG. 13 shows details of the initialization step 4-1 in the music composer mode flow (FIG. 4). The meanings of BEAT, type of pulse scale (PULS), type of note scale (ISCALE) and full automatic or motif-oriented composition as selected in this initialization step have already been described in connection with FIG. 4, and therefore they are no longer described again. The value of PULS serves as a pointer to a specific pulse scale stored in the pulse scale memory 7, and the value of ISCALE serves as a pointer to a specific note scale stored in the note scale memory 5.

[READING OF DATA]

As seen from the music flow shown in FIG. 4, reading of data is executed in step 4-3 or 4-5 after the initialization. In the case of the full automatic composition, no motif data reading is done for no motif is used as basic data for composition. The reading of individual data will be described hereinbelow.

Figure 15:
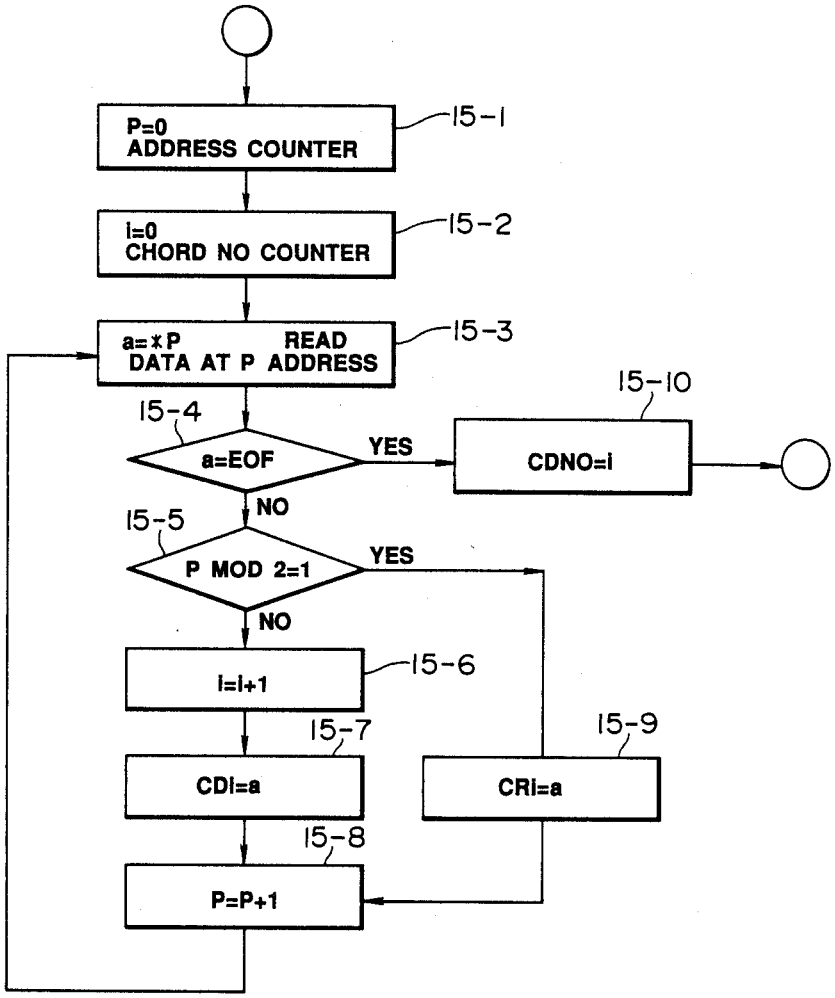
FIG. 15 is a flowchart for reading chord progression data.

FIG. 14 shows an example of the chord progression data in the chord progression memory 4 (FIG. 1), and FIG. 15 shows a flowchart for loading the chord progression data from the chord progression memory 4. In the example of data shown in FIG. 14, types of chords are located in even numbered addresses, and lengths of the chords are positioned in next addresses (odd addresses). For example, data CDi of hexadecimal 507 represents a G7th chord, and CRi of hexadecimal 10 represents a chord length which is 16 times the elementary time of, say, sixteenth note.

In FIG. 15, i-th chord appearing in music being composed is set in a register CDi, and the length of that chord is setting a register CRi. The total number of chords is set in a register CDNO. The other operations in the flow of FIG. 15 are obvious and are not described.

Figures 11, 12:
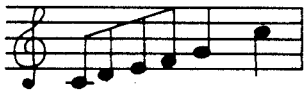
Figure 17:
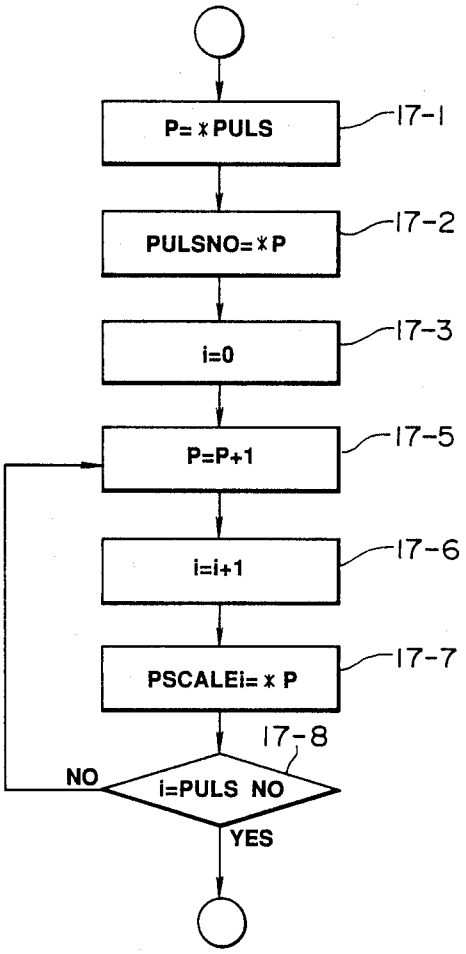
FIG. 17 is a flowchart for reading pulse scale data.

FIG. 16 shows an example of the pulse scale data stored in the pulse scale memory (FIG. 1). FIG. 17 shows a flow for loading the pulse scale from the pulse scale memory 7 as selected in the initialization. In this example, the type of pulse scale (PULS) selected in the initialization step for choosing a rhythmic feature of music to be composed points to a specific address (for instance "0") in the pulse scale memory 7, and stored in this address is a start address of the selected pulse scale data. This start address stores the number of sub-scales (having weights of only "0" and "1" ) constituting the pulse scale, and individual sub-scale data are stored in succeeding addresses. For example, the normal pulse scale consists of five sub-scales "FFFF", "5555", "1111", "0101" and "0001" (hexadecimal notion), whose binary expressions are shown in FIG. 11. In the case of normal pulse scale, the first pulse point (rightmost position of the data shown in FIG. 16) has the maximum weight of "5". This means that when the normal pulse scale is selected, a note is most liable to be present in the first position of each segment (e.g., bar) of the rhythm that is generated.

Figure 19:
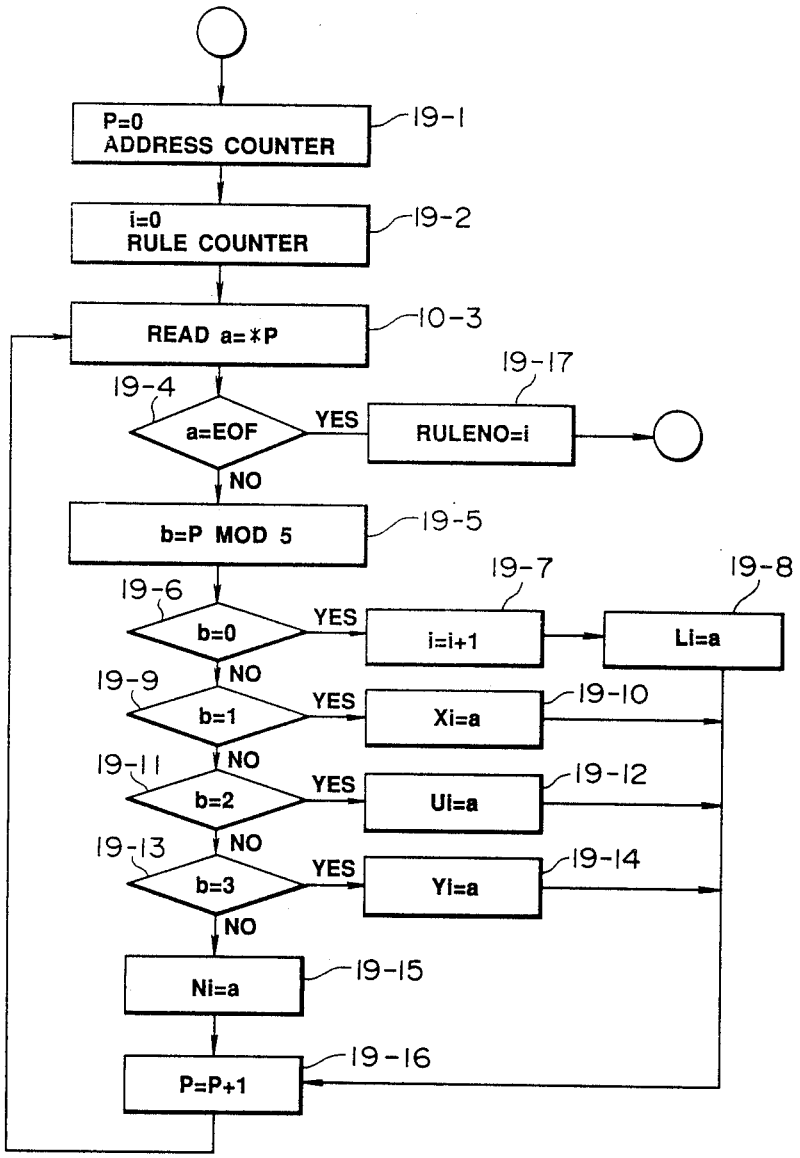
FIG. 19 is a flowchart for reading production rule data.

FIG. 18 shows an example of the production rule data stored in the production rule memory 6 (FIG. 1). FIG. 19 shows a flowchart for reading data from the memory 6. The entirety of the production rules represents musical knowledge of classifying nonharmonic tones contained in a melody. Each production rule data contains lower limit data Li, function data Xi designating type of function, upper limit data Ui, these data defining a condition part of the rule, and data Yi and Ni as a consequent parts of the rule. Each function is a numerical expression of a feature of the melody that is analyzed. An example of the functions to be described later is shown in FIG. 35. The condition part states that the value Fxi of a function represented by data Xi is greater than or equal to Li and less than or equal to Ui ($Li \leqq Fxi \leqq Ui$). If the condition is met, the result is shown by data Yi, and otherwise it is shown by data Ni. If the data Yi or Ni has a positive value, the value represents the production rule number to be referenced next in forward reasoning. If the data has a negative value, the absolute value thereof represents the type of nonharmonic tone, conclusion of reasoning. The forward reasoning always starts from one rule, called a root. The forward reasoning ends when a negative conclusion Yi or Ni is found.

In production rule data address allocation shown in FIG. 18, each production rule is stored five consecutive addresses with the lower limit data Li in the front. More specifically, data Li is stored in an address which yields a remainder of 0 when divided by 5, data Xi is stored in an address yielding a remainder of 1 in division by 5, data Ui is stored in an address yielding a remainder of 2 in division by 5, data Yi is stored in an address yielding a remainder of 3 in the division, and data Ni is stored in an address yielding a remainder of 4 in the division.

In the flow shown in FIG. 19, the total number of production rules is set in a register RULENO. For the rest, the flow will be obvious from the above description and also from the figure itself.

Figures 20, 22:
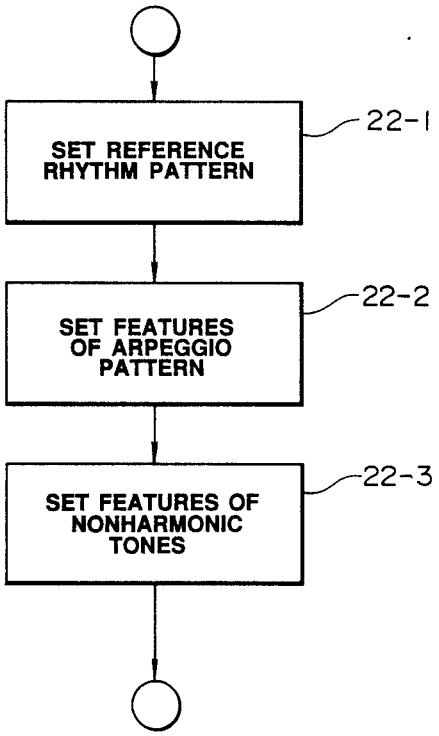
FIG. 20 shows an example of melody data (motif data) stored in a motif memory.
FIG. 22 is a flowchart for generating essentials of music.
Figure 21:
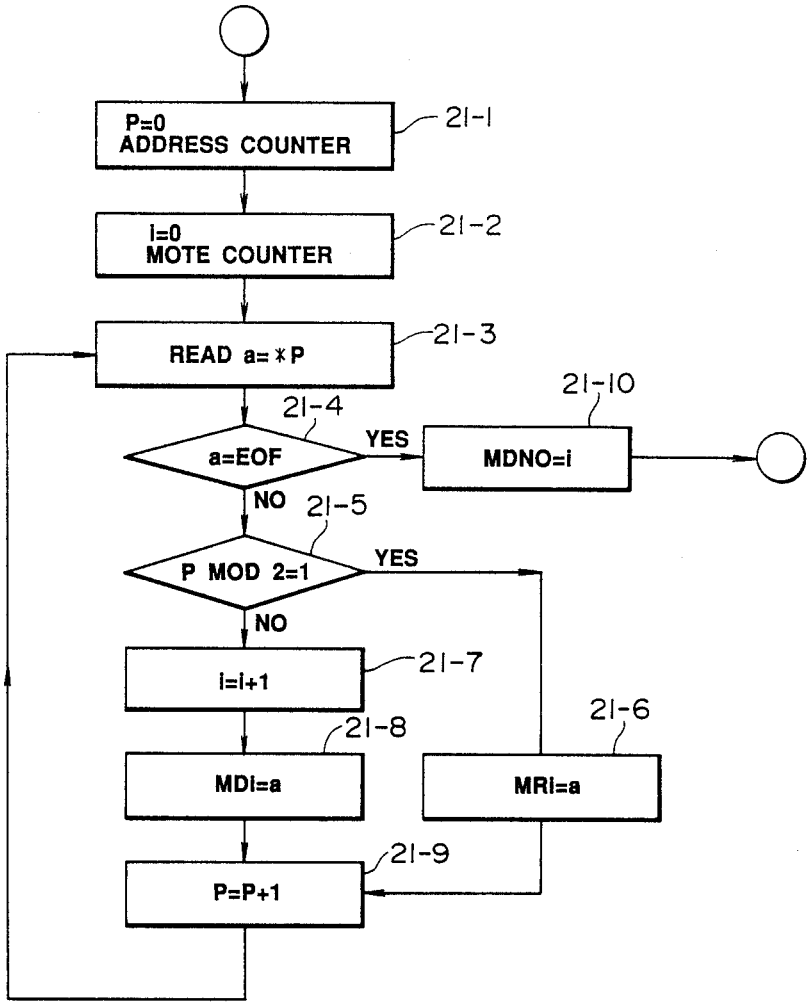
FIG. 21 is a flowchart for reading melody data.

FIG. 20 is an example of motif data (melody data) stored in the motif memory 3 (FIG. 1), and FIG. 21 shows a flowchart for reading motif data as the basis of composition. In the example of FIG. 20, pitch data MDi of each note is stored in an even numbered address, and tone duration data MRi of that note is set in the next odd address. In the flow shown in FIG. 21, the number of motif notes is set in a register MDNO.

[GENERATION OF ESSENTIALS]

Figure 23:
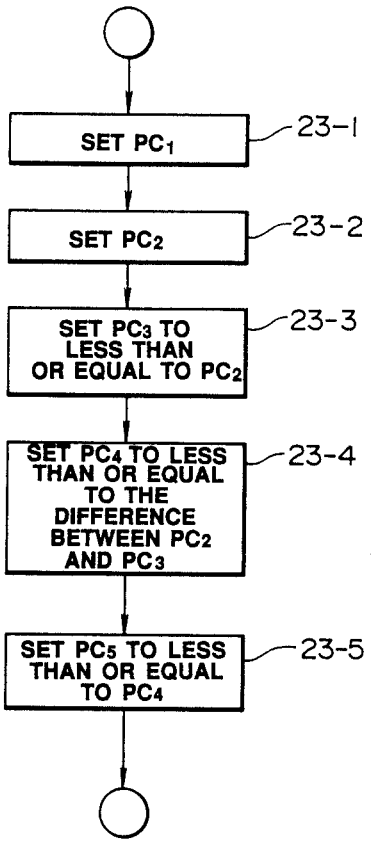
FIG. 23 is a flowchart for setting features of an arpeggio pattern.
Figure 24:
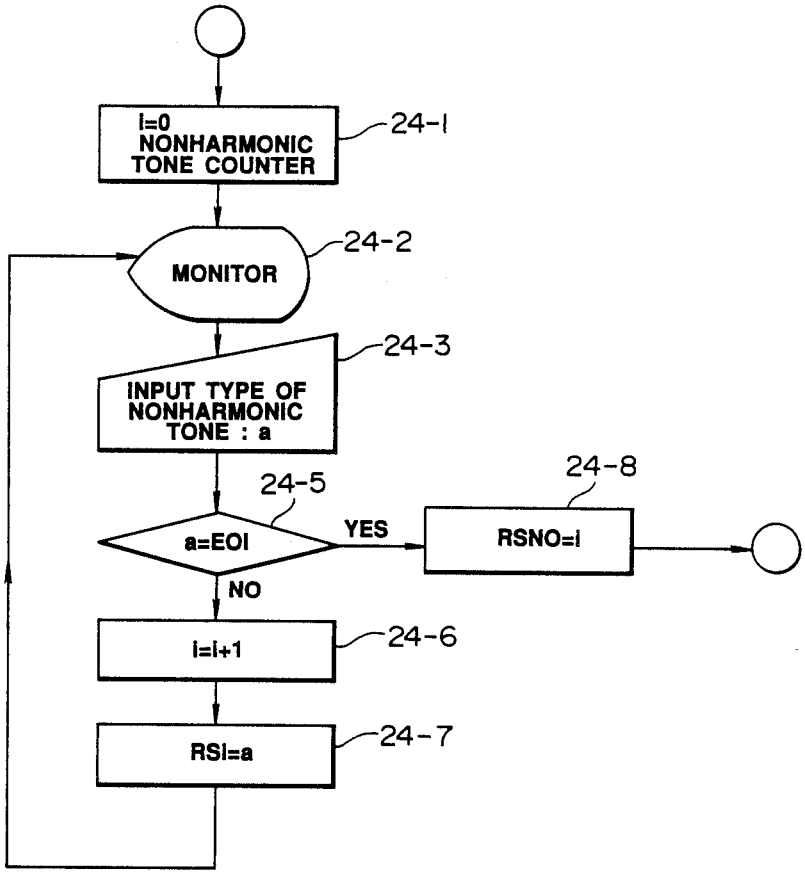
FIG. 24 is a flowchart for setting features of nonharmonic tones.

In the full automatic music composition mode without use of any motif, after having read the basic data, a reference rhythm, features of arpeggio pattern and features of nonharmonic tones are generated as essentials of music (step 4-4 in FIG. 4). FIG. 22 shows a detailed flowchart for generating the essentials. The essentials are generated according to a user's designation or fully automatically. For example, the setting of a reference rhythm pattern in a step 22-1 may be effected with automatic rhythm pattern generation means which automatically generates a reference rhythm pattern, for example,

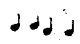

when 4/4 time and normal pulse scale are selected. In the alternative, the user may input a favorite rhythm pattern. The setting of features of arpeggio pattern in step 22-2 and setting of features of nonharmonic tones in a step 22-3 are effected either automatically or according to input by the user. FIG. 23 is a flowchart for automatically setting features of arpeggio pattern using, for example, a random number generator. FIG. 24 is a flow chart for setting features of nonharmonic tones according to input by the user.

In the arpeggio pattern feature setting shown in FIG. 23, PC1 to PC5 respectively represent the number of harmonic tones forming an arpeggio in a segment having a predetermined duration (e.g., a bar), the highest pitch harmonic tone, the lowest pitch harmonic tone, the maximum difference between adjacent harmonic tones and the minimum difference between adjacent harmonic tones (see FIG. 9). The data PC1 to PC5 can be generated for each segment. Each PC may be obtained by setting the upper and lower limits thereto and generating random numbers between the limits. In the alternative, there is provided a data-base which stores a plurality of PC series corresponding to the progression of music. A desired PC series is selected from the data-base.

In nonharmonic tone feature setting shown in FIG. 24, a keyword corresponding to the type a of each nonharmonic tone is displayed by the monitor to request the user's input (step 24-2). A series of nonharmonic tone identifiers a input by the user is set in an array RSi (steps 24-3, 24-6 and 24-7). When a code E01 representing the end of input is encountered, the number of nonharmonic tones is set in a register RSNO to exit from the flow (step 24-8).

[EXTRACTION OF ESSENTIALS]

In the music composition mode utilizing a motif, essentials of music (i.e., rhythm, arpeggio pattern, features thereof and features of nonharmonic tones) are extracted from the motif after the reading of data (step 4-6 in FIG. 4).

FIGS. 25, 29, 32 and 33 show respectively flows of motif rhythm evaluation, arpeggio pattern, arpeggio pattern feature and nonharmonic tone feature extractions. In these flows, each essential is generated for each segment (e.g., bar).

Figure 25:
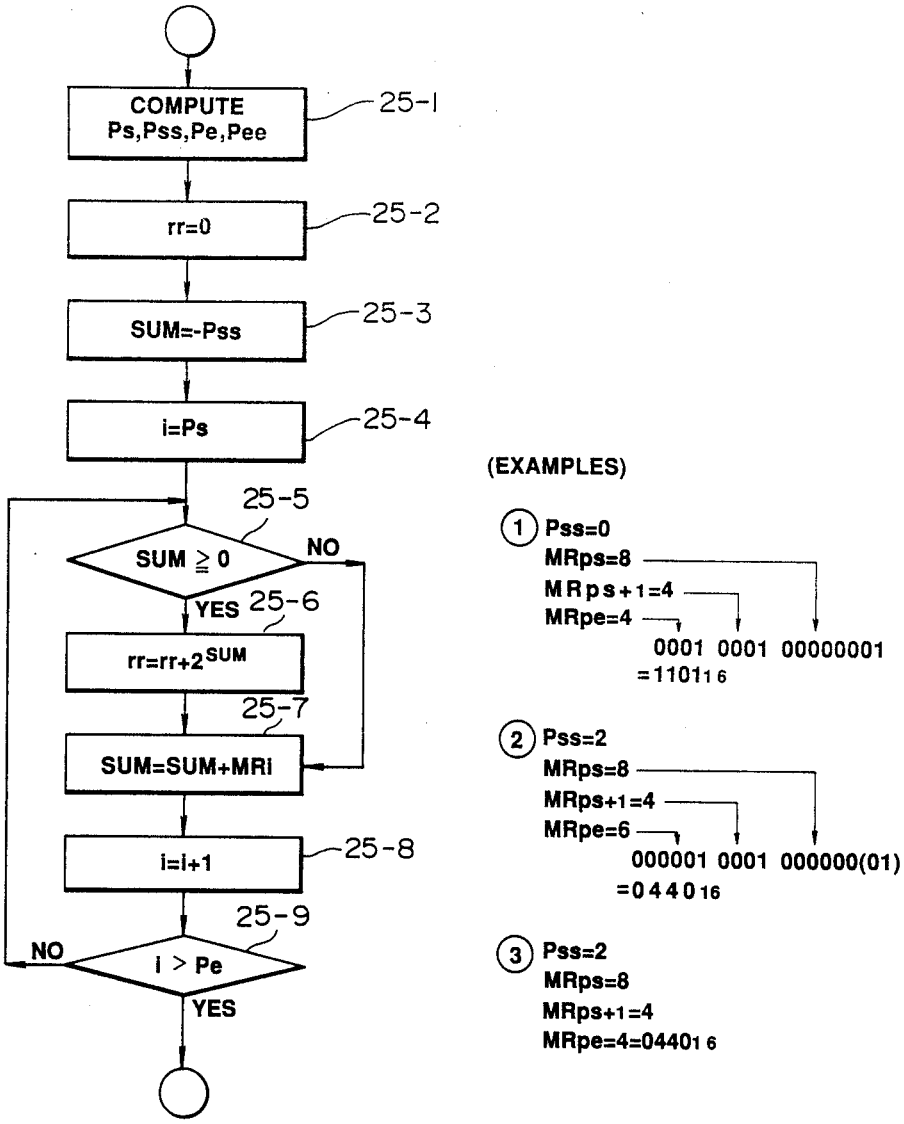
FIG. 25 is a flowchart for evaluating the rhythm of motif for each segment.

In rhythm evaluation flow of FIG. 25, in a step 25-1, positional data representing the position in music of the first note in a bar under consideration is set in Ps, the extent (in elementary time expression), to which the first note in the bar represented by Ps extends in the preceding bar is set in Pss, and positional data of the last note in the bar under consideration (i.e., a note immediately preceding the first note in the next bar) is set in Pe. In a step 25-2, rhythm pattern data for the bar under consideration is set in a 16-bit register rr. Denoting the duration of one bar by 16, the position of the first bit in rr represents the first elementary time of the bar. Likewise, the position of the N-th bit represents the N-th elementary time from the head of the bar. In the process of steps 25-3 through 25-9, the positions of the notes from note Pe to note Pe in the motif are obtained by using motif tone duration data MRi and setting the obtained positional data in corresponding bit positions of the rr register. For example, if rr results in "0001000100010001", this pattern rr represents that tones are generated in the first, second, third and fourth beats of the bar under consideration.

Figure 27:
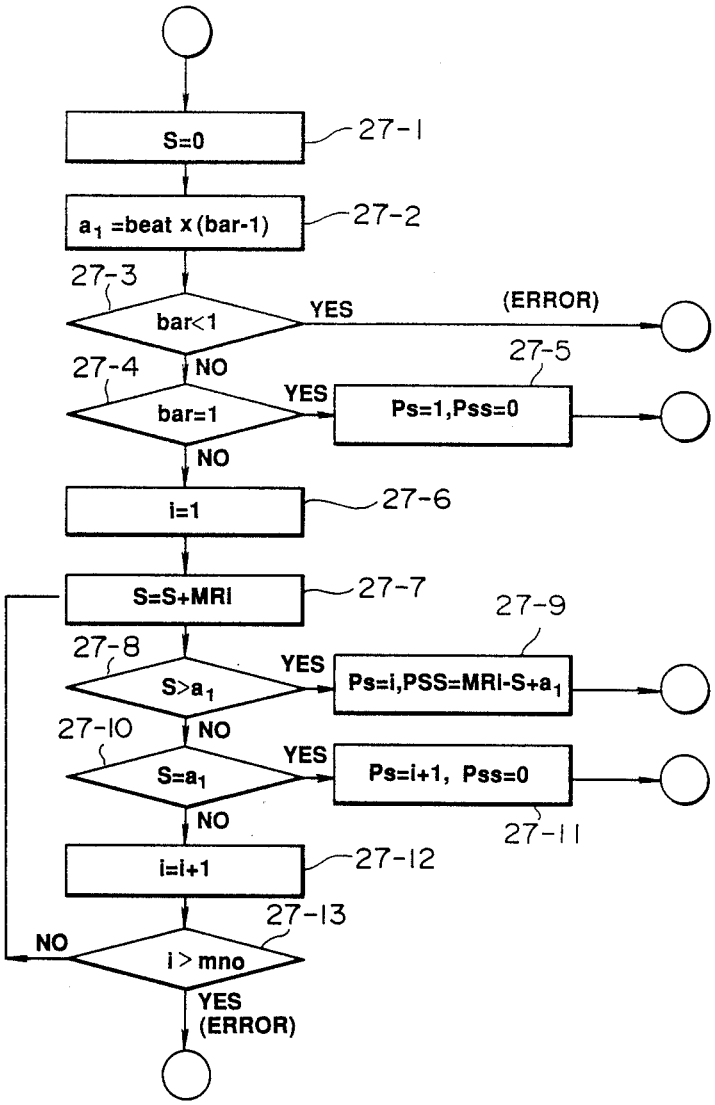
FIG. 27 is a detailed flowchart for computing Ps and Pss.
Figure 28:
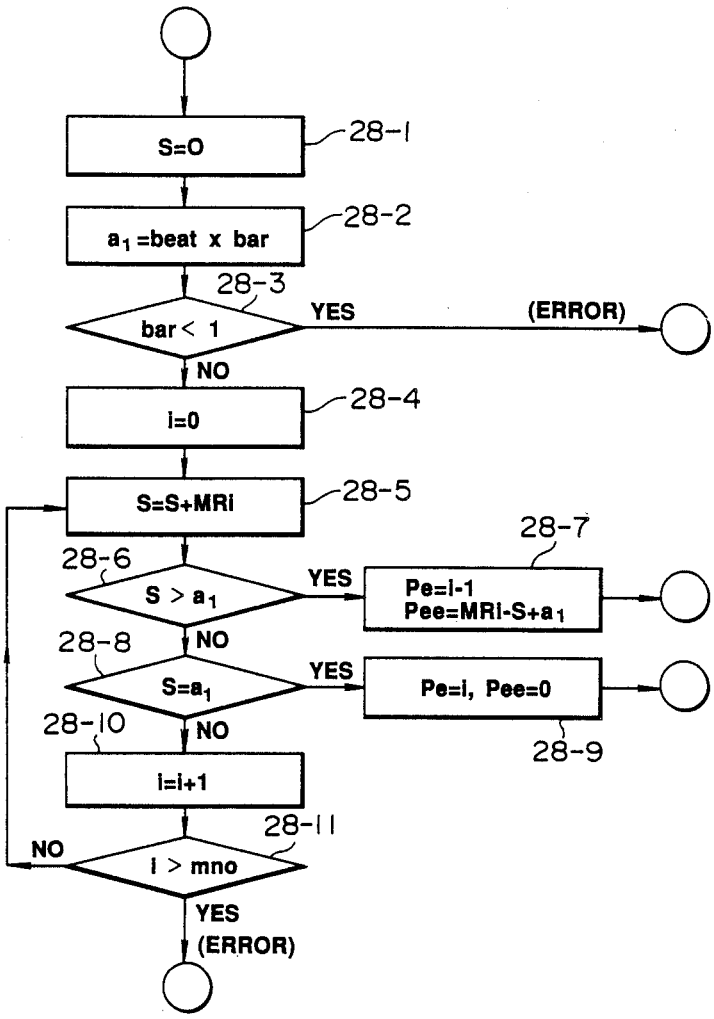
FIG. 28 is a detailed flowchart for computing Pe and Pee.

Details of the calculation of Ps, Pss, Pe and Pee are shown in FIGS. 26 to 28. Pee represents the extent, to which the note next to the note Pe, i.e., the first note in the next bar, extends in the bar under consideration.

In the flow of FIG. 27 for computing Ps and Pss, "beat" represents the duration of one bar in terms of elementary time, "bar" represents the number of the bar under consideration (i.e., bar number designated by the user). If the designated bar number is smaller than "1" or greater than the number mno of bars of music, it is an erroneous input. If the designated bar number is "1", Ps and Pss are respectively "1" and "0" (steps 27-4 and 27-5). The reason for Ps=1 is that the first note in the first bar is the first note of music or the first note of the entire motif. The reason for Pss=0 is that there is no preceding bar. Data a1 obtained in a step 27-2 represents the duration from the start of music to the front bar-line of the bar under consideration. This duration a1 is compared to the duration S obtained by accumulating tone duration data MRi of the motif from the start thereof (steps 27-7, 27-8, 27-10 and 27-12). When S=al satisfied, a note next to i-th note data last added to S begins at the start of the bar under consideration. In this case, set Ps=i+1 and Pss=0 (27-11). If S>al, the note last added to S, i.e., the i-th note is the first note in the bar under consideration. Thus, Ps=i is set. Also, Pss=MRi−S −a1 is set (27-9).

The flow of FIG. 28 for calculating Pe and Pee well resembles the flow of FIG. 27. In this case, however, the duration from the start of music to the rear bar-line in the bar under consideration is set in a1. The rest of the flow will be obvious and hence is not described.

Figure 29:
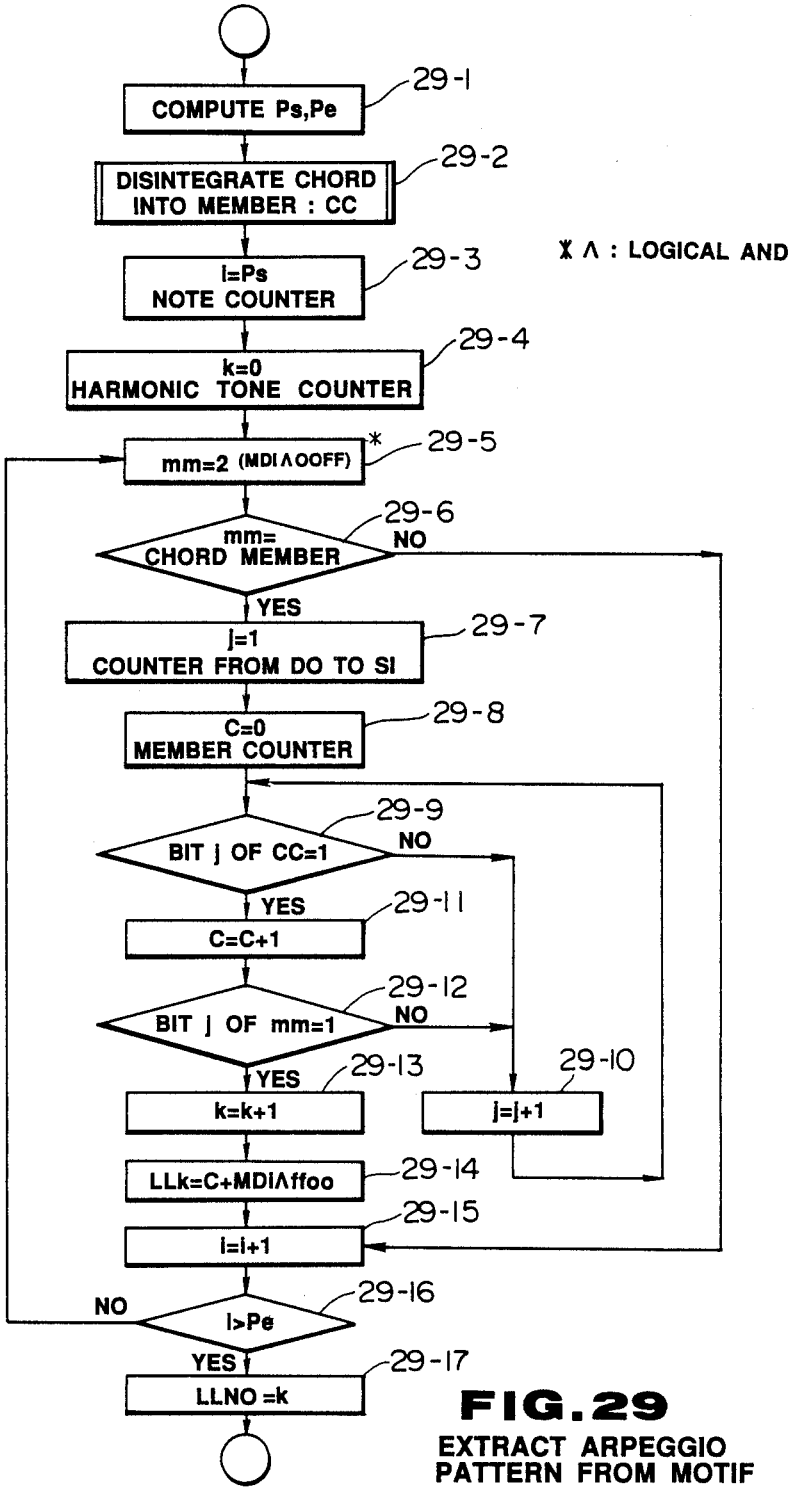
FIG. 29 is a flowchart for extracting an arpeggio pattern from a motif.
Figures 30, 32:
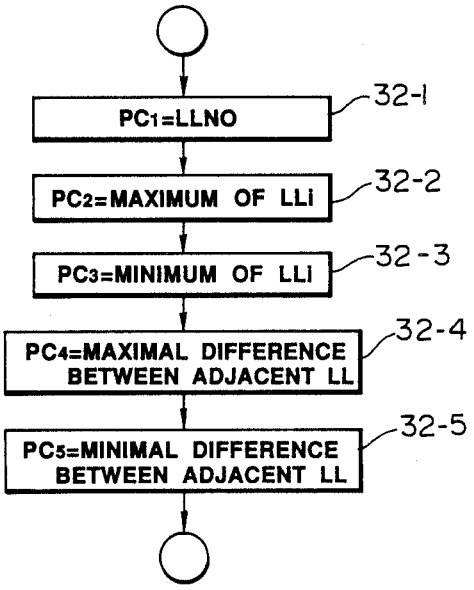
FIG. 30 shows an example of member data of chords.
FIG. 32 is a flowchart for extracting features of the arpeggio pattern.

In the arpeggio pattern extraction flow shown in FIG. 29, arpeggio pattern LLi is extracted from the motif of the bar under consideration. In brief, motif data in the bar extending from Ps to Pe are distinguished between harmonic and nonharmonic tones by using a corresponding chord in the chord progression data. For a tone which is discriminated to be a harmonic tone, a corresponding chord member is found out from the chord to obtain LL formatted data. More specifically, the first note Ps and last note Pe for evaluation are obtained from motif data (step 29-1). Then, the chord is decomposed into chord members (step 29-2, and FIGS. 30 and 31). FIG. 30 shows a chord member memory map. In the memory, chord members are indicated by lower 12 bits of 16-bit data for individual types of chord with root C. Each bit position represents a pitch name with do or C at the lowest bit position. For example, data cc=0091 (hexadecimal) has "1"s in the bit positions of do, mi and sol and represents members of chord C major. With a chord Gmaj in a segment under consideration, CD is "0007" (hexadecimal). Major chord member data cc of "0091" in an address designated by the upper 8 bits of CD is read out from the chord member memory, and the lower 12 bits are rotated to the left to an extent corresponding to the value of the root represented by the lower 8 bits of CD, as shown in FIG. 31. As a result, the "1" bits are shifted respectively to bit positions of "7", "11" and "2" representing sol, si and re to express Gmaj. In this way, chord member data are generated from a chord in the segment under consideration. Thereafter, note counter i and harmonic tone counter k are initialized (steps 29-3 and 29-4). The process of the step 29-5 is to convert motif note pitch data MRi into the same data format as the chord member data cc. For example, the tone "sol" is converted to data mm having "1" at the bit position "7". In a step 29-6, a check is made as to whether the pitch data mm matches a chord member. This is accomplished by producing a logical conjunction (mm Λ cc) of the pitch data mm and chord member data cc. In steps 29-7 through 29-13, a chord member number is examined for a "1" bit of chord member data cc that coincides with "1" bit in motif pitch data mm. The resultant member number c is combined with the octave number (MRi Λ ff00) of tone of motif to obtain an arpeggio pattern element LLk. In a step 29-15, i is incremented to the next note. The process repeats until the note number reaches Pe (step 29-16). In a step 29-17, the number of harmonic tones in the segment under consideration (i.e., length of the arpeggio pattern) is set in a LLNO register.

In the flow of FIG. 32, features of arpeggio pattern are extracted from the arpeggio pattern LLi and number LLNO obtained in the flow of FIG. 29.

Figure 33:
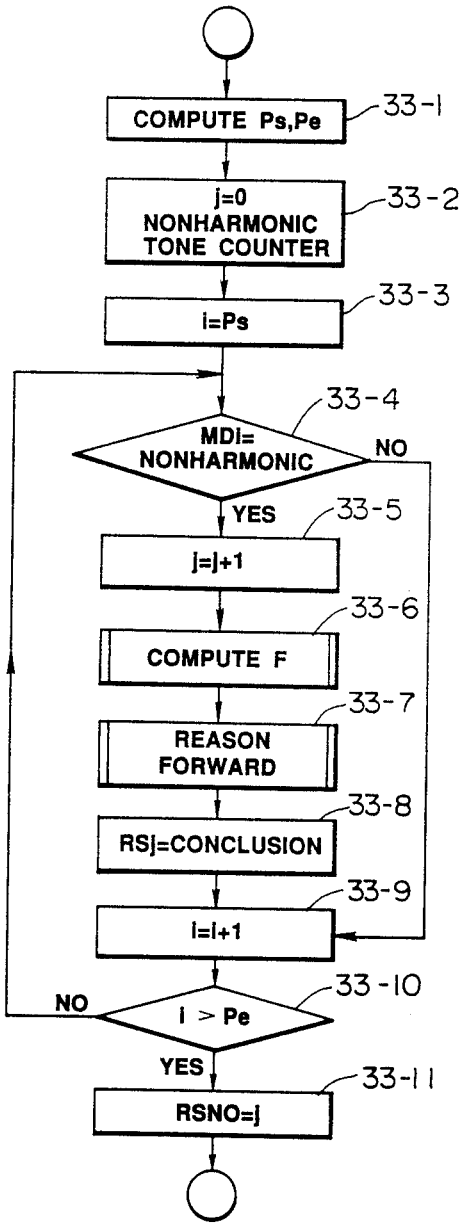
FIG. 33 is a flowchart for extracting features of nonharmonic tones.

FIG. 33 shows a flow for extracting features of nonharmonic tones from the motif. The features are defined by a pattern of types of nonharmonic tone distributed in a segment of motif under consideration. More specifically, the nonharmonic and note counters j and i are set (steps 33-2 and 33-3). If the note under consideration is a nonharmonic tone (step 33-4), functions F representing the situation of motif around that note are calculated (33-6). Then, forward reasoning based on the production rules is executed to deduce the type of that nonharmonic tone and store it into RSj (33-7, 8). This classification of nonharmonic tones is repeatedly executed until Pe is encountered. As a result, a row of types of nonharmonic tones in the segment of motif under consideration is stored in an array RSj. In step 33-11, the total number of nonharmonic tones in the segment under consideration is set in a PSNO register.

Figure 34:
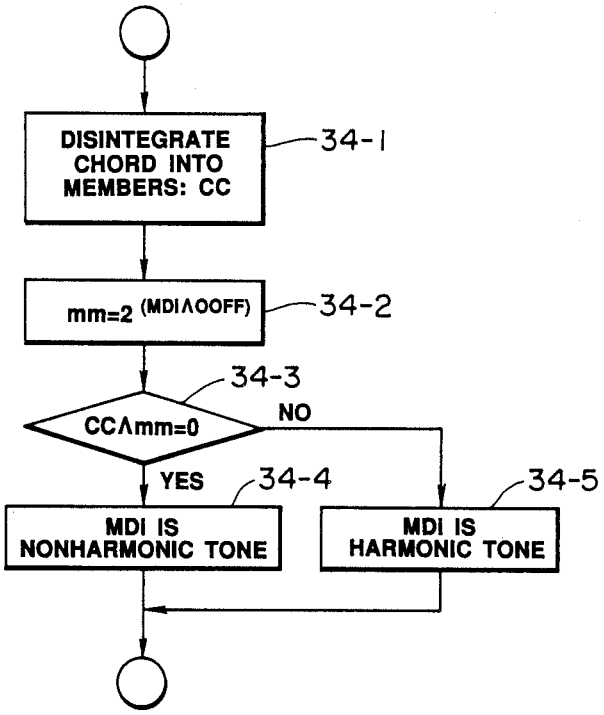
FIG. 34 is a flowchart for distinguishing between harmonic and nonharmonic tones.
Figure 36:
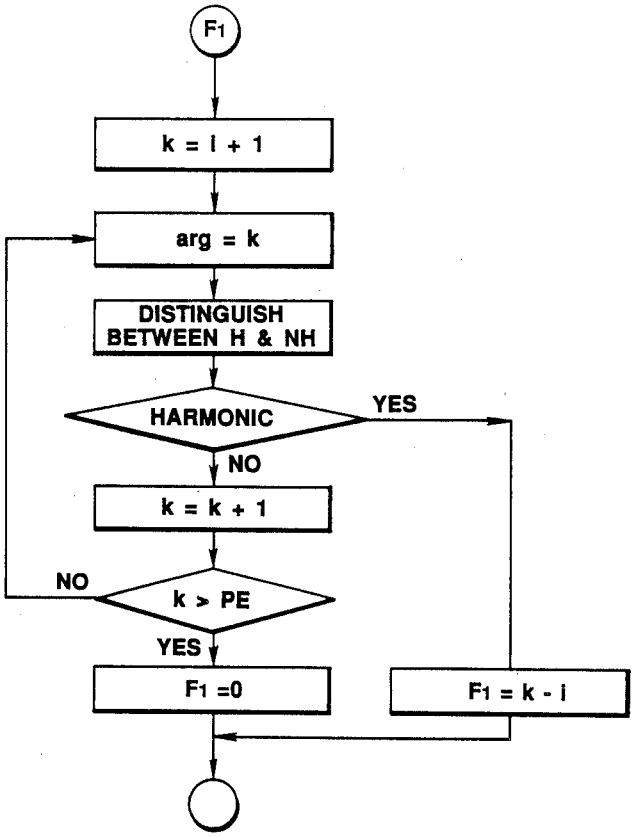
FIG. 36 is a detailed flowchart for computing a function F1.
Figure 37:
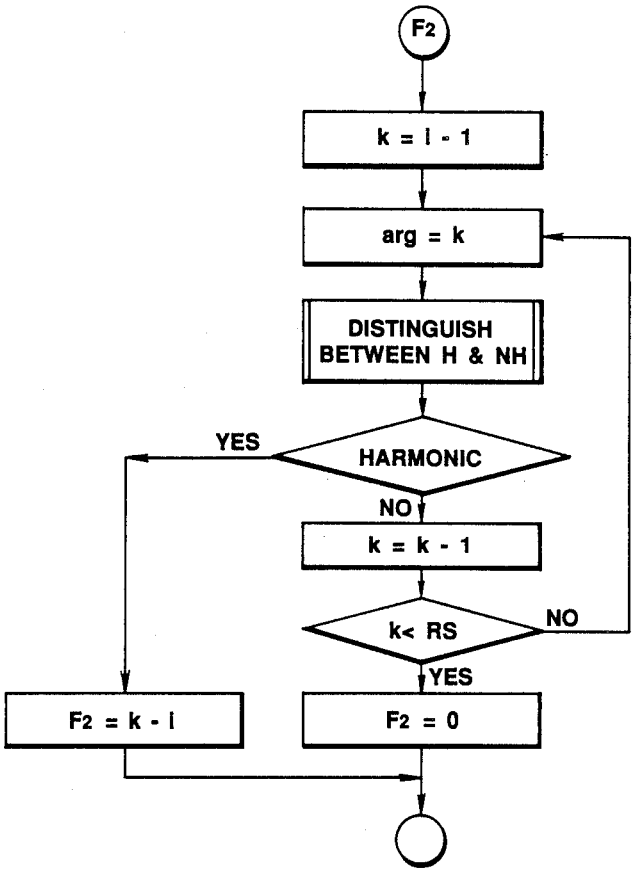
FIG. 37 is a detailed flowchart for computing a function F2.
Figure 38:
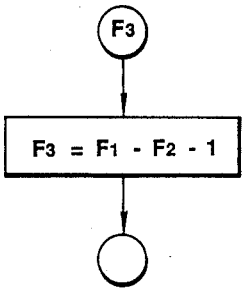
FIG. 38 is a detailed flowchart for computing a function F3.
Figure 39:
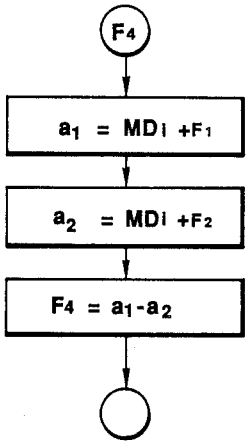
FIG. 39 is a detailed flowchart for computing a function F4.
Figure 40:
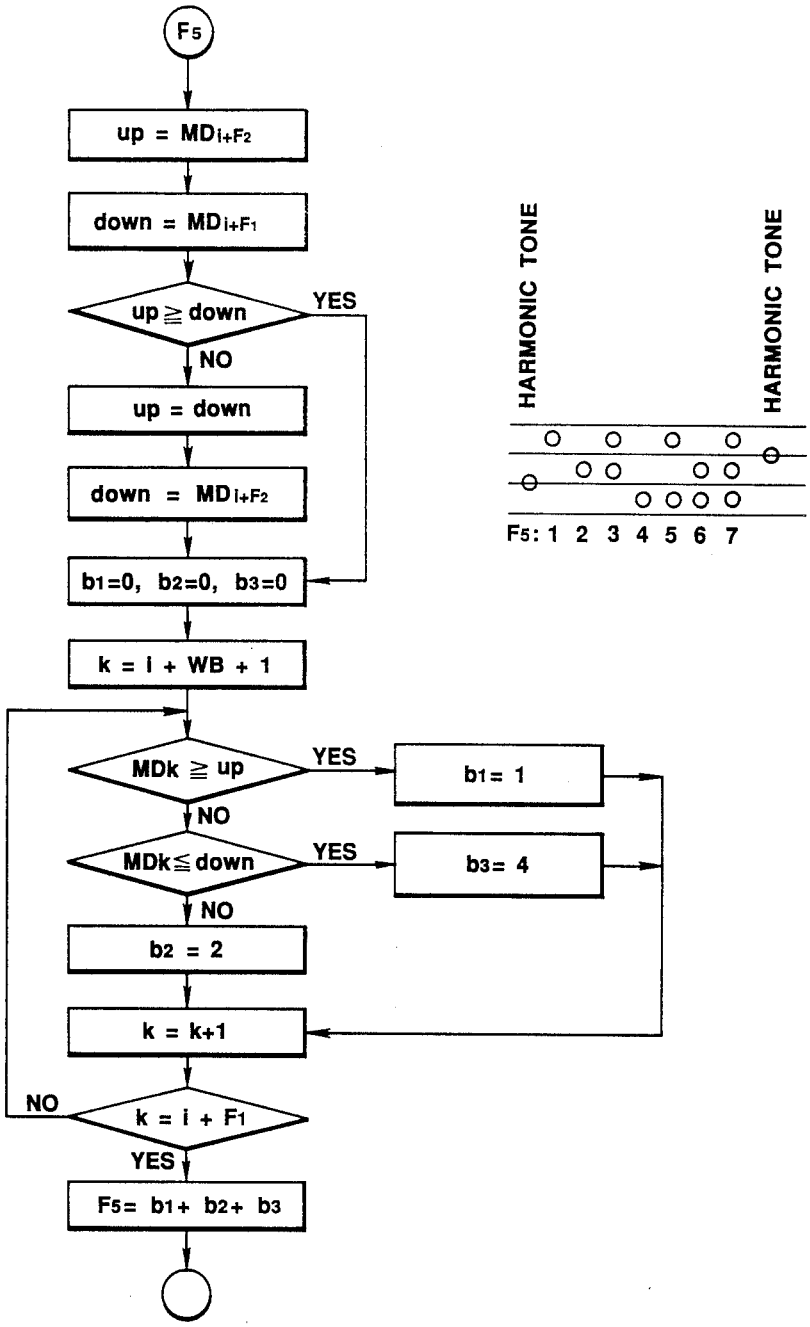
FIG. 40 is a detailed flowchart for computing a function F5.
Figure 41:
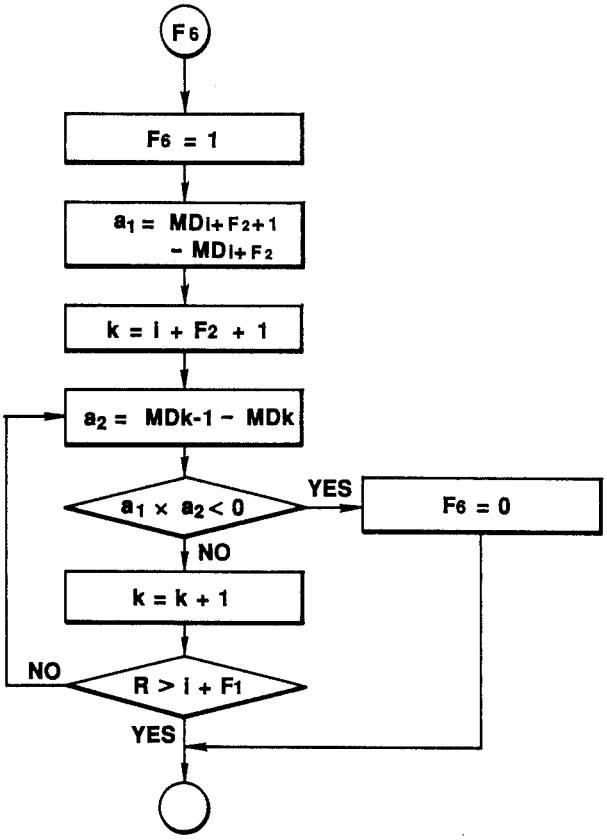
FIG. 41 is a detailed flowchart for computing a function F6.
Figure 42:
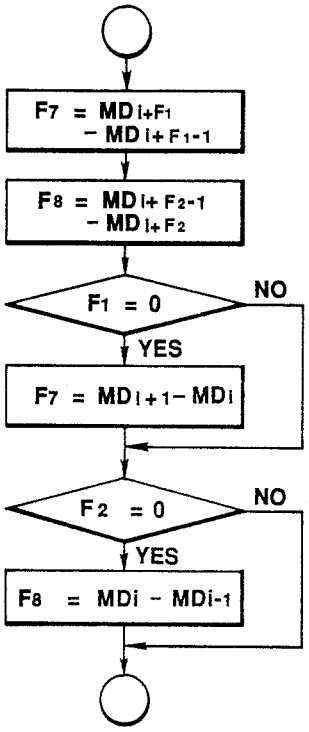
FIG. 42 is a detailed flowchart for computing functions F7 and F8.
Figure 43:
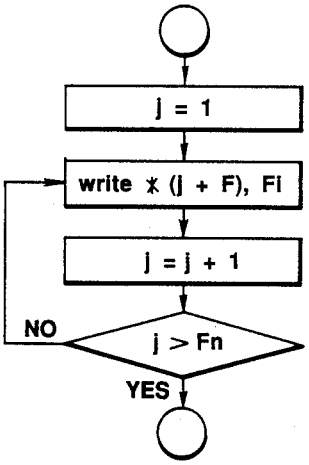
FIG. 43 is a flowchart for temporarily storing the computed functions.

FIG. 34 shows details of 33-4 for distinguishing between harmonic and nonharmonic tones for MDi. This process is similar to the process of checking whether the note under consideration is a harmonic tone or not, made in the extraction of arpeggio pattern (FIG. 29). The distinguishment is effected by checking whether the pitch name of the note under consideration is contained in the chord members in the segment under consideration.

In the calculation of functions F in the step 33-6, a condition of motif (or melody) is evaluated for the subsequent classification of nonharmonic tones. Specific examples of functions are shown in FIGS. 35 to 43. The illustrated functions F include (FIG. 35):

F1: location of the next harmonic tone relative to the note (nonharmonic tone) under consideration, F2: location of the last harmonic tone, F3: number of nonharmonic tones between the last and next harmonic tones, F4: pitch interval between the last and next harmonic tones, F5: nonharmonic tone pitch distribution between the next and last harmonic tones, F6: whether the melody tone pitch changes monotonously from the last to the next harmonic tone, F7: pitch interval between the next harmonic tone and the immediately preceding tone, and F8: pitch interval between the last harmonic tone and the next tone.

Further, data as to whether the beat is weak or strong and also data for classifying tone durations may be added to the set of functions F. The calculation of the individual functions F is obvious from the flowcharts, and further description is omitted.

Figure 44:
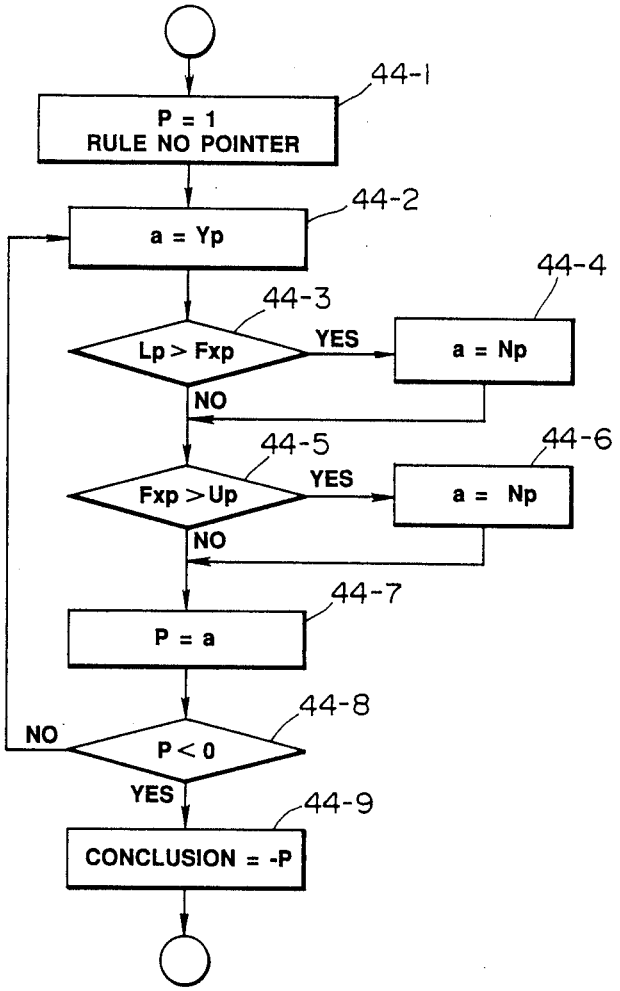
FIG. 44 is a flowchart for reasoning the type of a nonharmonic tone.

FIG. 44 shows details of 33-4 for forward reasoning. In a step 44-1, a rule number pointer P is set to "1" so as to point to a root rule among the production rules. Then, a check is done as to whether a condition part of the rule designated by the rule pointer P is satisfied (LP≦Fxp≦Up). If it is satisfied, data Yp of an affirmative consequent part of the rule is used as a pointer to the next rule. If the condition part is not satisfied, data Np of a negative consequent part of the rule is used as a pointer to the net rule. However, if data Yp or Np has a negative value, the final conclusion has been reached. In this case, the absolute value of the data (i.e., $-Yp$ or $-Np$) is set as a nonharmonic tone identifier in a conclusion register. According to the flow, if the condition $Lp>Fxp$ in the step 44-3 or condition $Fxp>Up$ in the step 44-5 is satisfied, the condition part $Lp \leqq Fxp \leqq Up$ of the rule P is false, so that data Np of the negative consequent part of the rule is set in a (steps 44-4 and 44-6). Otherwise, the condition part is satisfied, so that data Yp of the affirmative consequent part of the rule P is set in a (step 44-2). The set data a is substituted into P (step 44-7). If P is positive, the flow goes to the check of the next rule. If P is negative -P is used as the result of classification of nonharmonic tone (steps 44-8 and 44-9).

As an example of nonharmonic tone classification, it is assumed that the calculations of the functions F noted above yields:

F1=1—The next harmonic tone is located next to the nonharmonic tone under consideration.

F2=−1—The last harmonic tone is immediately preceding the nonharmonic tone under consideration.

F3=1—The number of tones between the two (i.e., last and next) harmonic tones is 1.

F4=8—The pitch interval between the two harmonic tones is 8.

F5=2—The nonharmonic tones between the two harmonic tones are distributed between the pitches of the two harmonic tones.

F6=1—The melody tone pitch changes monotonously from the last to the next harmonic tone.

F7=1—The pitch interval between the nonharmonic tone and the next harmonic tone is 1.

F8=7—The pitch interval between the last harmonic tone and the nonharmonic tone is 7.

In this case, reasoning using production rule data shown in FIG. 18 proceeds as follows:

When P=1 (root), the condition part $0 \leqq F2 \leqq 0$ is not satisfied for F2=−1. Thus, the negative consequent part N1=3 of the root points to the rule to be applied next.

When P=3, the condition part $0 \leqq F1 \leqq 0$ of the rule 3 is not satisfied for F1=1. Thus, N3=5 is the pointer to the next rule.

When P=5, the condition part $0 \leqq F4 \leqq 0$ of the rule 5 is not satisfied for F4=8. Thus, N5=6 is P.

When P=6, the condition part $1 \leqq F6 \leqq 1$ of the rule 6 is satisfied for F6=1. Thus, data Y6=7 of the affirmative consequent part of the rule 6 point to the rule to be referenced next.

When P=7, the condition part $3 \leqq F8 \leqq \infty$ of the rule 7 is satisfied for F8=7. Here, Y7=−2 (negative). Thus, the conclusion of reasoning is 2 (identifier of classified nonharmonic tone).

As is seen from the above example, a nonharmonic tone of any given type is identifiable with musical knowledge that a finite number of propositions are satisfied (the failure of holding of a condition part being identical with holding of a proposition with a false condition part). To represent and apply the knowledge, the functions F are calculated in cooperation with production rules. In other words, the functions F are melody check items used in the knowledge of classifying nonharmonic tones, and applied production rule data is a row of rules linked by pointers with the final rule having the result of classification of each nonharmonic tone.

[EVALUATION OF CHORD PROGRESSION]

The music composer of this embodiment features making full use of the chord progression for composition. More specifically, in the chord progression evaluation in the step 4-7 of the general music composition flow shown in FIG. 4, the hierarchic structure and key structure in music are extracted using a given chord progression as a clue. The hierarchic structure concerns the consistency and variety of music and is utilized for arpeggio generation control in melody generation to be described later. The key structure describes key changes as music proceeds and is utilized for selection of scale keys used in each segment for melody generation to be described later. Further, a process of the use of a special scale is provided for a special chord.

Now, extraction of the hierarchic structure will be described in detail with reference to FIGS. 45 to 47.

Figure 45:
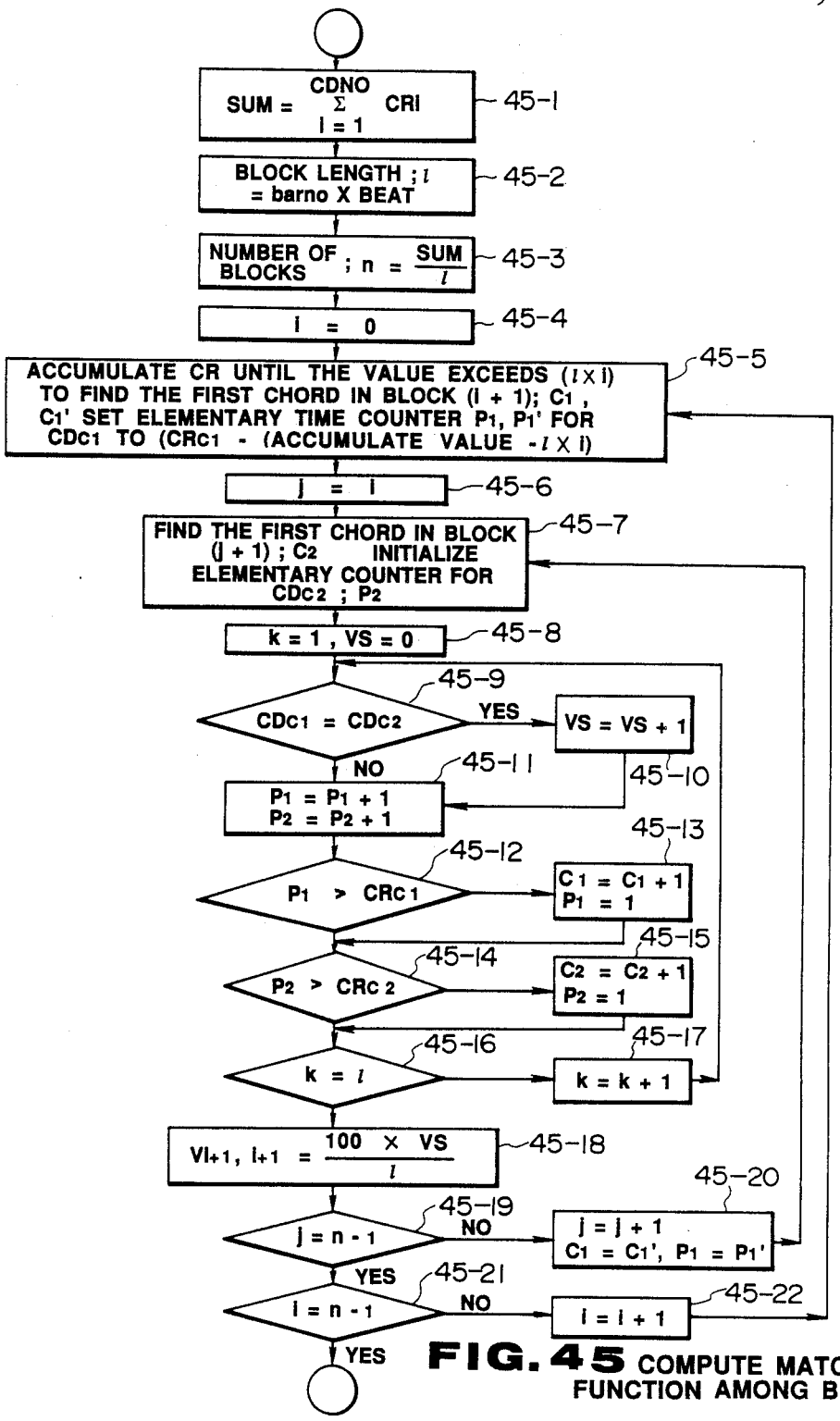
FIG. 45 is a flowchart for evaluating similarities of chord progression among blocks.

FIG. 45 shows a flow of calculating similarities among blocks of chord progression each having a duration of a phrase or the like.

The duration SUM of music is obtained by accumulating the durations CRi of the individual chords in the chord progression data (step 45-1). The duration of a block shown by barno (number of bars) per block is converted into block length of elementary time expression 1 (step 45-2), and the music duration SUM is divided by the block length to obtain the number m of blocks contained in the music (step 45-3). An i counter for the reference block number is initialized to "0" (step 45-4).

In steps 45-8 through 45-18, chord matching Vij between the i-th and j-th blocks ($j \geqq i$) is calculated. The matching function is given by $$Vij = \frac{100 \times Vs}{l}$$

in which l represents the block length, and Vs represents the numbers of coincident chords when the chords of the i-th block and those of the j-th block are compared at each elementary time. The matching function Vij varies from values of "0" to "100". When the value is "100", the chord progressions of the two blocks are coincident perfectly (i.e., 100%). When the value is "0", the two are perfectly non-coincident.

The calculation of the matching of j-th block against i-th block starts with j=i (step 45-6). Every time the matching is obtained, j is incremented by 1 for the calculation of the matching for the next block (steps 45-20 and 45-7). When the calculation is done for the last block (step 45-19), i is incremented by 1 to shift the i-th block (steps 45-22 and 45-5), and the process is repeated until the calculation is done for the last block. Thus, chord matching Vij of the j-th block with respect to the i-th block is obtained as

| | | | | | | | |
|---|---|---|---|---|---|---|---|
| V11 | V12 | ... | ... | ... | ... | ... | V1n |
| | V22 | ... | ... | ... | ... | ... | V2n |
| | | ... | ... | ... | ... | ... | ... |
| | | | ... | ... | ... | ... | ... |
| | | | | ... | ... | ... | ... |
| | | | | | ... | ... | ... |
| | | | | | | ... | ... |
| | | | | | | | Vnn |

The reader will recognize Vij=Vji, that is the chord matching of the j-th block with respect to the i-th block and chord matching of the j-th block with respect to the i-th block are equal. Further, Vij=100.

Figure 46:
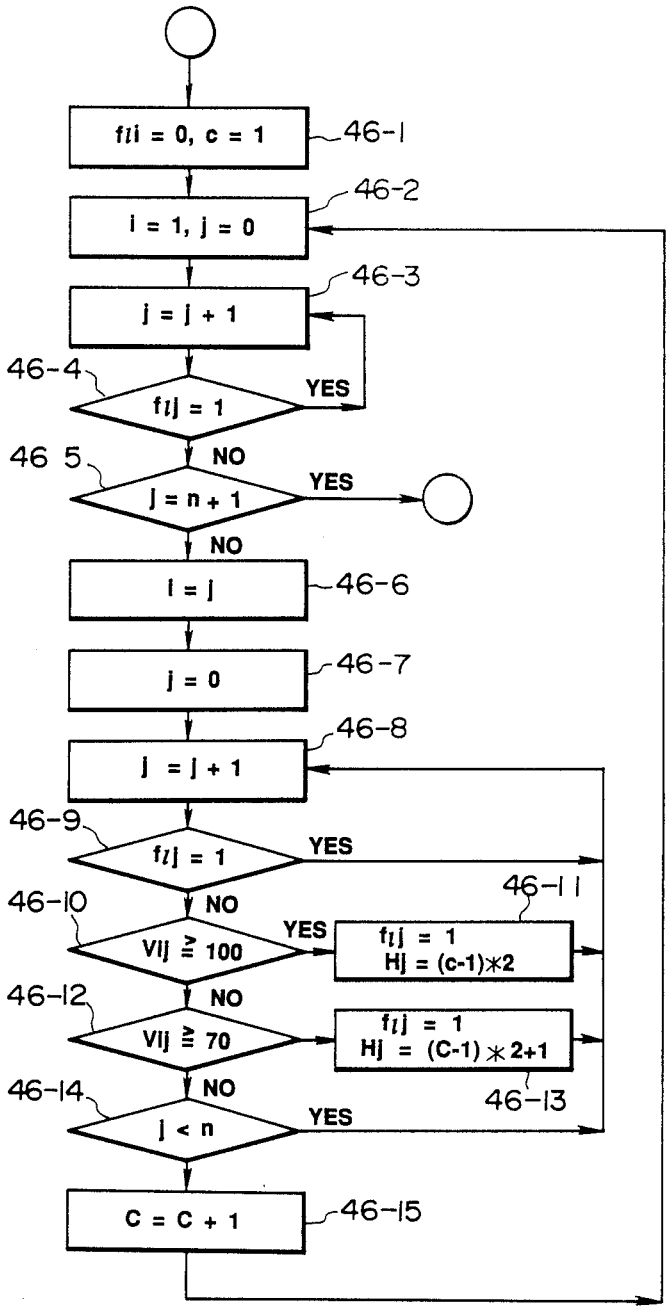
FIG. 46 is a flowchart for generating hierarchic structure data according to the evaluated similarities.

The result Vij of calculation of the chord matching between each block pair is utilized for generating the hierarchic structure data as shown in FIG. 46.

In FIG. 46, c counter is provided for the hierarchic structure calculation. A hierarchic structure identifier for the i-th block is stored in Hj. Hj can take integers "0", "1", "2", . . . . This corresponds to a, a', b, b', . . . in the conventional notation (see HIEj in FIG. 10). In the flow in FIG. 46, a block, the chords of which are matched 100% with those of a reference block, is given a hierarchic structure identifier of the same value (even number) as the hierarchic structure identifier of the reference block (steps 46-10 and 46-11). A block which matches the reference block in a range of 70 to 100%, is regarded as a block having a chord progression obtained by modifying the chord progression of the reference block so that its hierarchic structure identifier is given by adding 1 to the hierarchic structure identifier of the reference block (steps 46-12 and 46-13). A block which matches less than 70% is dealt with as a block having a hierarchic structure independent of the reference block. As a first reference block, the first block of music is selected (step 46-2). Blocks which match the reference block by 100% and 70 to 100% are given respective values of Hj=0 and Hj=1. To indicate the completion of evaluation, flag f g for these blocks is set to "1". Among the blocks of music, for which no definite evaluation is provided in the first evaluation loop (steps 46-2 through 46-15), the lowest numbered block is set as a reference block in the next evaluation loop (steps 46-3, 46-4 and 46-6), and the hierarchic structure identifier of this reference block is given "2". Similar processes are repeated until all the blocks of music are given respective hierarchic structure identifiers Hj.

Figure 47:
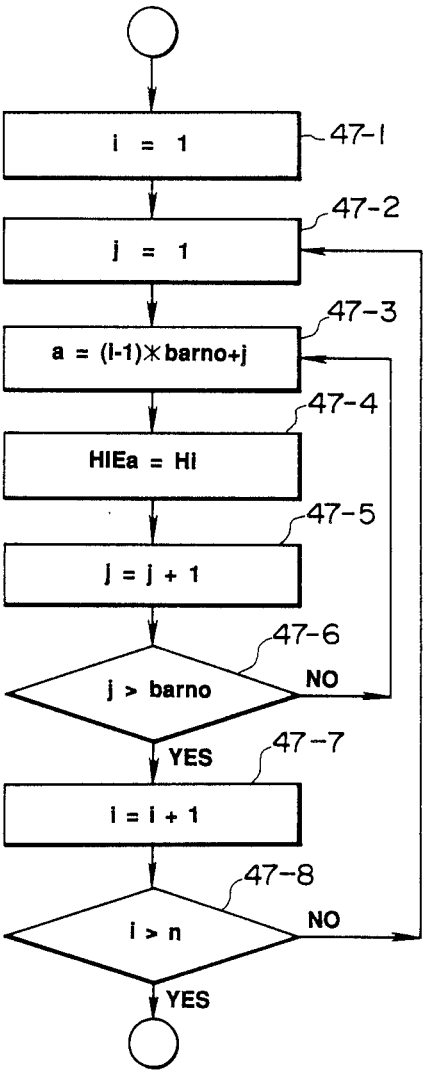
FIG. 47 is a flowchart for converting block-to-block hierarchic structure data to chord-to-chord hierarchic structure data.

FIG. 47 shows a flow of converting the hierarchic structure obtained for each block in the flow of FIG. 46 into hierarchic structure data for each bar. The hierarchic structure identifier of an a-th bar is set in a HIEa register.

Now, extraction of the key structure will be described with reference to FIGS. 48 to 51. In this embodiment, properties of the key structure of normal music are considered for the extraction of the key structure from the chord progression. These properties are:

(a) A key tends to preserve rather than change frequently in the course of music.

(b) Chord members are in a note scale of a particular key.

(c) A key tends to change, if it does, to a related key such as dominant or subdominant key rather than to a distant key.

In order to impart the key structure to be extracted with the above properties, this embodiment defines a distance of key among chords. In addition, when a chord in the segment under consideration is of a key within a predetermined distance from the key of the immediately preceding segment, the key of the segment under consideration is regarded to be the same as the key of the immediately preceding segment.

Figure 51:
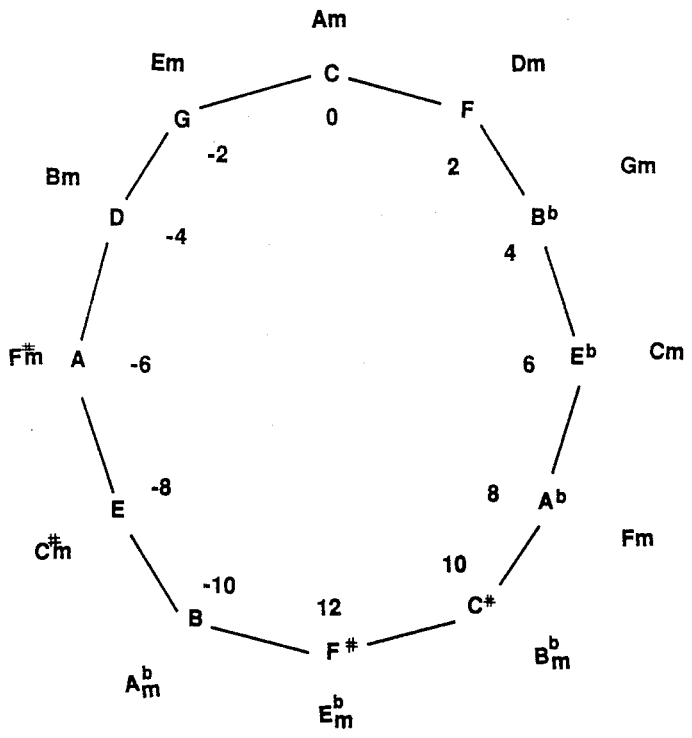
FIG. 51 shows the definition of key distances among chords.

FIG. 51 exemplifies the distance of key among chords. As is seen from the figure, the distance of key between two chords in a parallel key relation (for instance chords Am and (C) is zero. Thus, these chords have the same key (C). Further, the distance of key from a chord lowered or raised by a perfect fifth degree is set to 2 or −2. Considering the diatonic scale (do, re, mi, fa, sol, la, si, do) of key C, all six chords C, Am, G, Em, F and Dm within a key distance of ±2 from chord C having their members all in the diatonic scale of key C. As will be described later, this embodiment is designated to preserve the key as long as chord changes within a key distance of ±2.

Figure 48:
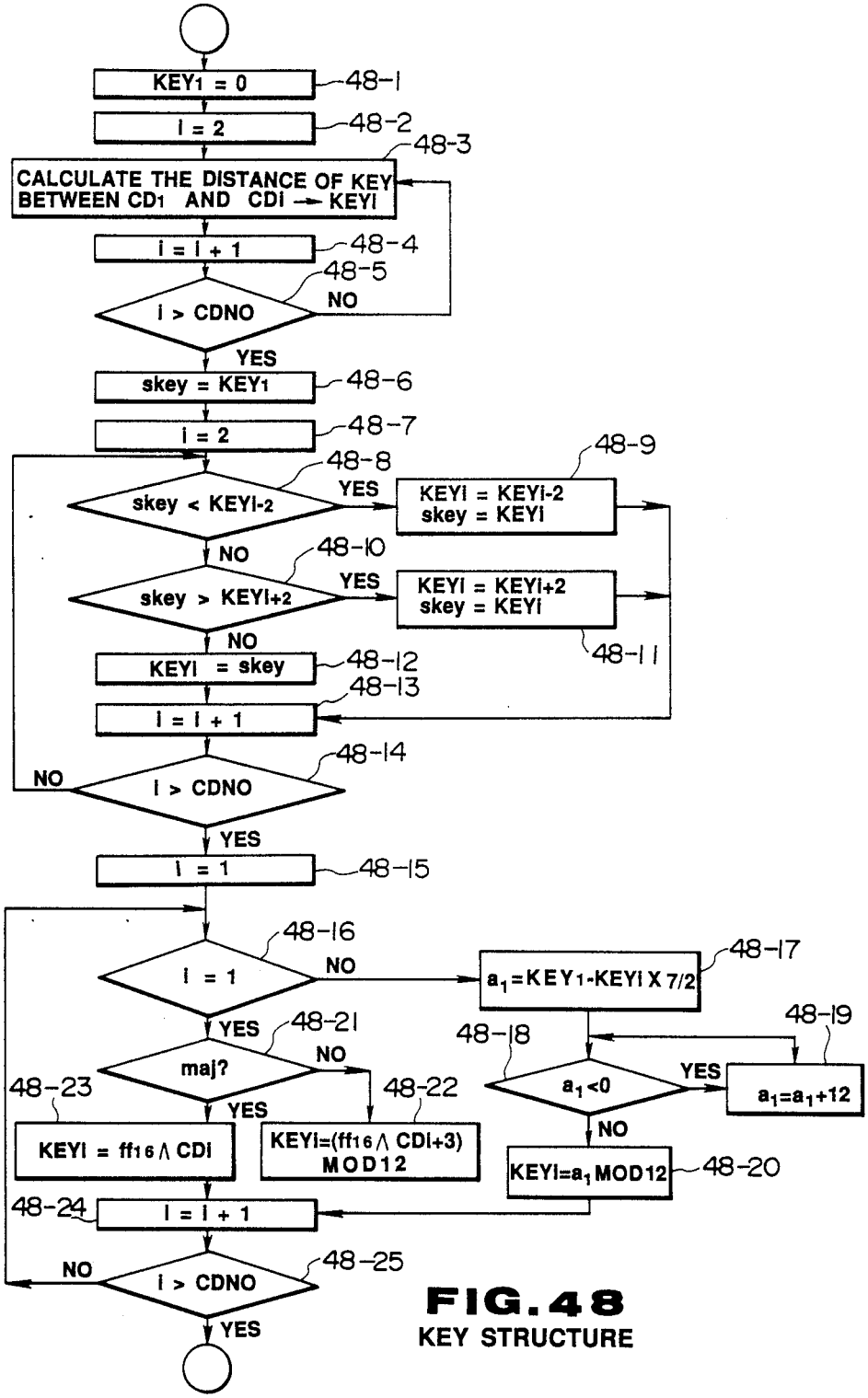
FIG. 48 is a flowchart for extracting a key structure from a chord progression.

In the flow of FIG. 48, the process from step 48-1 through step 48-5 is for allotting key distance data to the individual chords in chord progression according to the definition of the distance of key exemplified in FIG. 51. More specifically, in a step 48-1 the key KEY1 of the first chord in music is set to "0", and in steps 48-2 through 48-5 the key KEYi of each subsequent chord CDi is obtained by calculating the key distance from the key KEY1 of the first chord CD1. The key calculation in step 48-3 is shown in more detail in FIG. 50.

Figure 50:
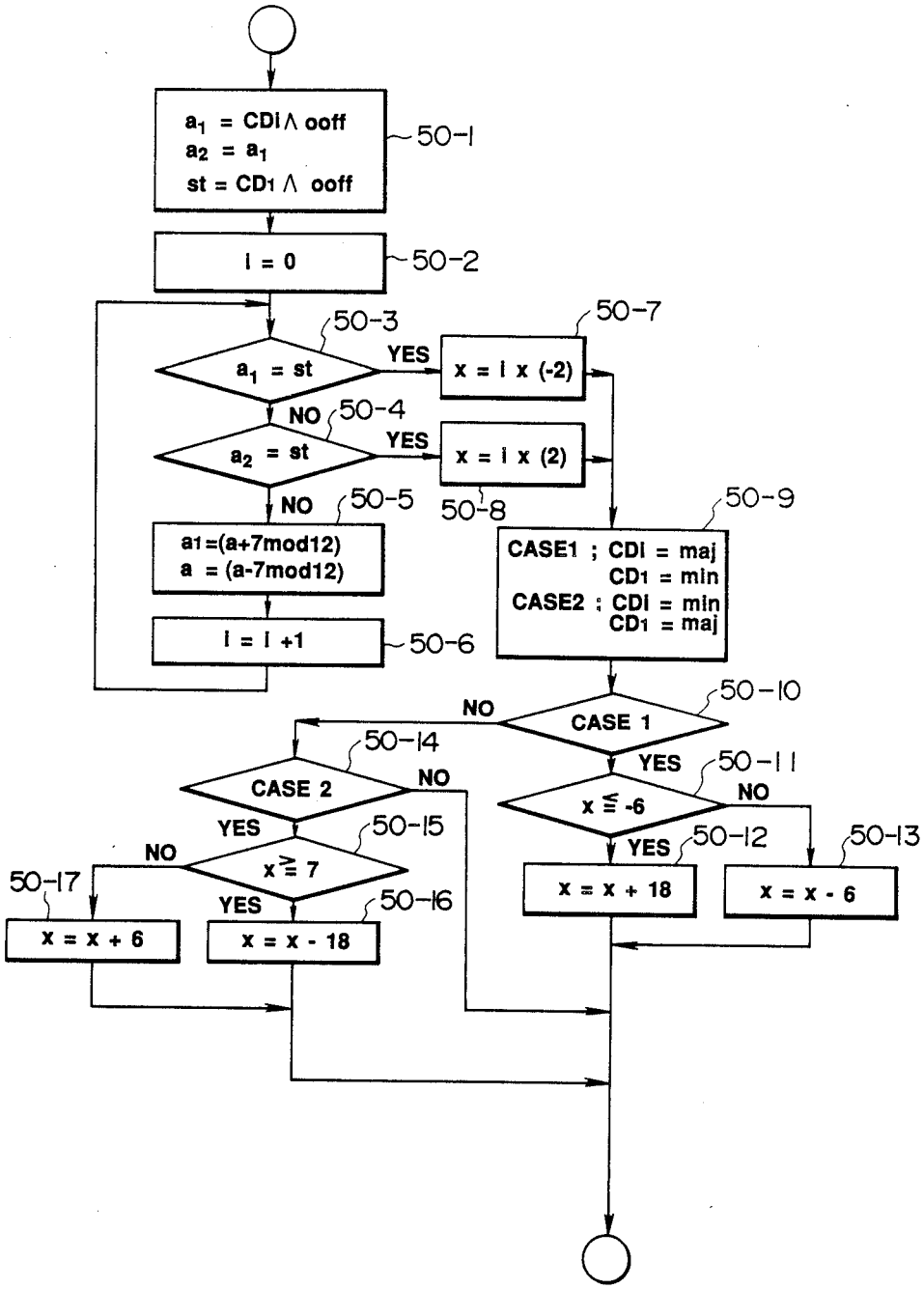
FIG. 50 is a flowchart for computing the distance of key between a first chord CD1 and i-th chord CDi.

CDi Λ 00ff in a step 50-1 represents root data of the i-th chord CDi (see FIG. 8), and the result is substituted into a1 and a2. The root data of the first chord CD1 is substituted into st. Every time the loop of the steps 50-3 through 50-6 circulates, the root data of a1 is rotated upwards by the fifth degree while the root data of a2 is rotated downwards by the firth degree (50-5). (This corresponds to either counter-clockwise or clockwise rotation on the ring shown in FIG. 51.) In a step 50-3, a1=st is satisfied when the root data i of CDi is rotated upwards by the fifth degree as many times as i, and in a step 50-4 a2=st is satisfied when root data i of CDi is rotated downwards by the fifth degree as many times as i. Thus, for the former i×(−2) is placed as the distance of key into x (step 50-7), and for the latter i×2 is placed into x (step 50-8). The process of steps 50-9 through 50-17 is for converting x depending on whether the first chord CD1 and chord CDi under consideration are both major chords or both minor chords or not so. For example, if CD1 and CDi are respectively Am and Gmaj, x is x=+4 in 50-7 (from the comparison of the roots A and G). According to FIG. 51, x should be x=−2. In this case, process goes from 50-10 through 50-11 to 50-13, so that x=−2 is obtained from x=x−6. If CD1 and CDi are respectively Gmaj and Bmin, x is x=−10 in step 50-8. According to the definition of the distance of key shown in FIG. 51 x should be x=−4. In this case, process goes from 50-10 through 50-15 to 50-17, and x=−4 is obtained from x=x+6. The result x of calculation in the flow of FIG. 50 is stored in KEYi.

An example of the process of the steps 48-1 through 48-5 is shown in (1) in FIG. 49. For a chord progression of C, C, F, G7, B, F, G7 and C, KEY1=0, KEY2=0, KEY3=+2, KEY4=−2, KEY5=+4, KEY6=+2, KEY7=−2 and KEY8=0 are obtained respectively as the key distance KEY.

The key distances KEY obtained in the above way are converted in subsequent steps 48-6 through 48-14 such that the key properties discussed above are imparted. More specifically, immediately preceding key data is set in skey, and if the key data of the current chord under consideration is within a key distance of ±2 from the immediately preceding key data skey, the key data of the current chord is given by the immediately preceding key data to maintain the key. If the key distance exceeds ±2, a modulation is assumed to occur, so that data obtained by adding ±2 to the key data of the chord under consideration is used as final key data.

An exemplary result of the process of the steps 48-6 through 48-14 is shown in (2) in FIG. 49. For a chord progression of C, C, F, G7, B, F, G7 and C, data "0", "0", "0", "0", "2", "2", "0"and "0" are obtained as key data KEY.

In this way, key structure having a character desired for a music is generated in the form of key distance notation.

In steps 48-15 through 48-25 in the flow of FIG. 48, key structure data of the key distance notation is converted into pitch name notation of a keynote of scale. In the pitch name notation, "0" is allotted C, "1" to C# and so on and "11" to B. Suppose, for example that the chord of music is Cmaj, the i-th chord is Fmaj and the key thereof is "2" in the key distance notation. The corresponding pitch name notation is "5". For the conversion, the process proceeds from the step 48-15 through steps 48-16 and 48-17 to obtain a1=KEY1−KEYi×7/2. Since KEY1=0 and KEYi=2, we obtain a1=−7, and through steps 48-18 and 48-19 we obtain a1=5. This data is set as KEY1 (step 48-20). If the first chord of music is a chord of major class, the scale keynote for the first chord is obtained from KEY1=00ff Λ CD1. If the chord is a minor chord, KEY1−(00ff Λ CD1 +3) mod 12 is executed according to the relation of Am=C to obtain the scale tonic for the first chord (steps 48-16 and 48-21 through 48-23).

An exemplary result of the process of the steps 48-15 through 48-25 is shown in (3) in FIG. 49. When the chord progression consists of C, C, F, G7, B, F, G7 and C, the keys used in the respective chord durations are C, C, C, C, F, F, C and C.

As will be described in detail, each melody tone generated in each chord is selected from a note scale having a keynote specified in the key structure data extracted in the above process.

Figure 52:
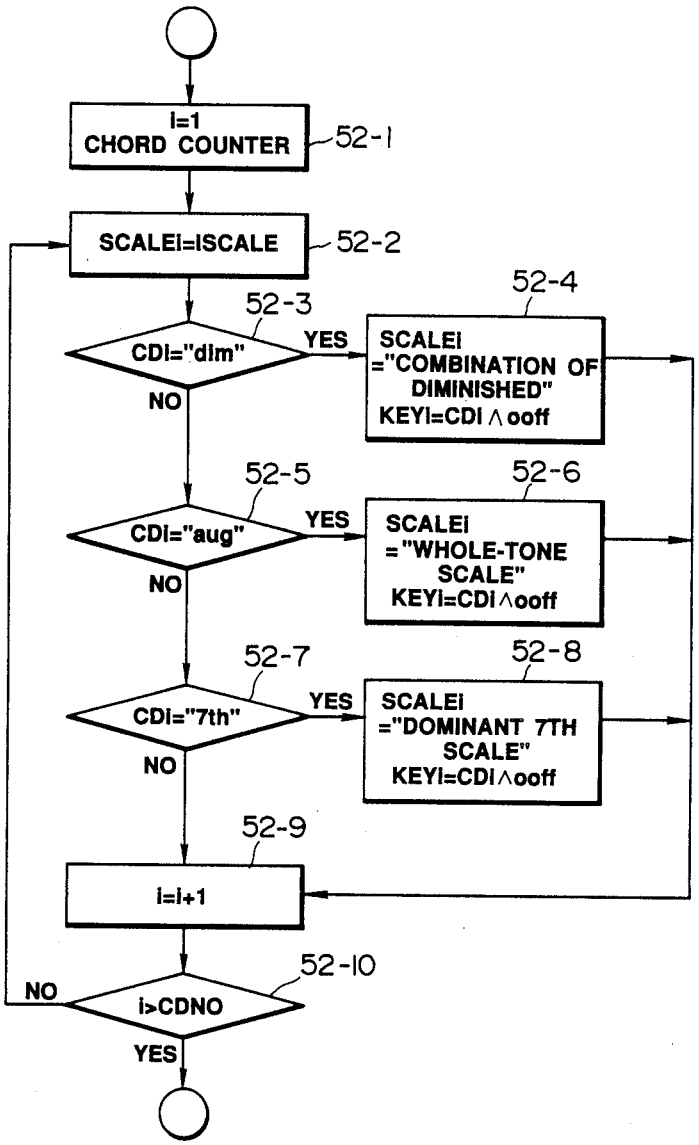
FIG. 52 is a flowchart for producing scale data for particular chords.

Now, scale evaluation will be described with reference to FIG. 52. The purpose of this process is to use a special scale for melody generation for a segment, in which a special chord is used. In FIG. 52, ISCALE is a scale selected in the initialization step 4-1 (FIG. 4). When the chord CDi is a diminished chord dim, a combination of diminished scale is set as scale SCALEi used in the segment under consideration. If the chord CDi is an augmented chord aug, the whole-tone scale is set. If the chord CDi is a seventh chord seventh, a dominant seventh scale is set. As the keynote for each of these chord, the root of the chord is used in lieu of the key data obtained in the key structure extraction process described above. Thus, in the chord segments other than exceptional ones as noted above, a scale selected in the initialization steps is used, with a keynote according to the key data obtained in the key structure extraction process.

[MELODY GENERATION]

The music composer of this embodiment is initially given external data constituting the basis of music and then analyzes and evaluates the supplied data. Thereafter, the composer does the job of generating a melody.

Figure 53:
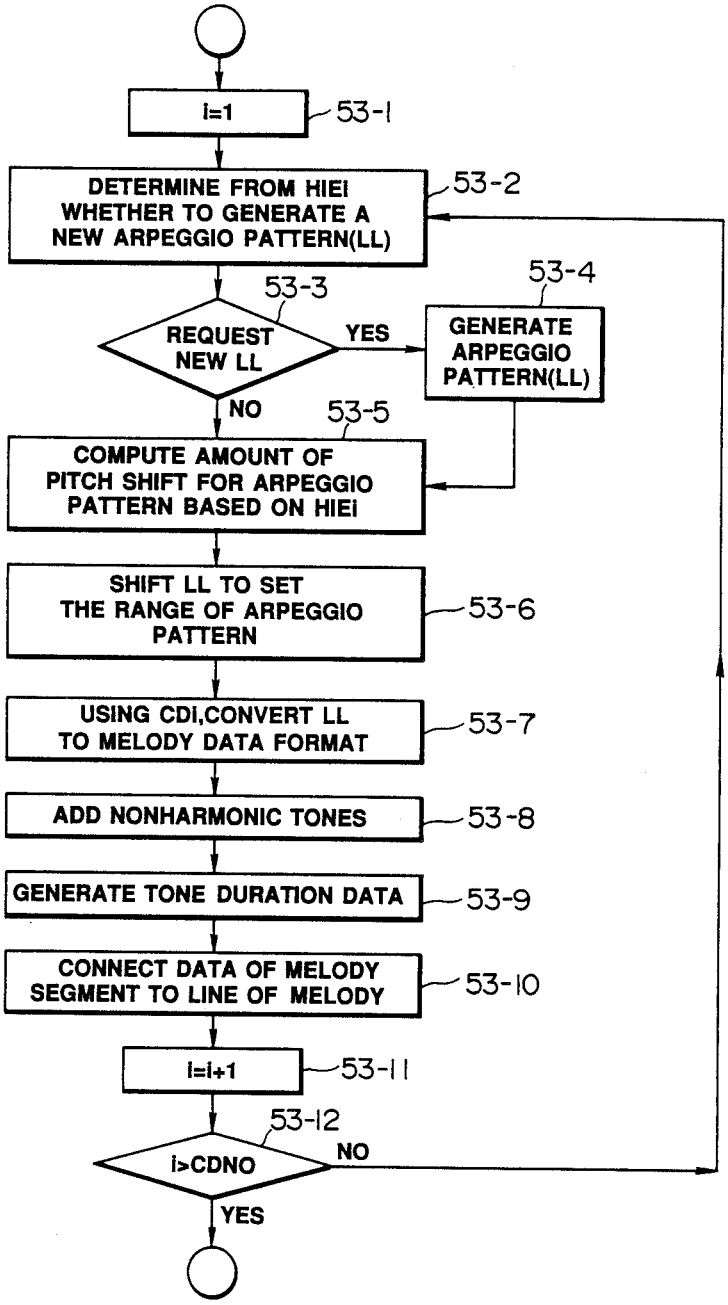
FIG. 53 is a flowchart for generating a melody.

FIG. 53 is a simplified flow for generating a melody, as executed in step 4-8 in the general music composition flow shown in FIG. 4. In FIG. 53, denoted by HIEi is hierarchic structure data extracted for each chord segment in the chord progression evaluation discussed above. In steps 53-2 through 53-4, hierarchic structure HIEi is utilized for the control of generation of arpeggio pattern LL. This control will be described later in detail. The hierarchic data is also utilized for the control of the pitch range of the arpeggio pattern LL in steps 53-5 and 53-6.

The arpeggio pattern forms the framework of melodic line. The range of the arpeggio pattern basically prescribes the range of melody. In this embodiment, the hierarchic structure obtained from the chord progression is utilized for the arpeggio pattern control. This constitutes one feature of the embodiment. However, the arpeggio pattern control factors are not necessarily limited to the hierarchic structure data evaluated from the chord progression. For example, hierarchic structure and random number may be weighted according to the user's input and the sum of the two weighted data is used to control an arpeggio pattern. In general, it is possible to modify the hierarchic structure such that a user's intention in the composition can be reflected in the arpeggio generation.

The arpeggio pattern LL is converted into the form of pitch notation, i.e., melody data format (arpeggio) by using chord data CDi (step 53-7). To this arpeggio, nonharmonic tones are added according to the production rules (step 53-8). It should be noted that the rules used for the nonharmonic tone addition are same as those used for classifying nonharmonic tones contained in the motif. Thus, reversibility holds between the analysis and synthesis of melody.

The melody pitch series is completed by adding nonharmonic tones to the arpeggio. After the completion of the melody pitch series, melody tone duration series (i.e., rhythm pattern) is generated (step 53-9). In this step, the reference rhythm pattern consisting of a predetermined number of notes (i.e., a tone duration series determined in the essential generation or extraction step 4-4 or 4-6) is converted according to the pulse scale selected in the initialization step 4-1 into a tone duration series having an equal number of notes as that of the melody pitch series.

The generation of arpeggio, addition of nonharmonic tones and generation of tone duration data are effected for each chord segment in the flow of FIG. 53. Therefore, in a step 53-10 melody data generated for a certain segment is connected in line of melody.

Figure 54:
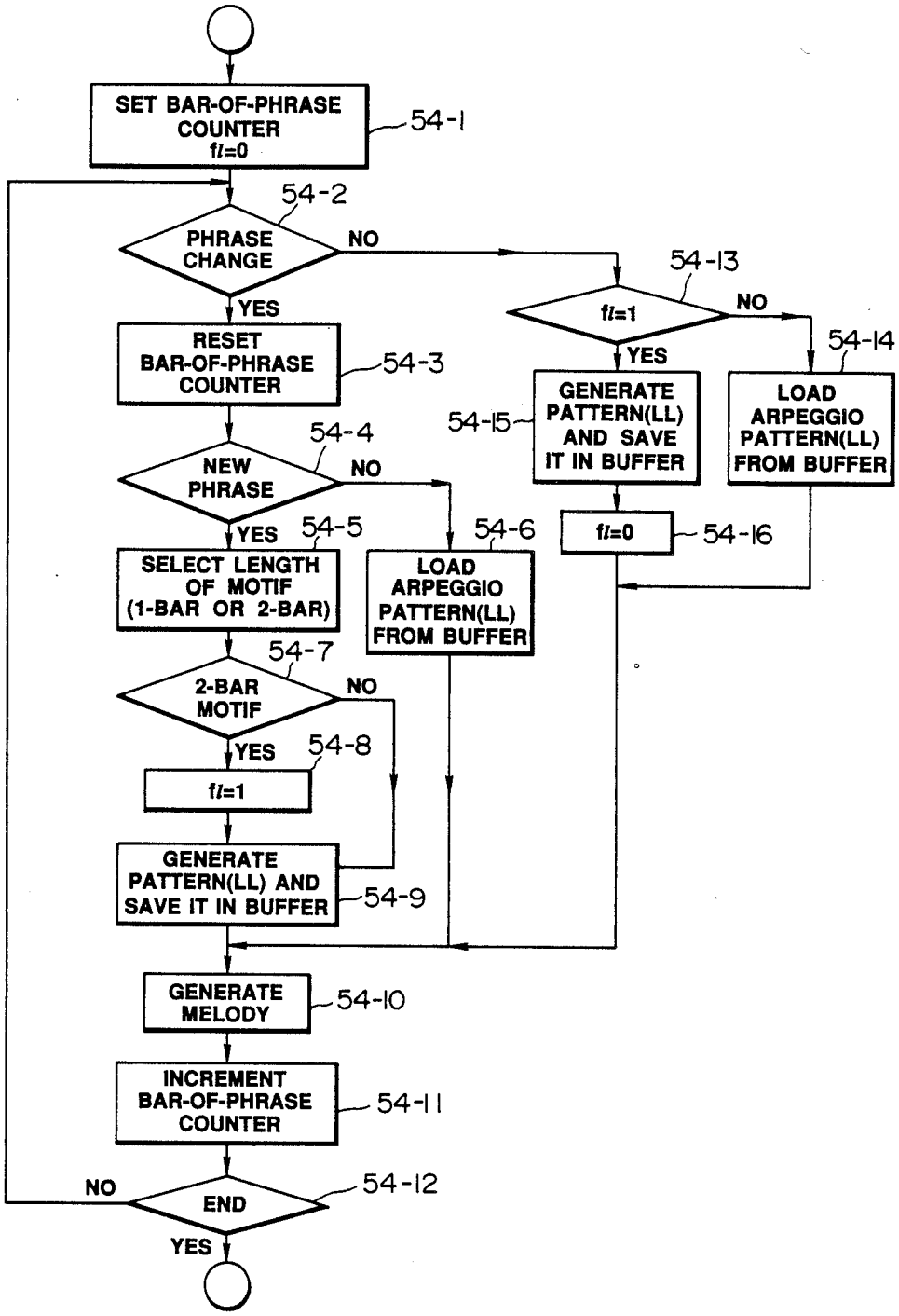
FIG. 54 is a flowchart for generating, saving and retrieving arpeggio patterns.

FIG. 54 shows a detailed flow for generating, saving and loading of arpeggio pattern (details of the steps 53-2 through 53-4 in FIG. 53). In this example, the control of the arpeggio pattern LL based on the hierarchic structure data HIEi is done as follows. First, a check as to whether a phrase under consideration has a structure different from the past phrases is done by comparing the hierarchic structure data of the phrase under consideration to past hierarchic structure data. Arpeggio pattern is newly formed only for phrases which are found to have different structures. The arpeggio pattern generation is done by using featuring parameters PC of the arpeggio pattern. No new arpeggio pattern LL is generated for phrases which are recognized to be segments having a similar structure to the past. Instead, an arpeggio pattern is used, which was generated in the past for a segment having the similar structure to the segment under consideration.

Now, suppose a piece of music consisting of four phrases having structures a, b, c and d, respectively. In this case, the structure a of the first phrase appears for the first time in music. Thus, an arpeggio pattern is generated for this phrase according to the arpeggio pattern featuring parameters. Likewise, the structure b and c of the second and third phrases appear for the first time, so that independent arpeggio patterns are generated for these phrases. The last phrase, however, has the same structure a as that of the first phrase. Therefore, the arpeggio pattern generated for the first phrase is used for this phrase.

The generation of a new arpeggio pattern for a phrase having a new structure means that a different motif starts from the new structure phrase. If an arpeggio pattern that is generated for the first bar of a phrase is suppose to be used repeatedly for the succeeding bars in that phrase, a motif having a duration of one bar will be perceived. In general, a motif lasts from one to several bars. The motif duration sometimes changes in the course of music. These are taken into consideration in the example of FIG. 54: When a phrase having a new structure is detected, the motif duration for that phrase is set to one or two bars. When a two-bar motif is selected, independent arpeggio patterns are generated for the first and second bars of the phrase. For the succeeding odd numbered bars the arpeggio pattern of the first bar is used, and for the succeeding even bars the arpeggio pattern of second bar is used.

A pattern data LL buffer is provided for the reference to hierarchic structure data of the past segments and repetition of an arpeggio pattern of a past segment. FIG. 55 shows an example of the pattern data buffer.

Referring back to FIG. 54, in a step 54-1 a bar counter for a phrase (a segment of barno shown in FIG. 45) is set to "1", and in a step 54-2 the start of phase is checked by comparing hierarchic structure data HIEi of the bar under consideration to hierarchic structure data HIEi-1 of the immediately preceding bar. The start of phase is detected when, for instance, I HIEi - HIEi-1 I≧2 is satisfied. When the start of phrase is detected, the bar counter in the phrase is reset to "1" (step 54-3). Then, the pattern data buffer is looked up to see whether the phrase under consideration is a phrase, for which a new arpeggio pattern is to be formed (step 54-4). The search of the pattern data buffer is done as follows. First, data in address "0" of the pattern data buffer (i.e., data representing the number of patterns generated in the past) is read out, and pattern header data in addresses, pointed to by data in addresses "1" to "N" are successively read out to compare their higher 8 bits, i.e., hierarchic structure data to the hierarchic structure data HIEi of the bar under consideration. If the pattern data buffer does not contain any hierarchic structure that is identical or similar to the hierarchic data of the bar under consideration (e.g., data having the same value as HIEi or HIEi-1), the bar under consideration is the first bar of a phrase, for which a new arpeggio pattern is to be generated. If a header containing the same hierarchic structure data is found, the succeeding arpeggio pattern is loaded as the arpeggio pattern of the bar under consideration. With a phrase for which a new arpeggio pattern is to be generated, the length of motif is determined (step 54-5). This determination may be realized by random number generation, for instance. In case of a two-bar motif, flag f1 is set to "1" (steps 54-7 and 54-8), so that a new arpeggio pattern will be generated again for the next bar (i.e., the second bar of the phrase). Then, the arpeggio pattern for the first bar is generated (see FIG. 56) and saved in the pattern data buffer (step 54-9). More specifically, generate a header by HIEi×0100+bar count×0010+number of motif bars, increase the number N of patterns in address "0" of the pattern data buffer, write the address of the header at the increased address N, and from the header address write the header, LLNO (number of generated arpeggio pattern elements) and LL1, LL2, . . . LLLLNO (elements of the generated arpeggio pattern). Thereafter, the remaining melody generation processes are performed (step 54-10), and the bar counter is increment (step 54-11).

If no change of phrase is found in the step 54-2, the flag f1 is checked (step 54-13). If the flag is f1=1, the bar under consideration is the second bar of a phrase, for which a two-bar motif is to be generated. Thus, arpeggio pattern is generated afresh for that bar and loaded in the pattern data buffer (step 54-15), and the flag f1 is then reset to "0" (step 54-16). If the flag is f1=0 in the step 54-13, the header corresponding to the hierarchic structure data HIEi of the bar under consideration is searched from the buffer. If the header indicates a one-bar motif, the succeeding pattern data is loaded for the bar under consideration. If the header indicates a two-bar motif, comparison is made between the modulo 2's remainder of the bar count and the bar number in the header. If match, pattern data following the header is loaded as arpeggio pattern for the bar under consideration.

Figure 56:
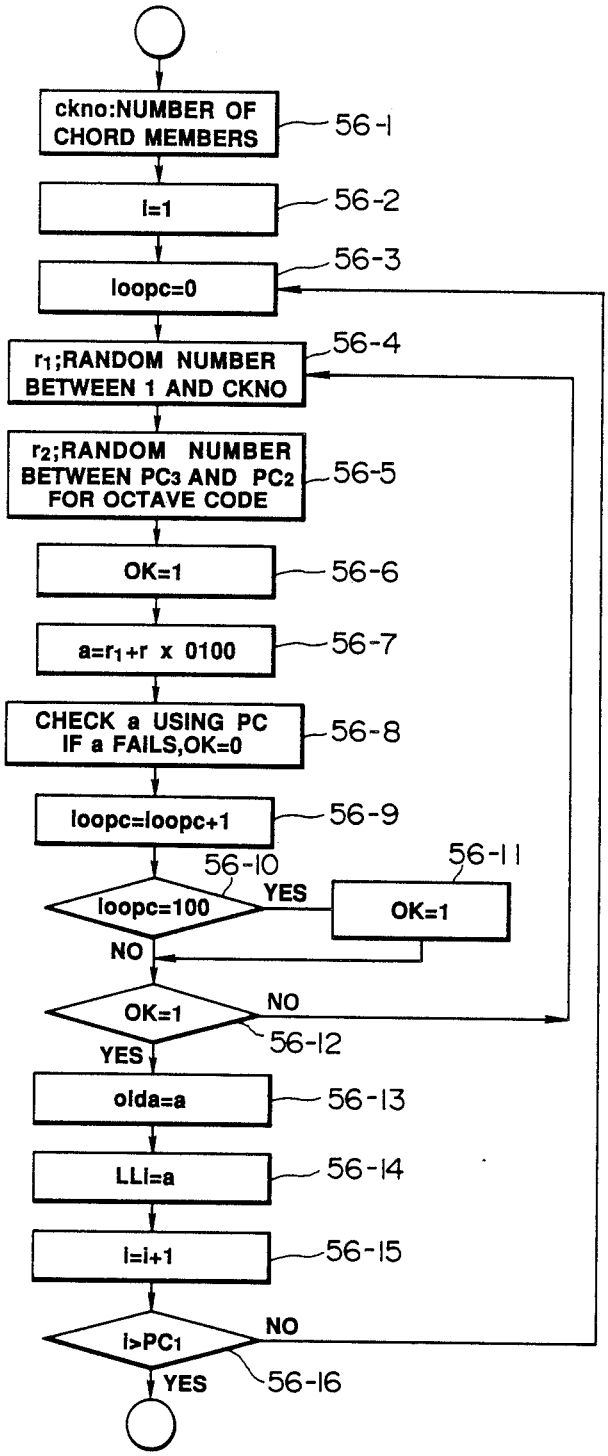
FIG. 56 is a flowchart for generating an arpeggio pattern.

FIG. 56 shows a detailed flow of arpeggio pattern generation executed in steps 54-9 and 54-15 in FIG. 54. A symbol ckno in step 56-1 represents the number of chord members. This number is obtained by counting "1" bits among 16 bits of chord member data (see FIG. 30). In the example of FIG. 56, PC1 to PC5 are used as parameters for the control of arpeggio pattern generation. Data r1 is a random number from "1" to "ckno" and represents a chord member location (step 56-4). Data r2 is a random number between PC3 (representing the lowest arpeggio pattern tone) and PC2 (representing the highest arpeggio pattern tone) and represents the octave number of LL generated (step 56-5). A candidate a for LL to be generated is calculated from a=r1+r2×0100 (step 56-7), and if the candidate a satisfies the condition of PC, it is adopted as LL (steps 56-8, 56-12 and 56-14). After the determination of the preceding arpeggio pattern element LL (for instance, the first arpeggio pattern element LL1), the candidate for the succeeding pattern element LL2 can fail to satisfy the PC condition forever, depending on the values of PC. Assume, for example, that LL1=403 is obtained (the first LL being the third chord member on the fourth octave) with PC2=501 (the highest pitch tone of arpeggio being the first chord member on the fifth octave), PC3=401 (the lowest pitch tone of arpeggio being the first chord member on the fourth octave), PC4=3 (the maximum interval between adjacent LL having a range of three chord members) and PC5=3 (the minimum interval between adjacent LL having a range of three chord members). Then, to satisfy the conditions of PC4 and PC5, LL2 must be either LL2=503 or LL2=303 in a case of three member chord. This can not satisfy the conditions of PC2 and PC3. For this reason, a loop counter LOOPC is provided to forcibly adopt the candidate a as LL when the loop counter LOOPC exceeds a certain count, for instance "100" (steps 56-9, 56-10 and 56-11).

Figure 57:
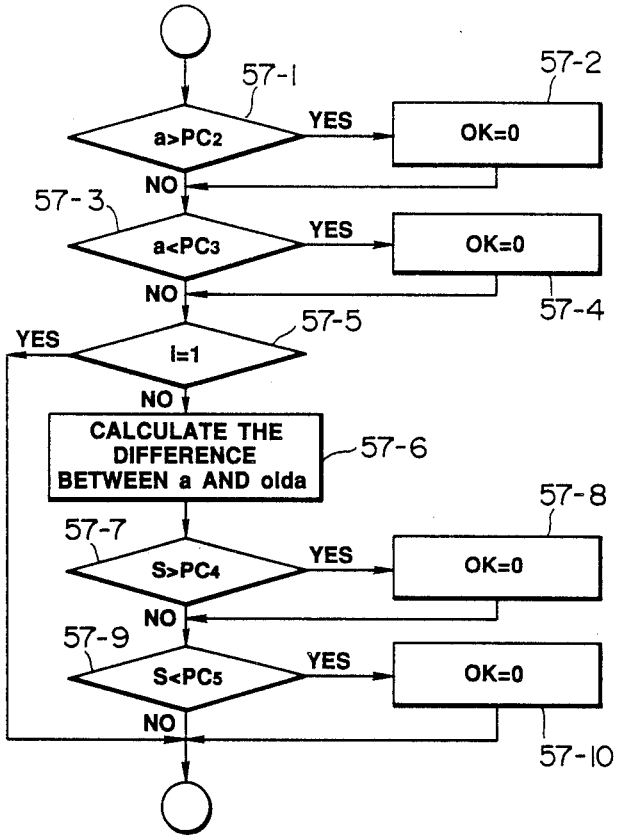
FIG. 57 is a flowchart for checking an arpeggio pattern.

FIG. 57 shows a detailed flow of the check 56-8 in FIG. 56. The candidate a for LL1 should satisfy the PC conditions, as follows:

(a) a≦PC2 (pitch of a being no higher than the highest pitch)

(b) a≧PC3 (pitch of a being no lower than the lowest pitch)

(c) I a - LLi-1 I≦PC4 (interval from the immediately preceding LL begin no greater than PC4)

(d) I a - LLi-1 I≧PC5 (interval from the immediately preceding LL being no less than PC5)

In the flow of FIG. 57, if these conditions are not satisfied, a flag OK is set to "0" (olda in the Figure representing the immediately preceding LL, see step 56-13).

Figure 58:
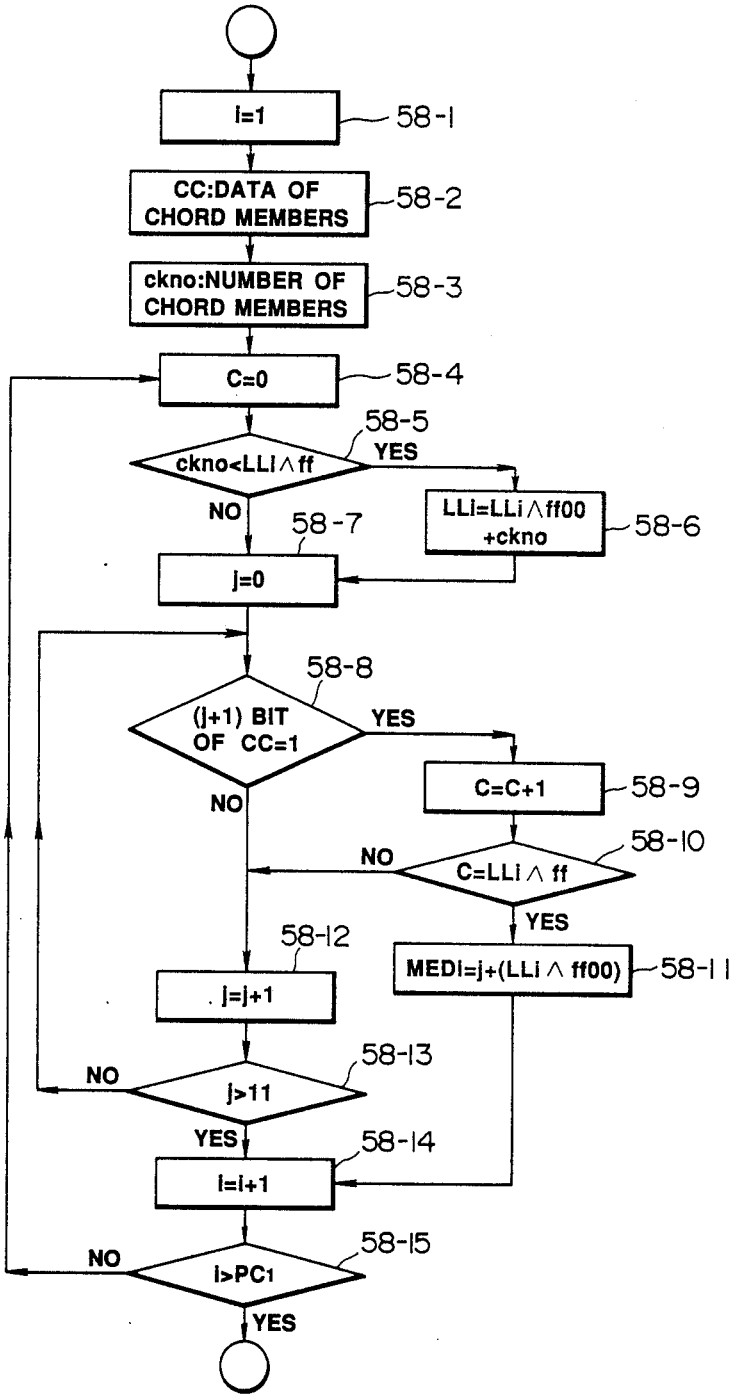
FIG. 58 is a flowchart for converting the generated arpeggio pattern to a format of melody data.

FIG. 58 shows the details of 53-7 in FIG. 53. The purpose of this routine is to convert the format of arpeggio pattern LL designated by the octave number+-chord member number into a melody data format shown by the octave number+pitch name number by using chord member data cc before storing the pattern in MEDi. The process of steps 58-5 and 58-6 is done for converting, if the chord member number (LLi Λ 00ff) of LLi is greater than the number (CKNO) of chord members of the chord of the segment under consideration, the chord member number of LLi into the highest chord member number among the chord members in the segment under consideration. In the Figure, c denotes a chord member counter, LLi Λ ff00 the octave number of LLi, and j a pitch name counter.

Figure 59:
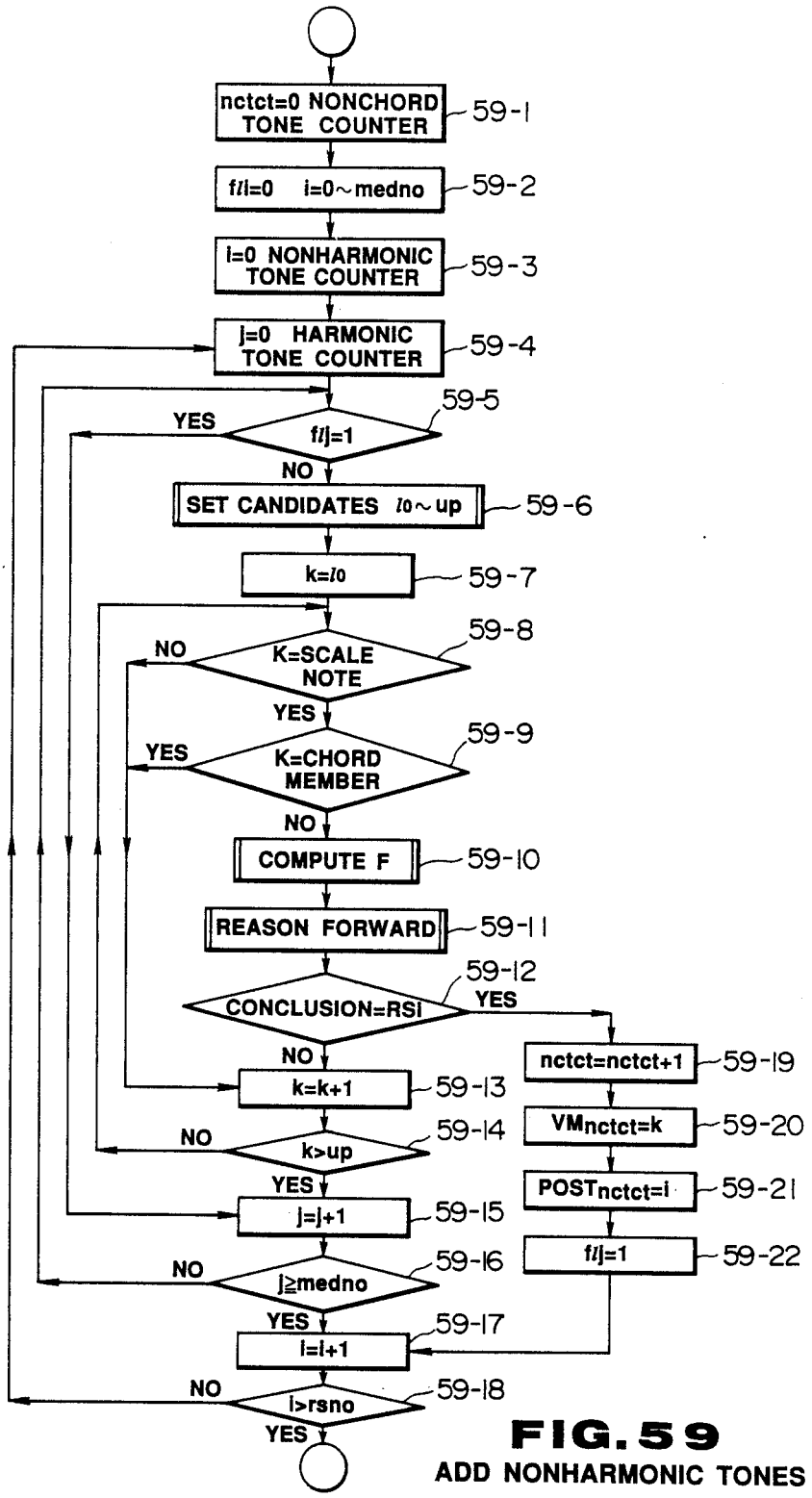
FIGS. 59 and 60 show, in combination, a flowchart for adding nonharmonic tones to the arpeggio tones.
Figure 60:
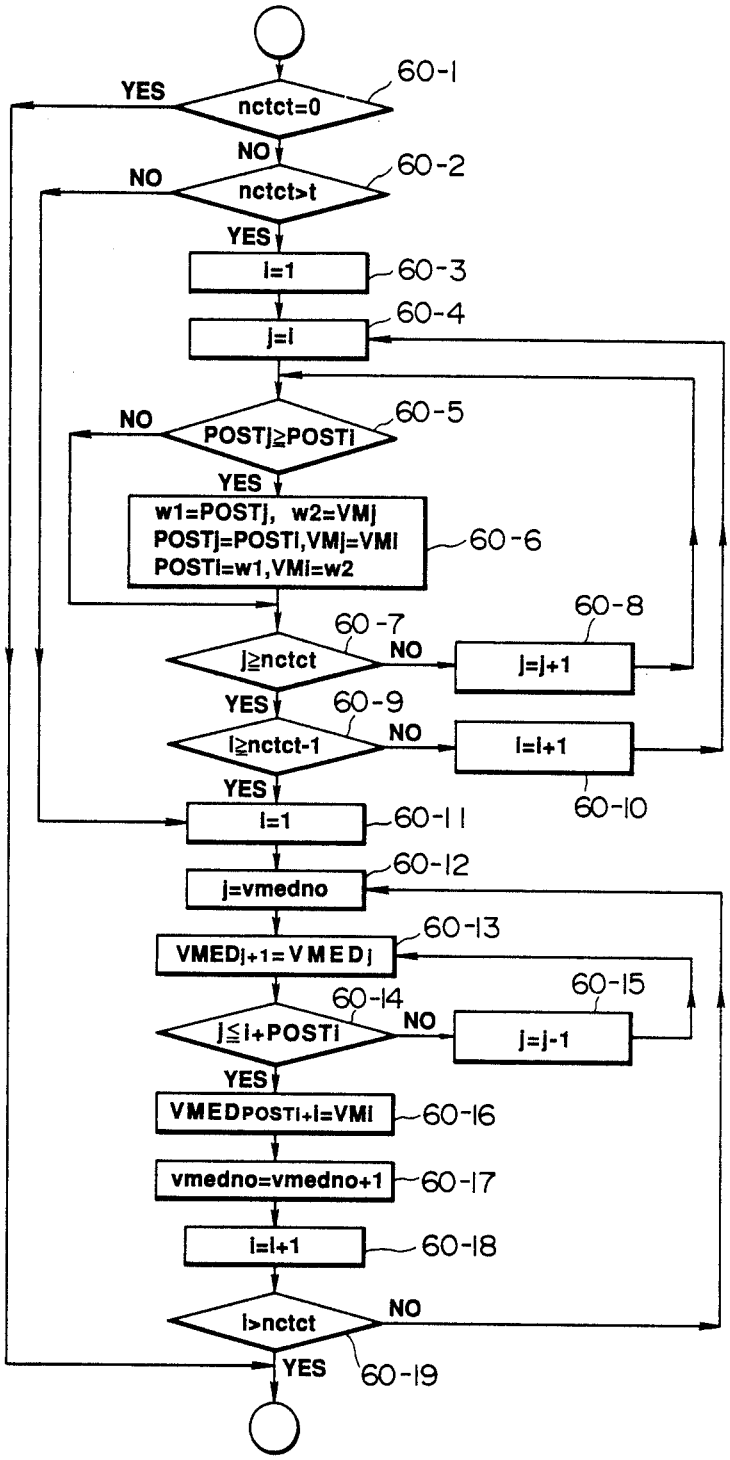

FIGS. 59 and 60 show details of the nonharmonic tone addition step 53-8 in FIG. 53. The purpose of this process is to add desired nonharmonic tones to arpeggio so as to complete a melody pitch series. The process utilizes features RSi of nonharmonic tones, key structure KEYi obtained in the chord progression evaluation and production rules representative of knowledge for classifying nonharmonic tones. Each nonharmonic tone to be added should satisfy the following conditions.

(a) It should be a tone in a predetermined range.

(b) It should be a tone in a scale having a keynote of KEYi obtained in the chord progression evaluation.

(c) It should not be a chord member.

(d) It should be a tone, for which the conclusion obtained from production rules matches a nonharmonic tone identifier RSi.

Figure 61:
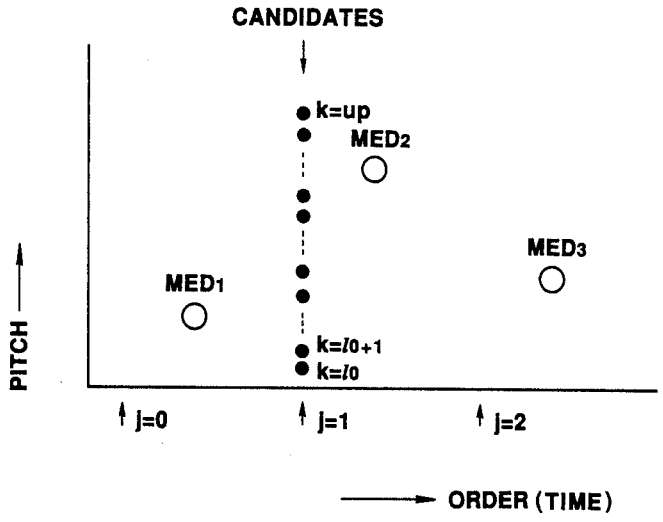
FIG. 61 shows an order of adding nonharmonic tones.

In FIG. 59, a loop of steps 59-4 through 59-18 is repeated a number of times corresponding to the number of designated nonharmonic identifiers RSi. A loop of steps 59-5 through 59-16 is repeated a number of times corresponding to the number of arpeggio notes. In steps 59-8 through 59-14, pitch data k in a range from the lower limit "1o" to the upper limit "up" are successively checked as candidate for nonharmonic tone (see FIG. 61). If pitch data k represents a scale note other than the chord members (steps 58-8 and 59-9), the functions F are computed (step 59-10), and forward reasoning based on production rules is executed (step 59-11). Then a check is done as to whether the conclusion matches a designated nonharmonic identifier RSi (step 59-11). If it matches, pitch data k satisfies all the conditions of nonharmonic tone as noted above. Consequently, a non-chord tone counter ctct for counting added nonharmonic tones is incremented, pitch data k of the found nonharmonic tone is set in VMnctct, position 1 of the added nonharmonic tone is set in POSTnctct, and an associated flag flj is set to "1" (steps 59-19 through 59-22). In this example, at most one nonharmonic tone can be inserted between adjacent harmonic tones, and flj=0 indicates that no harmonic tone is provided yet between adjacent harmonic tones MEDj and MEDj+1.

If the conclusion mismatches RSi in the step 59-12, the pitch data k under consideration does not satisfy the condition for nonharmonic tone. Thus, pitch data k is incremented (step 59-13), and the process is repeated. If k>UP is satisfied in the step 59-14, it means that the test has failed to find any suitable nonharmonic tone between adjacent harmonic tones MEDj and MEDj+1. Thus, j is incremented to proceed with the test as to whether a nonharmonic tone can be provided between next adjacent harmonic tones.

Figure 62:
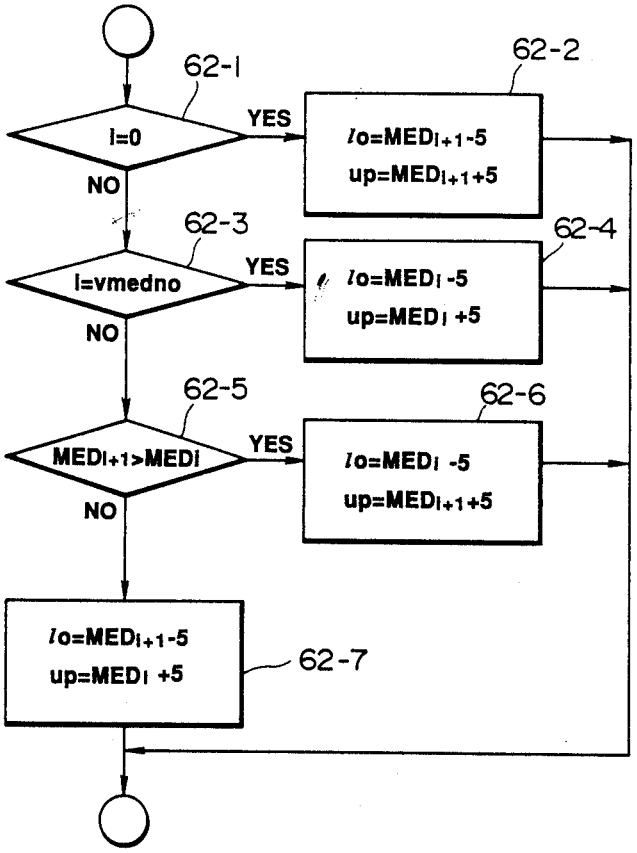
FIG. 62 is a flowchart for setting pitch limits to a nonharmonic tone.

FIG. 62 shows details of step 59-6 for setting pitch range of a candidate for a nonharmonic tone. In this example, the pitch range is set between fifth degrees above the higher one of the adjacent harmonic tones MEDi and MEDi+1 and fifth degrees below the lower one of MEDi and MEDi+1 (steps 62-5 through 62-7). However, when i=0, that is, when a nonharmonic tone is to be added before the first harmonic tone in the segment under consideration, the pitch range is set between fifth degrees above and below the first harmonic tone (steps 62-1 and 62-2). When i=Vmedno, that is, when a nonharmonic tone is to be added after the last harmonic tone in the segment under consideration, the pitch range is set between fifth degrees above and below the last harmonic tone (steps 62-3 and 62-4).

FIG. 65 shows a detailed flowchart of 59-8 for checking whether pitch data k is a scale tone. In the Figure, SCALEi represents the type of scale used in segment i and points to an address in the note scale memory 5 shown in FIG. 64. 12-bit scale data *SCALEi in this address is rotated by KEYi obtained in the chord progression evaluation noted above (step 65-2). When SCALEi is, for instance, "0" (diatonic scale), its scale data represents do, re, mi, fa, sol, la, si, do with C as tonic. If KEYi is "5" (F), the data is rotated by "5", resulting in concerted scale data with F as tonic. In a step 65-3, pitch data k (denoted by MD in the Figure) is converted into a data b having the same format as scale data. If the logic AND of the result b and scale data a is "0", a conclusion is reached that the pitch data k is not a scale tone (steps 65-4, 65-6). Otherwise, the data k is confirmed to be a scale tone (steps 65-4, 65-7).

Figures 63, 64:
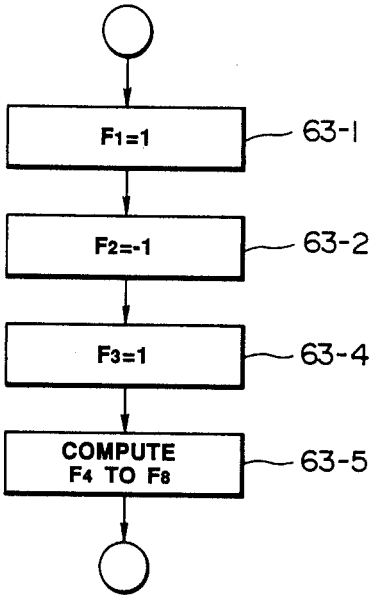
FIG. 63 is a flowchart for computing functions F.
FIG. 64 exemplifies data of note scales stored in a scale memory.

FIG. 63 shows a detailed flowchart of 59-10 for computing F. Since in this embodiment only a single nonharmonic tone may be provided between adjacent harmonic tones, some of the function (i.e., F1 to F3 in the illustrated case) are set to predetermined values.

Details of the forward reasoning in the step 59-11 are shown in FIG. 44.

When the process of FIG. 59 is ended, the number of added nonharmonic tones is stored in nctct, pitch data of the i-th nonharmonic data added in the process of FIG. 59 is stored in the i-th element of array Vi, and position data of the i-th added nonharmonic tone is stored in the i-th element of array POSTi.

These data are converted in the process shown in FIG. 60 into the format of melody data VMEDi. Array VMEDi has been initialized to arpeggio MEDi. In steps 60-2 through 60-9, arrays POSTi and VMi are sorted in the order of positions of addition of nonharmonic tones. In steps 60-10 through 60-19 pitch data VMi of nonharmonic tone is inserted at a position represented by positional data POSTi.

Although in this embodiment only a single nonharmonic tone can be provided between adjacent harmonic tones, it is possible to alter the process such that a plurality of nonharmonic tones may be provided between adjacent harmonic tones.

So far the melody pitch series data is completed. The remaining process is to generate a succession of melody tone durations.

Figure 66:
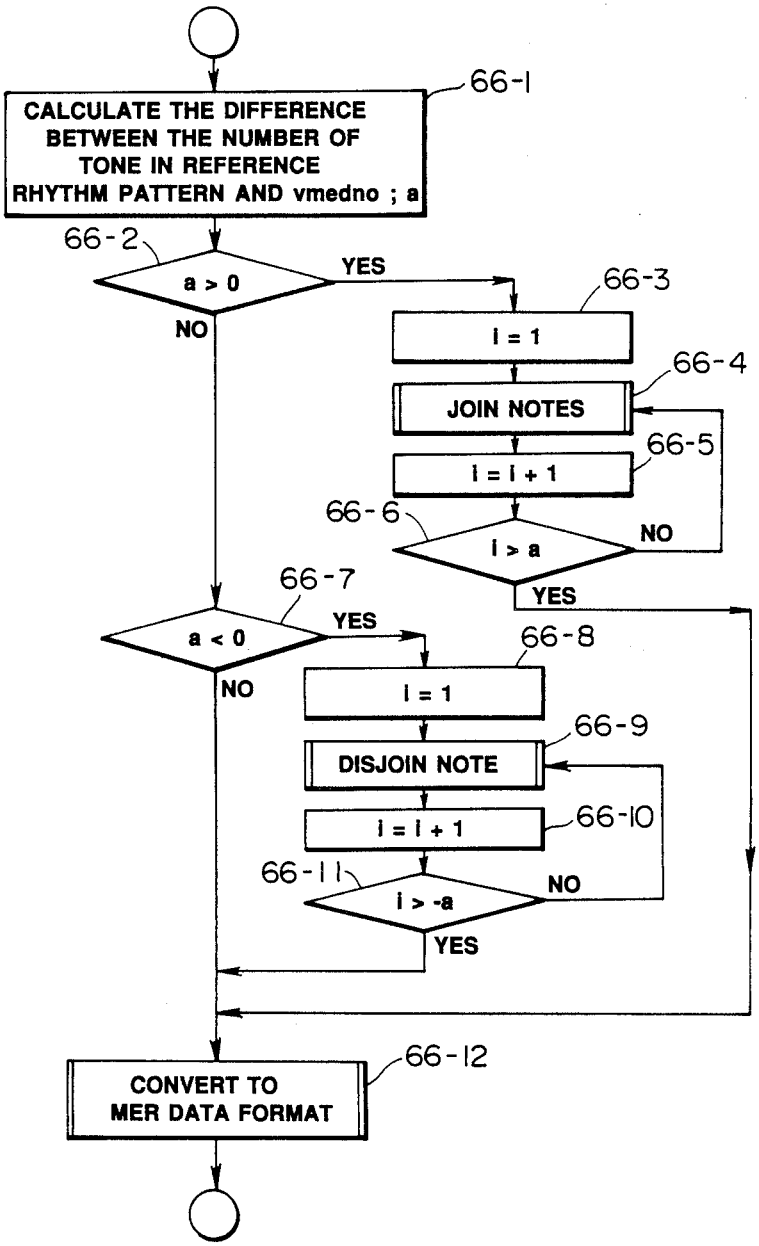
FIG. 66 is a flowchart for generating tone duration data (rhythm pattern) of a melody.

FIG. 66 shows a detailed flow of 53-9 for generating a melody tone duration series. First, comparison is made between the number of notes in the reference rhythm pattern as obtained in the essential generation or extraction and the number Vmedno of notes generated in a segment under consideration (i.e., number of data in melody pitch series) to obtain the difference a therebetween (step 66-1). If the number of melody notes generated is less than the number of notes in the reference rhythm pattern (i.e., $a>0$), an optimum joining of notes based on pulse scale is repeatedly executed a number of times corresponding to the difference a with respect to the reference rhythm pattern (steps 66-2 through 66-6). If the former number is greater than the latter number (i.e., $a<0$), an optimum disjoining of notes is repeatedly executed a number of times corresponding to the difference (steps 66-7 through 66-11). Since the rhythm pattern data is formed with 16 bits with the individual bit positions assigned to respective timings such that each of "1" bit positions represents sounding of a tone, conversion to MER data format is finally executed (step 66-12).

Figure 67:
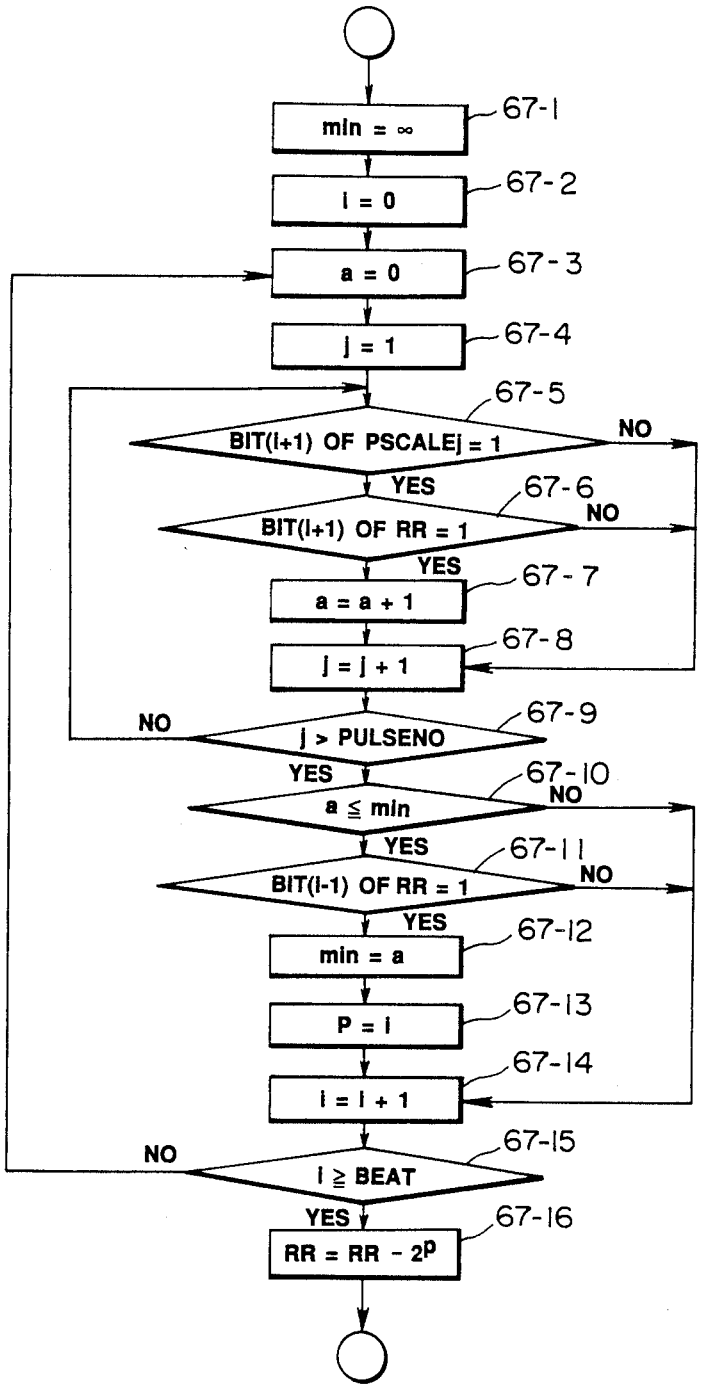
FIG. 67 is a flowchart for joining notes.

FIG. 67 shows the note-joining process in detail. In the figure, PSCALEj represents the j-th subscale in the pulse scale used, and RR represents the rhythm pattern to be processed. To join notes, a "1" bit of RR with the minimum pulse scale weight is set to "0". For example, when the reference rhythm pattern is

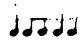

When the notes are decreased by one by note-joining, using the normal pulse scale (see FIG. 11), this results in

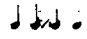

More particularly, RR is initially

0001 0001 0101 0001 while the normal pulse scale is

1213 1214 1213 1215.

A "1" bit of RR corresponding to the lightest weight in the minimum normal pulse scale is at the seventh position from the right end. The bit at this position is changed to "0". The resultant RR is thus

0001 0001 0001 0001.

This represents

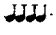

Figure 68:
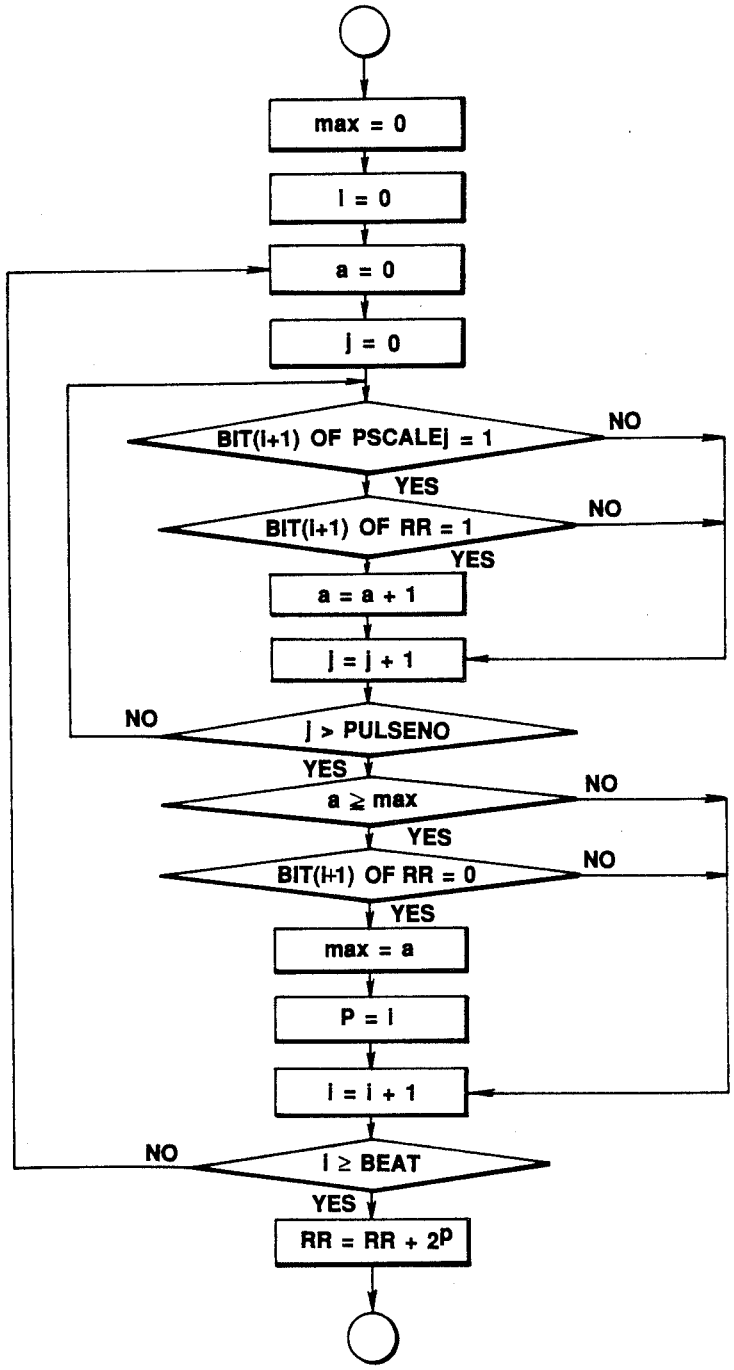
FIG. 68 is a flowchart for disjoining notes.

FIG. 68 shows the note-disjointing process in detail. To disjoin a note, a "0" bit of RR with the maximum pulse scale weight is set to "1". As an example, with a rhythm pattern

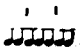

disjoining a note with the normal pulse scale yields

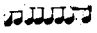

Figure 69:
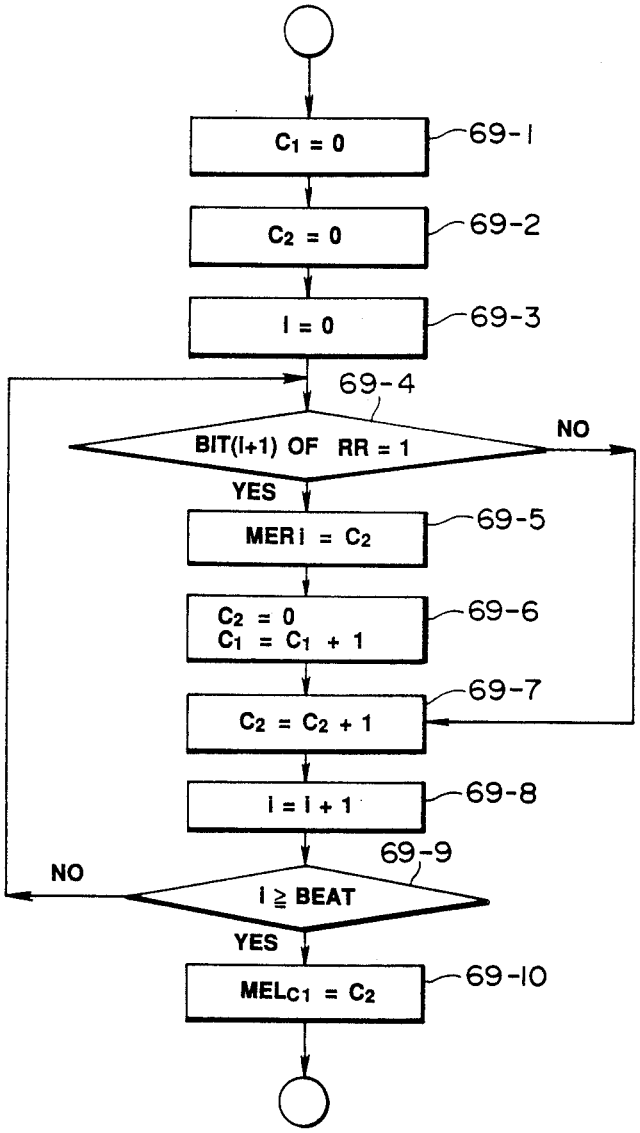
FIG. 69 is a flowchart for converting the generated rhythm pattern to a MER data format.

FIG. 69 shows details of step 66-12 for converting the rhythm pattern to the MER data format. In the Figure, c1 denotes a note counter, and c2 a counter for measuring the tone duration of each note. In this example, MER0 stores the duration of time until the first "1" bit in RR is encountered so that the melody may contain a tone crossing a segment boundary (bar line) for syncopation.

Figure 70:
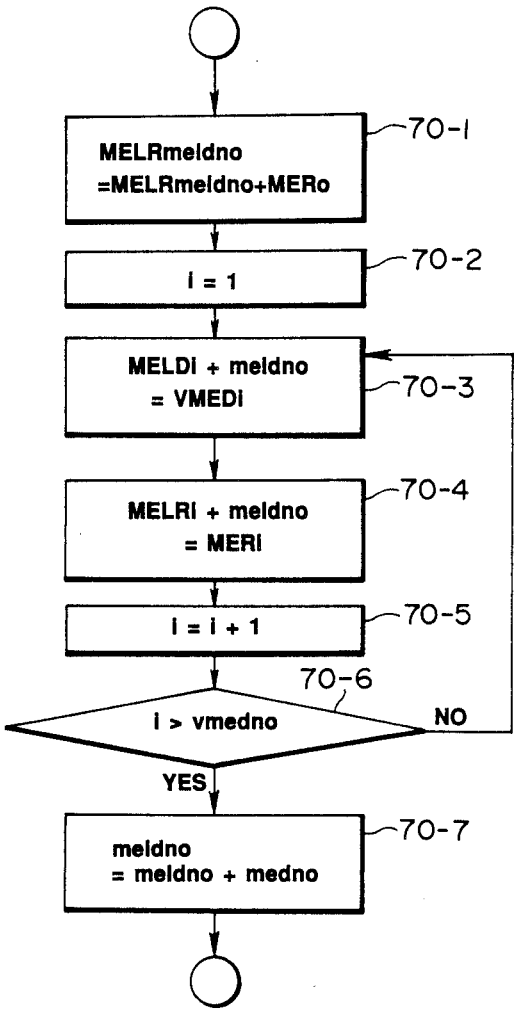
FIG. 70 is a flowchart for placing the generated melody data in a contiguous area.

FIG. 70 shows details of step 53-10 for connecting the melody segment data to the line of melody. First, MER0 (blank portion in the head of the segment under consideration) is added to MELRmeldno (duration data of the last generated note in the previous measure), where meldno represents the number of notes already generated. A pitch series VMED1 to VMEDvmedno generated in this time is connected to MELD, and a tone duration series MER1 to MERvmedno generated this time is connected to MELR (steps 70-2 through 70-6). Finally, meldno is updated to exit from the flow (step 70-7).

[FEATURES OF MUSIC COMPOSER MODE]

As has been described above, the present embodiment has various features in the music composer mode, some of which are as follows:

(a) A production system of effecting reasoning using musical knowledge is involved in the analysis and synthesis of a melody.

(b) Because the process of classifying nonharmonic tones contained in melody and the process of adding nonharmonic tones to arpeggio are performed on the basis of the same production rules representing musical knowledge, the two processes are reversible to each other.

(c) Music is planned by analyzing a chord progression given as a material of music composition and extracting hierarchic and key structures in music.

(d) The extracted key structure specifies the key of the scale available in each segment. Thus, natural sound music with a sense of tonality is guaranteed.

(e) The extracted hierarchic structure is utilized for controlling the arpeggio generation. Thus, it is possible to provide consistency and variety to music that is generated.

It should be noted, however that the present embodiment is given for the sake of illustration only, and various changes, modifications and improvements of it are possible. For example, while in the present embodiment the arpeggio pattern feature data PC extracted from the motif are used as control data for the generation of arpeggio pattern LL, it is possible to change the arpeggio pattern features PC in the course of music. This can be realized by means of calculating functions that depend on the position of music and hierarchic structure.

Likewise, nonharmonic tone features RSi may be changed with the progress of music. For example, one of nonharmonic tone identifiers extracted from the motif is substituted into a different nonharmonic tone identifier. This can be realized by selecting at random a nonharmonic tone identifier in an identifier set.

Further, while in the embodiment the rhythm is controlled through the joining and disjoining of notes according to the pulse scale, it is possible to extract a dominant mini-rhythm pattern in the motif and incorporate it in the melody tone duration series to be generated.

[[MELODY ANALYZER MODE]]

Now, the melody analyzer mode of this embodiment will be described.

Figure 71:
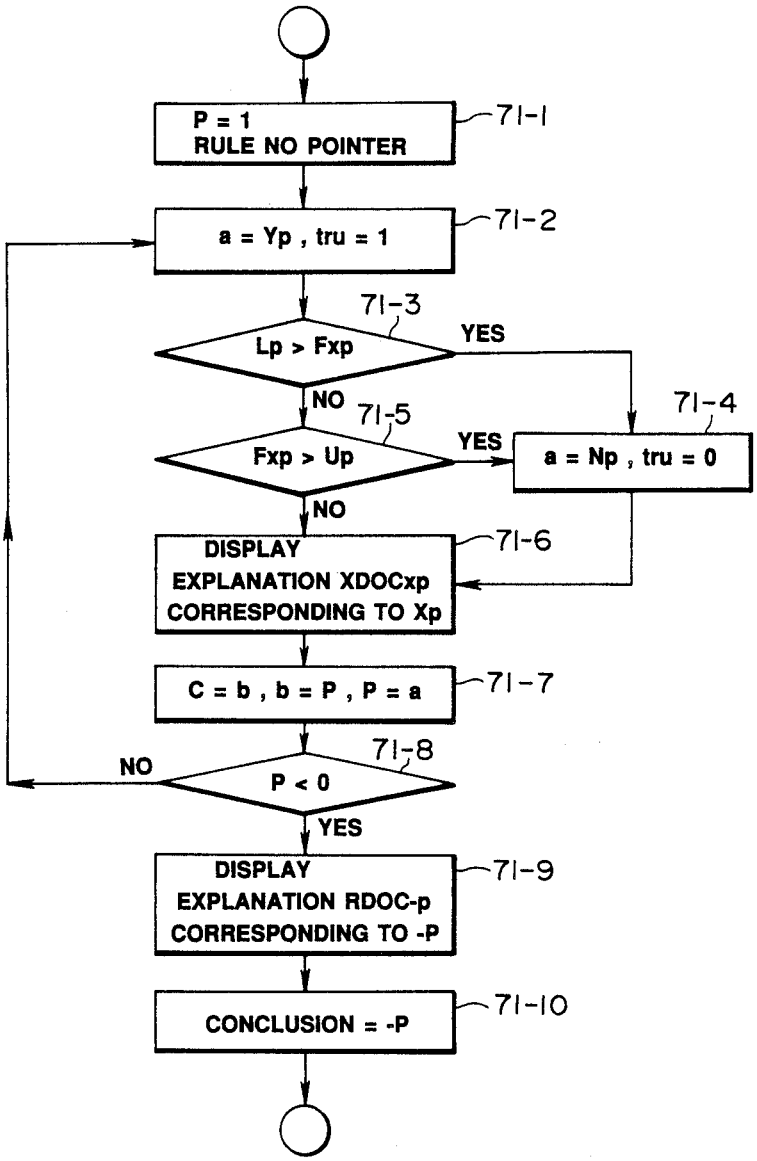
FIG. 71 is a flowchart for forward reasoning with explanation.

FIG. 71 shows a flow of forward reasoning with explanatory function. This flow is executed in the melody analysis step 5-6 in the general flow shown in FIG.

5 in the music composer mode. The same is also executed in the step 6-4 of the flow shown in FIG. 6 in the musical knowledge editor mode. The purpose of this flow is to classify nonharmonic tones contained in a melody by forward reasoning and to tell the user the conclusion and reason why the conclusion is reached. The user thus can readily obtain knowledge about the classification of nonharmonic tones. In a step 71-6 of the flow of FIG. 71, information of the condition parts linked to the final conclusion (i.e., leaf of production rule) is displayed on the monitor. In a step 71-9, a message of the final conclusion is shown in a step 71-7, a pointer to a rule having the final conclusion in its consequent part and a pointer to the immediately preceding rule are stored in registers b and c, respectively. These variables b and c are utilized in knowledge edition (change of a production rule data) to be described later. The portion of the flow other than the steps 71-6, 71-7, and 71-9 is the same as the forward reasoning shown in FIG. 44.

Figure 72:
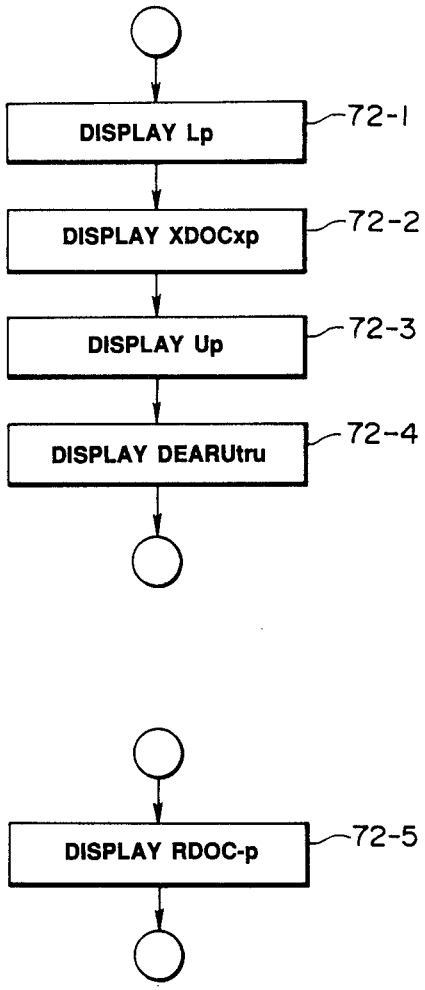
FIG. 72 is a flowchart for displaying the explanation.

Details of the step 71-6 are shown in steps 72-1 through 72-4 in FIG. 72, and details of the step 71-9 are shown in a step 72-5. FIG. 73 shows an example of the explanatory message. In the step 72-1 lower limit data Lp to the function in the condition part is displayed, and in the step 72-2 a message XDOCxp indicative of kind of the function Xp in the condition part is displayed. In the step 72-3 upper limit data Up to the function in the condition part is displayed, in the step 72-4 a message DEARUtru indicative of whether the condition part is satisfied is shown, and in the step 72-5 a message RDOC-p indicative conclusion-p is shown.

Figure 74:
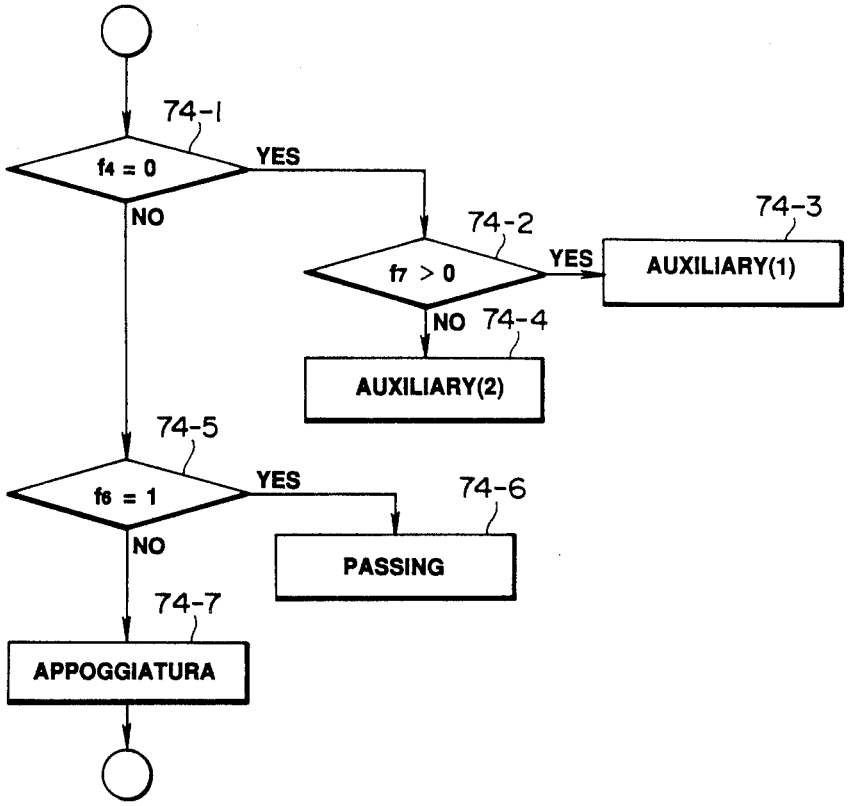
FIG. 74 shows an example of production rule data.

FIG. 74 shows an example of production rules. An example of display of explanatory messages when these rules are used for reasoning is shown in FIG. 75. Given an example, in which re in a melody of do, re, mi, is to be analyzed with chord Cmaj, then the flow of FIG. 74 proceeds as follows. In step 74-1 of checking rule condition ($0 \leqq f4 \leqq 0$), a message "$0 \leqq$ pitch difference between adjacent harmonic tones $\leqq 0$ is false" is displayed. When the next rule condition ($1 \leqq f6 \leqq 1$) is checked in a step 74-5, a message "$1 \leqq$ monotonously increasing or decreasing identifier $\leqq 1$ is true" and a message "conclusion: passing" corresponding to affirmative consequent part−p (=3) of the rule are displayed. From these messages, it can be seen that the nonharmonic tone "re" in "do, re, mi" is concluded to be a passing tone because there is a pitch difference between its immediately preceding and immediately succeeding harmonic tones "do" and "mi" and the tone pitch variation in the row of "do", "re" and "mi" are monotonous.

In this manner the melody analyzer does the analysis of melody to derive the type of nonharmonic tones through reasoning based on the production rules. In addition, the meaning of the production rule data used in the reasoning is notified to the user. If the user is dissatisfied with analysis results given from the melody analyzer, he or she can correct the production rule data such that desired results can be obtained, as will be described hereinbelow in connection with the musical knowledge editor mode.

[[MUSICAL KNOWLEDGE EDITOR]]

In the musical knowledge editor mode, the present embodiment provides an environment, which permits the user to correct production rule data representative of musical knowledge used in the analysis and synthesis of melody.

Now, as correction of production rule data, addition, deletion and alteration of knowledge will be described.

[ADDITION OF KNOWLEDGE (NODE)]

Figure 76:
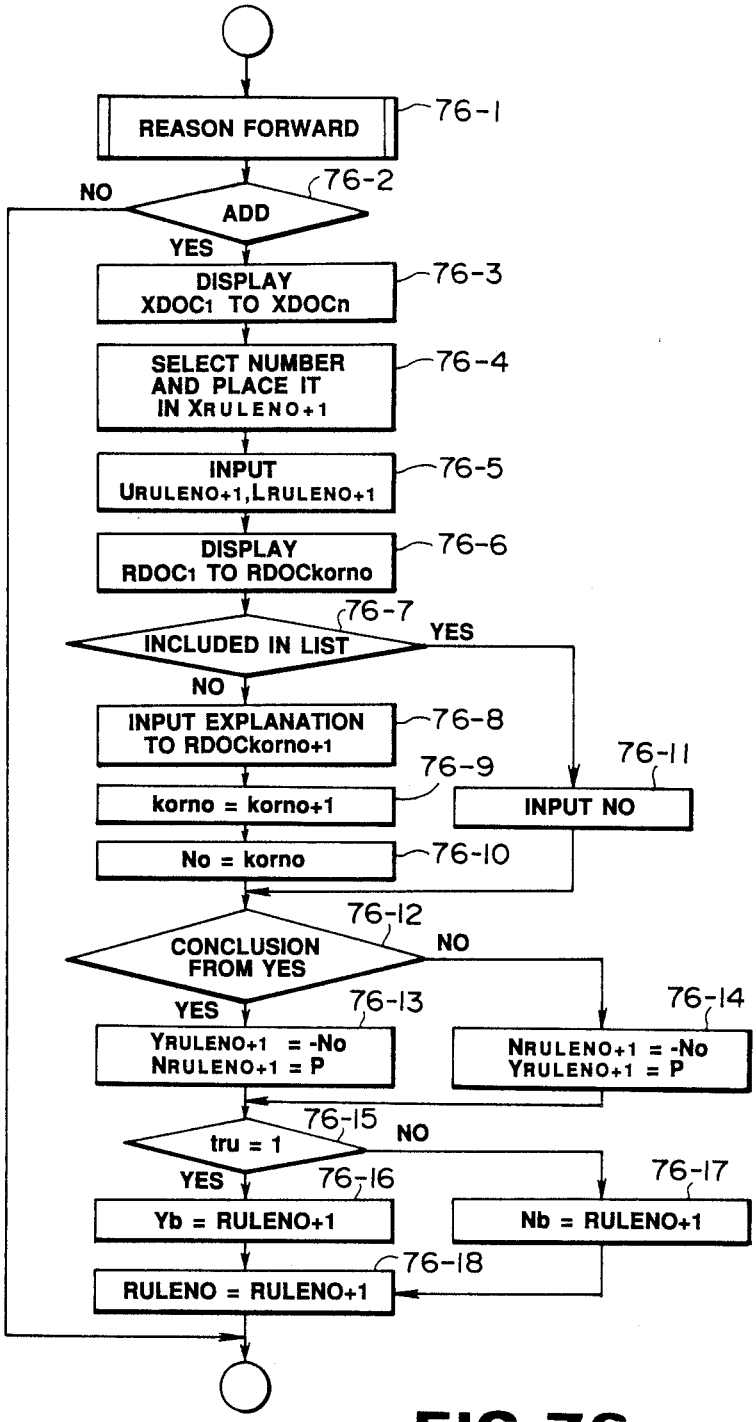
FIG. 76 is a flowchart for adding a node to production rule data.
Figure 77:
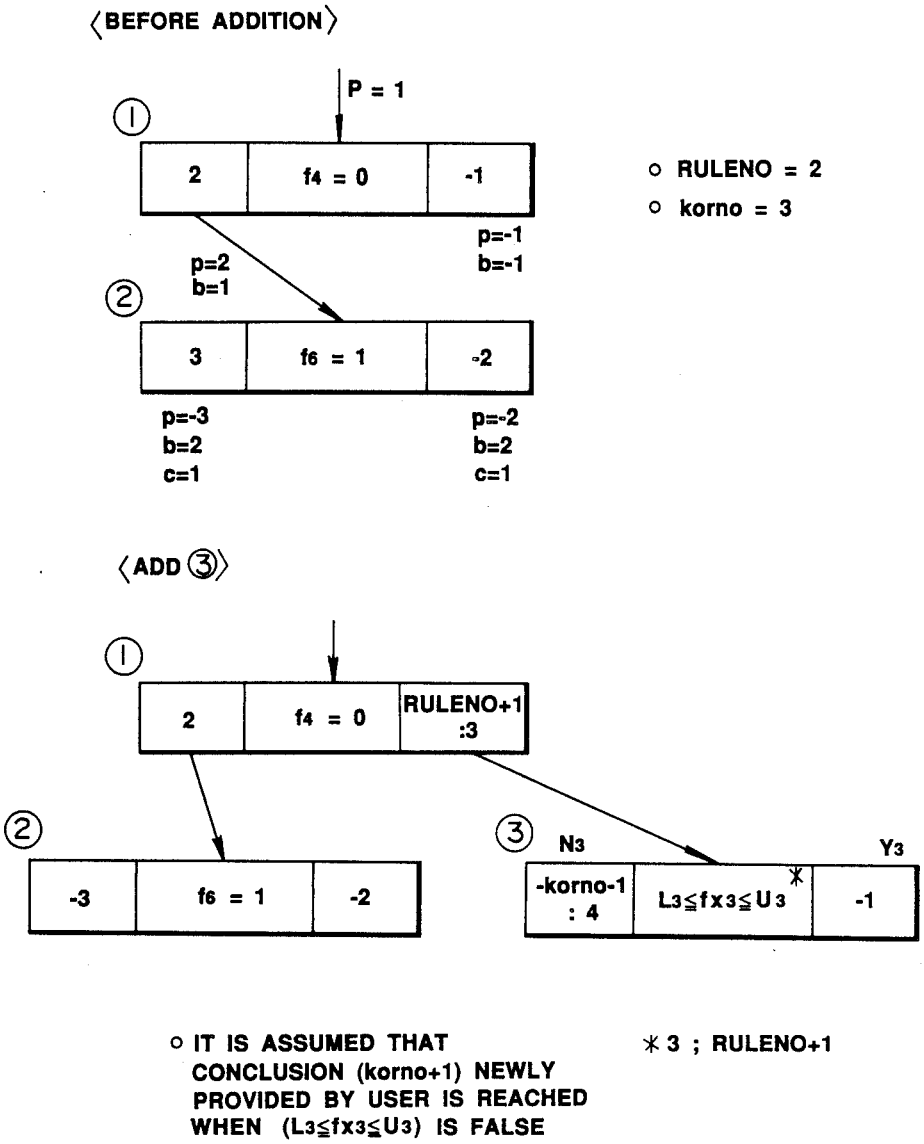
FIG. 77 schematically shows how rule data are updated by adding a node.

FIG. 76 is a flow for adding a node to production rules, and FIG. 77 shows how a node is added. In a step 76-1 in the flow of FIG. 76, forward reasoning with explanatory function as discussed above is executed. When the user desires an addition of node from the result of analysis, he will make a request for node addition (step 76-2). Explanation in the forward reasoning is as follows.

First rule: $Lp1 \leqq XDOCp1 \leqq Up1$ *DEARUtru*

Next rule: $Lp \leqq XDOCp2 \leqq Up2$ *DEARUtru*

Last rule: $Lpn \leqq XDOCpn \leqq Upn$ *DEARUtru*

*RDOC − p* (conclusion)

It is now assumed that the user thinks it necessary to add another rule (node) in order to reach the conclusion RDOC−p. Denoting the rule pointer to the additional node by Pn+1, the conclusion RDOC−p will be obtained when $Lpn+1 \leqq XDOCpn+1 \leqq Upn+1$ is satisfied or not. If the conclusion RDOC−p is to be reached when the condition part of the additional node is satisfied, a separate conclusion has to be prepared for the other case, that is, when the condition part is not satisfied. Conversely, if the conclusion RDOC−p is to be reached when the condition part of the additional node is not satisfied, a separate conclusion has to be prepared for the case when the condition part is satisfied.

Thus, for the node addition, the user has to input the following items of data.

(a) lower and upper limits Lpn+1 and Upn+1 of the condition part of the additional node (b) selection of the type Xpn+1 of function of the condition part (c) name of nonharmonic tone identifier stored in the conclusion part of the additional node (d) selection as to whether the nonharmonic tone identifier is a conclusion when the condition part of the additional node is satisfied or not.

The condition part of the additional node is input in steps 76-3 through 76-5. More specifically, in the step 76-3 a function list XDOC1 to XDOCn is displayed, and in the step 76-4 the function number selected by the user is loaded into Xruleno+1. RULENO+1 is a pointer of the additional rule. In the step 76-5 the lower and upper limit data are input by the user to be set in LRULENO+1 and URULENO+1. In steps 76-6 through 76-10, the conclusion to be added is input. In the step 76-10, a conclusion list RDOC1 to RDOCkorno (korno being the number of types of conclusions) is displayed. The conclusion list may or may not contain the conclusion (i.e., nonharmonic tone identifier) to be added. If it is included in the conclusion list, the conclusion number is selected (steps 76-7 and 76-11). If it is not included, a new conclusion name is set in RDOCkorno+1 (steps 76-7 and 76-8). Then, korno is incremented, and the resultant value is set as conclusion data in No (steps 76-9 and 76-10). In steps 76-12 through 76-14, an input indicative of whether the added conclusion is to be reached when the condition part of the additional rule is satisfied (YES side) or not is received, and −No (additional conclusion data) and P (conclusion data obtained in the forward reasoning) are set in corresponding YRULENO+1 and NRULENO+1. At this point, additional rule data are registered in the production rule memory. The remaining process (steps 76-15 through 76-18) is to link the last rule used in the forward reasoning (old roof rule) to the added rule with a pointer. More specifically, to change the consequent part of the last rule in the forward reasoning to data pointing to the added rule, RULENO+1 is written into Yb or Nb according to the value of tru. Finally, the number RULENO of rules is updated to bring the node addition process to an end.

[DELETION OF KNOWLEDGE (NODE)]

Figure 78:
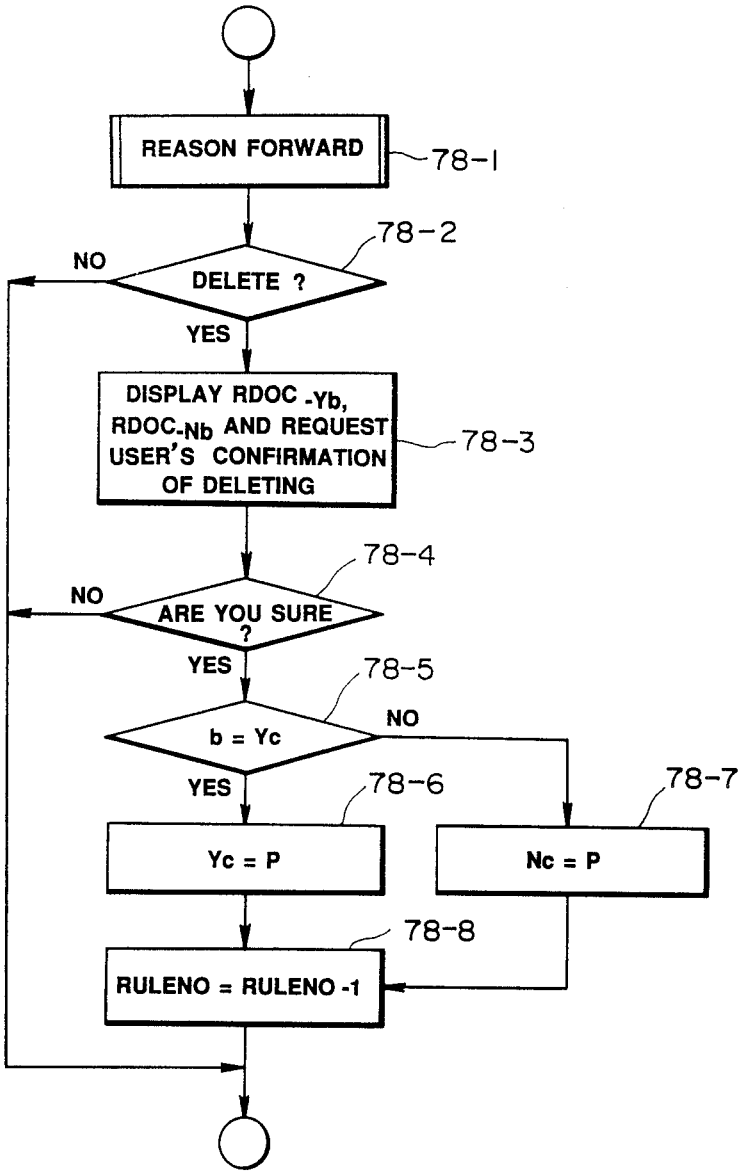
FIG. 78 is a flowchart for deleting a node from rule data.
Figure 79:
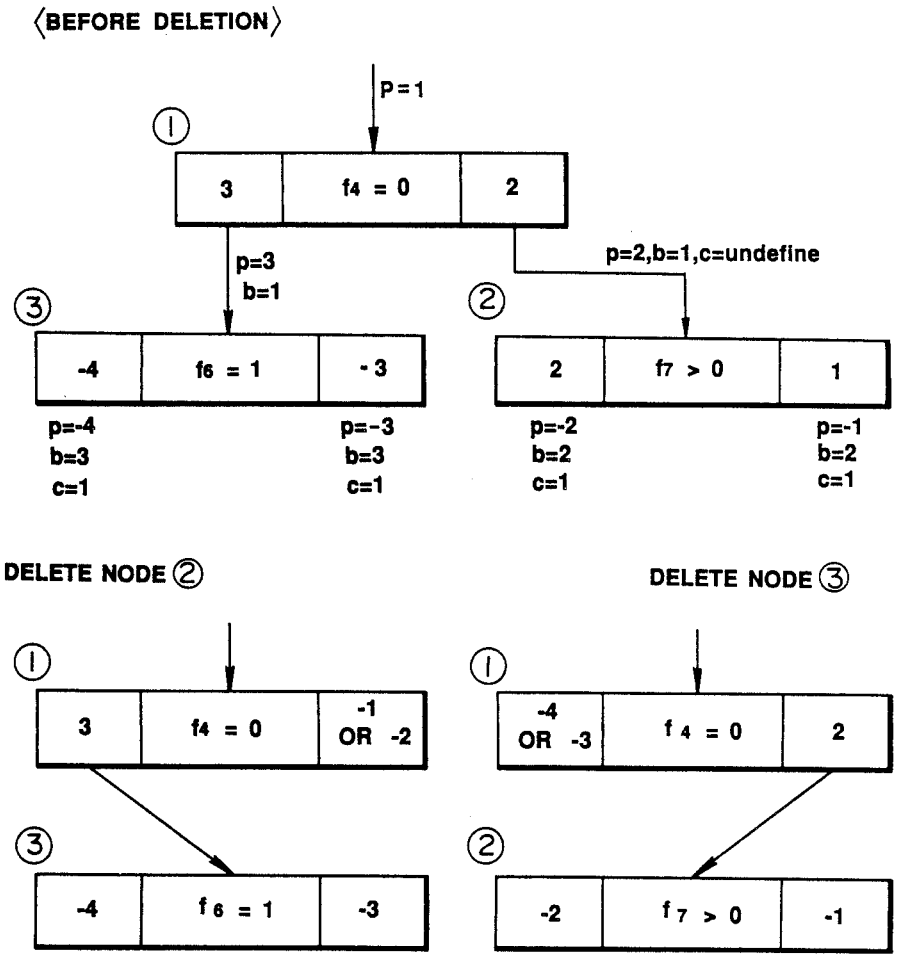
FIG. 79 schematically shows how rule data are updated by deleting a node.

FIG. 78 is a flow for deleting a node from the production rules and FIG. 79 shows how a node is deleted. In this example, deletion can be done only to a node, whose consequent parts (Yp, Xp) do not point to the next rules but represent nonharmonic identifiers (final conclusion). In other words, deletions start with a leaf or terminal of tree-structure knowledge. For this reason, both consequent parts RDOC−Yb and RDOC−Nb of the rule (one of which is the conclusion of the forward reasoning) are displayed (step 78-3). In the alternative, if Yb or Nb has a positive value representing the pointer to the next rule, a message that the rule cannot be deleted may be directly notified to the user. When the user confirms deleting of a node which can be deleted (step 78-5), a check is done as to which of the consequent parts Yb, Nb of the node applied before the node to be deleted points to the node to be deleted (step 78-6). The consequent part that has served as the pointer to the node to be deleted is changed to conclusion data P of forward reasoning (nonharmonic tone identifier) (steps 78-6 and 78-7). In consequence, the b-th node (rule) is deleted from the production rule memory. Finally, the rule member RULENO is decremented to complete the node deletion process (step 78-9).

As an example, suppose that f4=0 and f7=2 are given as melody situation. In this case, when the forward reasoning is executed by using the production rules shown in FIG. 74, the condition part $0 \leqq f4 \leqq 0$ is satisfied in the rule indicated by pointer 1. The affirmative consequent part of rule 1 designates rule 2, so that rule 2 is checked. The condition part $1 \leqq f7 \leqq \infty$ of rule 2 is satisfied. The affirmative consequent part of rule 2 has a negative value −1, so that it represents the final conclusion. The user judges this reasoning and may find that the condition $1 \leqq f7 \leqq \infty$ of rule 2 is not needed. Thus, he will make a node deletion request to the system. In turn, the system notifies the affirmative and negative conclusions of rule 2 to the user. If the user finds that there is no need of providing any difference between the two conclusions, he tells the system that deleting of rule 2 is confirmed. Then, the system changes the affirmative consequent part of rule 1 linked to rule 2 to be deleted from pointer value "2" of rule 2 to value "−1" of the conclusion of forward reasoning that was stored in affirmative consequent part of deletion rule 2. As a result, rule 2 is no longer accessed in subsequent forward reasoning, that is, it is deleted in effect. Either conclusion data of the deletion rule 2 may be set in the affirmative conclusion part of rule 1, because the deletion of the condition part of the deletion rule 2 is nothing other than recognizing the same conclusion regardless of whether that condition part is satisfied or not.

[CORRECTION OF CONCLUSION]

Figure 80:
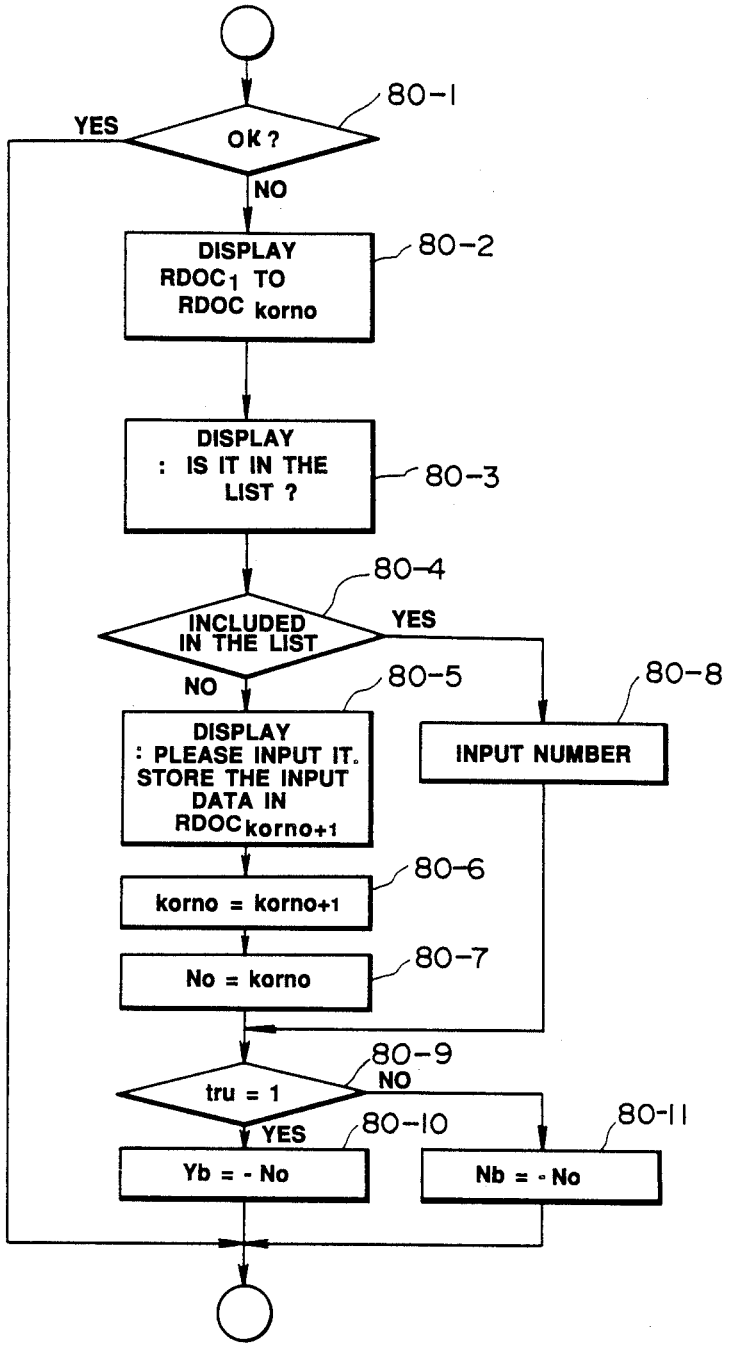
FIG. 80 is a flowchart for correcting a conclusion.

FIG. 80 is a flow for correcting a conclusion. The correction of conclusion is done for a conclusion obtained forward reasoning (nonharmonic tone identifier). First, the conclusion list is displayed (step 80-2). The system asks whether there is a desired nonharmonic tone type in the list (step 80-3). If a desired conclusion is in the list, the number of that conclusion is input (step 80-8). Otherwise, type of conclusion is asked, and the type of nonharmonic tone input by the user is set in RDOCkorno, conclusion list size korno is increased, and increased korno is set as corrected conclusion data in No (steps 80-5 through 80-7). Then, a check is done with reference to tru as to which of the conclusion Yb and Nb of the last rule used in the forward reasoning was the conclusion thereof, and the identified conclusion is changed to the corrected conclusion data (−No) (steps 80-9 through 80-11).

With the functions of addition and deletion of knowledge and correction of conclusion, it is possible to correct existing production rule data to desired data. Such correction is done according to user's judgment on a melody analysis result obtained by applying existing production rule data to a melody. This means that musical knowledge obtainable by the user in a single forward reasoning is only part of the entire production rules. It is desired to provide means for displaying the entire production rules in a tree structure to permit the user to grasp the entire musical knowledge provided in the system. The tree structure musical knowledge display means will be described hereinunder.

[MUSICAL KNOWLEDGE TREE MONITOR]

Figure 81:
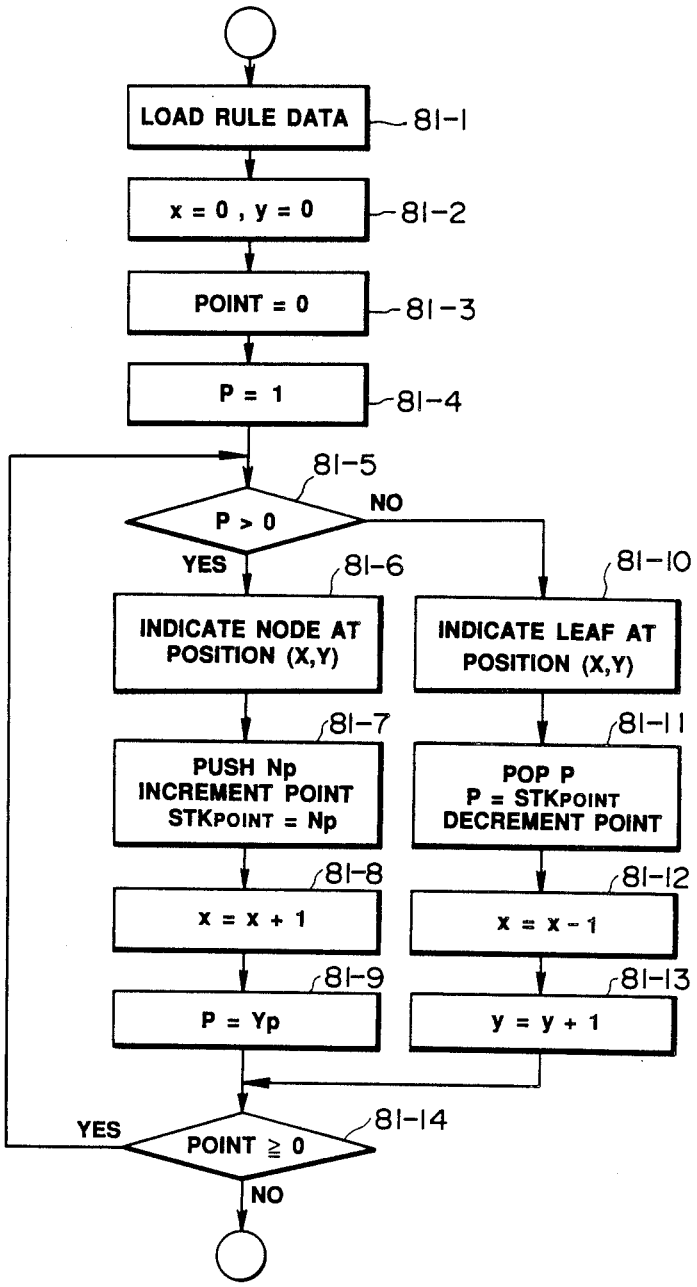
FIG. 81 is a flowchart for monitoring knowledge (rules) in a tree form.
Figure 82:
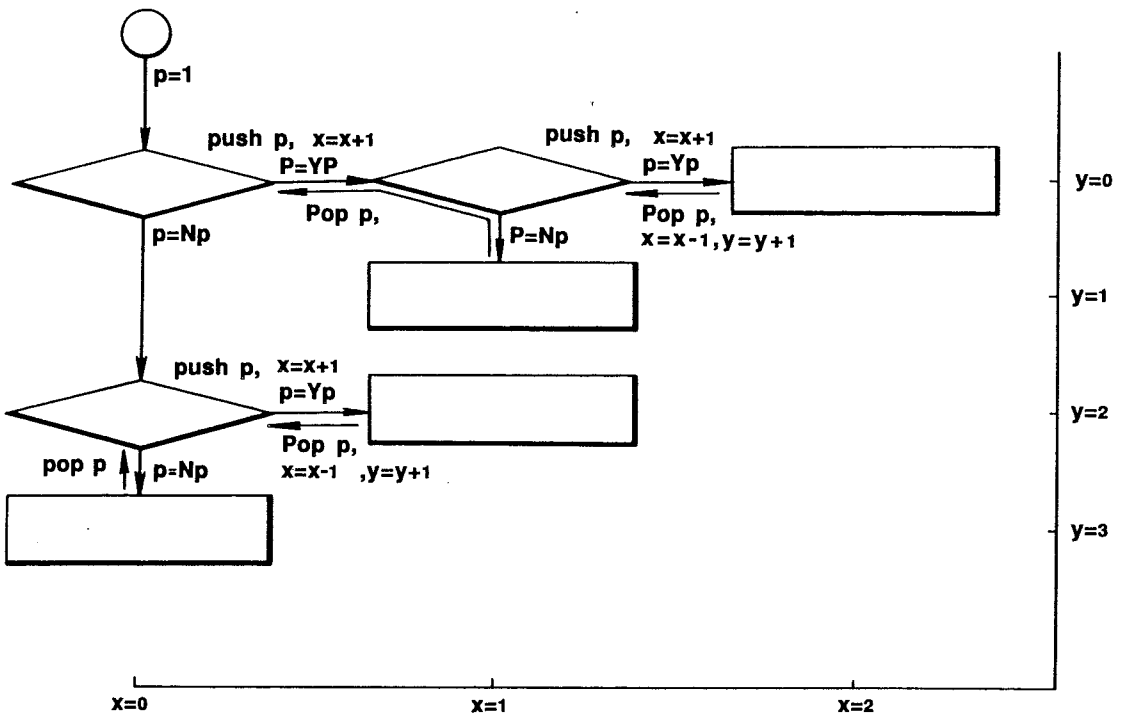
FIG. 82 shows a displayed example of knowledge in a tree form.

FIG. 81 shows a flow of a musical knowledge tree monitor, in which musical knowledge represented by production rules is visually displayed in a tree structure, and FIG. 82 shows an example of a musical knowledge tree displayed on a display screen by the monitor. In this example, the positions of the condition part (node) and consequent parts of respective rules stored in the production rule memory 7 are allotted to unique points in X-Y co-ordinates. Retrieval of all the rules starts with the root rule, and YES side of the condition part of each rule is followed. With a rule, the YES side of which has been explored, the NO side data (rule pointer) is pushed onto a stack to explore the NO side afterwards. When a leaf (a conclusion representing a nonharmonic tone identifier) is reached, a rule pointer is popped out from the stack, and the process is continued. When there is no rule pointer remaining in the stack, all the rules have been retrieved and displayed.

In the flow of FIG. 81, after loading rule data (step 87-1), x=0 and y=0 (representing, for instance, a left upper position on the screen) is selected as initial position of display (step 81-2). At the initial position, the condition part (node) of the root rule is to be displayed. Then, a stack pointer POINT is initialized to "0" (step 81-3), and data "1" designating the root rule is set in a rule pointer P (step 81-4).

If it is found in a step 81-5 that P is positive, P designates a particular production rule. In this case, the condition part of the rule designated by P is displayed at display position (x, y). Then, to explore the rule branched out from the NO side of the condition part of this rule at a later time, NP (data of the negative consequent part of rule P) is pushed onto stack STKPOINT, and the stack pointer POINT is incremented (step 81-7).

With x=x+1 the position of x is shifted by 1 to the right to determine the display position of the node or consequent part of the next rule to be explored (step 81-8), and data Yp of the affirmative consequent part of the rule accessed now is set in the rule pointer P, so that the rule linked to the YES side of the condition part of the current rule is accessed next.

If it is found in the step 81-5 that P is negative, P designates a leaf (i.e., conclusion). In this case, the conclusion is indicated at the display position (x, y) (step 81-10), then data STKPOINT is taken out from the stack and set in the rule pointer P, and the stack pointer POINT is decremented (step 81-11). As noted above, the data stored in the stack either points to an unexplored rule, if any, linked to the NO side of the rule with its YES side already explored, or represents a conclusion if there is no subsequent rule. Then, the next data display position is determined by shifting x by 1 to the left (step 81-12) and shifting y down by 1 (step 81-13). The tree monitor process ends when it is found in a step 81-14 that the stack pointer POINT is negative.

If a piece of knowledge which is desired to be corrected is included in the entire knowledge displayed by the tree monitor, change to the desired one can be made by using functions of addition and deletion of knowledge and correction of conclusion as described before. For example, to add knowledge the user selects, among the terminals of musical knowledge displayed by the tree monitor, a terminal to which it is desired to add a condition, by using a pointer device such as cursor. The system then checks for a conclusion of a rule at the selected position. As a result, data corresponding to P, b, true in the forward reasoning (shown in FIG. 71) are obtained. Subsequently, the process of the step 76-3 and following steps in FIG. 76 is executed to effect addition of knowledge.

This concludes the description of the embodiment. However, various modifications and alterations are obvious to a person of ordinary skill in the art without departing from the scope of the invention which should be limited solely by the appended claims.

What is claimed is:

1. In an automatic composer having:

melody input means for providing a melody;

chord progression input means for providing a chord progression formed by a succession of chords;

melody analyzer means for analyzing the melody provided by said melody input means;

melody synthesizer means for synthesizing a melody from the chord progression provided by said chord progression input means and the result of analysis from said melody analyzer means;

said melody analyzer means including nonharmonic tone classification means for classifying nonharmonic tones contained in the melody provided by said melody input means; and said melody synthesizer means including arpeggio generator means for producing arpeggio tones in accordance with the chord progression provided by said chord progression input means, and nonharmonic tone addition means for adding nonharmonic tones to the arpeggio tones produced by said arpeggio generator means;

the improvement comprising:

common knowledge base means for storing musical knowledge of classifying nonharmonic tones contained in a melody; and means for commonly using said common knowledge base means by both of said nonharmonic tone classification means and said nonharmonic tone addition means, wherein said nonharmonic tone classification means executes a classification of nonharmonic tones in accordance with the musical knowledge in said common knowledge base means, and said nonharmonic tone addition means executes an addition of nonharmonic tones in accordance with the same musical knowledge in said common knowledge base means.

2. The automatic composer recited in claim 1, wherein said non harmonic tone classification means comprises first function calculator means for computing a plurality of functions representing a situation of a melody, and first inference means for deducing a type of a nonharmonic tone by applying said musical knowledge to the computed functions, and wherein said nonharmonic tone addition means comprises second function calculator means for computing a plurality of functions representing a situation of a melody, and second inference means for deducing a type of a nonharmonic tone by applying said musical knowledge to the computed functions.

3. The automatic composer recited in claim 1, wherein said musical knowledge stored in said common knowledge base means forms a network of a plurality of rules, each rule comprising a condition part and two alternative consequent parts branching out from the condition part, and wherein one of the consequent parts is selected when the condition part is satisfied while the other consequent part is selected when the condition part is not satisfied, so that each of the consequent parts either points to a rule to be applied next if such a rule remains, or indicates a nonharmonic tone identifier representative of a classified type of a nonharmonic tone if there is no more rule to be applied.

4. The automatic composer recited in claim 1 wherein said nonharmonic tone addition means further comprises conditioning means for setting pitch limits to a nonharmonic tone from arpeggio tones produced by said arpeggio generator means.

5. In an automatic composer having:

melody input means for providing a melody;

chord progression input means for providing a chord progression formed by a succession of chords;

melody analyzer means for analyzing the melody provided by said melody input means;

melody synthesizer means for synthesizing a melody from the chord progression provided by said chord progression input means and the result of analysis from said melody analyzer means;

said melody analyzer means including nonharmonic tone classification means for classifying nonharmonic tones contained in the melody provided by said melody input means; and said melody synthesizer means including arpeggio generator means for producing arpeggio tones in accordance with the chord progression provided by said chord progression input means, and nonharmonic tone addition means for adding nonharmonic tones to the arpeggio tones produced by said arpeggio generator means;

the improvement comprising:

knowledge base means for storing musical knowledge of classifying nonharmonic tones;

correction input means for inputting correction data;

knowledge management means coupled to said correction input means and to said knowledge base means, for correcting the musical knowledge stored in said knowledge base means based on the input correction data; and means coupled to said knowledge management means, for enabling either of said nonharmonic tone classification means and said nonharmonic tone addition means to reference the corrected musical knowledge stored in said knowledge base means under the control of said knowledge management means so that either the classification of nonharmonic tones by said classification means or the addition of nonharmonic tones by said addition means, will be executed in accordance with the corrected musical knowledge.

6. The automatic composer recited in claim 5, wherein said knowledge management means comprises:

condition adding means for adding a condition for a nonharmonic tone of a particular type to said knowledge base means so that when a nonharmonic tone in question fails to satisfy the added condition, the nonharmonic tone in question will not be determined to be said nonharmonic tone of a particular type;

condition deleting means for deleting a condition for a nonharmonic tone of a particular type from said knowledge base means so that a nonharmonic tone in question will be determined to be said nonharmonic tone of a particular type irrespective of whether or not the nonharmonic tone in question satisfies the deleted condition; and conclusion changing means for changing the type of nonharmonic tone determined when a set of conditions is met wherein the changed type of nonharmonic tone will be determined when said set of conditions is met.

7. The automatic composer recited in claim 5 wherein said knowledge base means is shared as a source of common knowledge by both of said nonharmonic tone classification means and said nonharmonic tone addition means.

8. In an automatic composer employing:

chord progression providing means for providing a chord progression;

featuring parameter generating means for generating featuring parameters of a melody; and melody synthesizer means for synthesizing a melody from said chord progression and from said featuring parameters;

the improvement wherein said featuring parameter generating means comprises hierarchic structure extraction means for extracting a hierarchic structure from said chord progression, and featuring parameter control means for controlling said featuring parameters based on said hierarchic structure, so that said hierarchic structure will be reflected in the melody synthesized by said melody synthesizer means.

9. The automatic composer recited in claim 8 wherein said hierarchic structure extraction means comprises:

matching evaluation means for evaluating similarities among the segments of the chord progression for respective phases of a music piece; and structure assigning means for assigning hierarchic structure identifiers to the respective phrases based on the evaluated similarities.

10. The automatic composer recited in claim 8, wherein said featuring parameter control means includes means for controlling a pattern of arpeggio tones as at least part of said featuring parameters so that said melody synthesizer means will produce arpeggio tones in accordance with the controlled pattern.

11. The automatic composer recited in claim 8, wherein said featuring parameter control means includes means for controlling a range of a melody as at least part of said featuring parameters so that said melody synthesizer means will produce a melody within the controlled range.

12. The automatic composer recited in claim 8 wherein said featuring parameter generating means further comprises melody input means for inputting a melody and featuring parameter extraction means for analyzing the input melody to extract featuring parameters, and said featuring parameter control means modifies the extracted featuring parameters based on said hierarchic structure.

13. An apparatus for analyzing a chord progression formed by a succession of chords, comprising:

chord progression providing means for providing a chord progression formed by a succession of chords having associated time intervals; and key determining means responsive to said chord progression providing means for automatically and variably determining from said chord progression a key for each time interval of a chord in said chord progression to provide a key structure in music as a function of said chord progression.

14. The apparatus recited in claim 13, wherein said key determining means comprises means for maintaining the key in a current time interval unchanged from a key in a preceding time interval when all members of the chord in the current time interval are included in a scale having the key of the preceding time interval, and means for successively changing a key to related keys when the chord in the current time interval contains a member outside the scale of the key in the preceding time interval, wherein a changed key whose scale contains all the members of the chord in the current time interval is determined to be the key in the current time interval.

15. In an automatic composer having:

chord progression providing means for providing a chord progression formed by a succession of chords having associated time intervals; and melody generator means for generating a melody in accordance with said chord progression;

the improvement comprising:

key determining means responsive to said chord progression providing means for automatically and variably determining from said chord progression a key for each time interval of a chord in said chord progression to provide a key structure in music as a function of said chord progression; and said melody generator means including means for selecting at least one melody tone from a scale having a key determined by said key determining means for said each time interval of the chords in said chord progression.

16. The automatic composer recited in claim 15, wherein said key determining means comprises means for maintaining the key in a current time interval unchanged from a key in a preceding time interval when all members of the chord in the current time interval are included in a scale having the key of the preceding time interval, and means for successively changing a key to related keys when the chord in the current time interval contains a member outside the scale of the key in the preceding time interval, wherein a changed key whose scale contains all the members of the chord in the current time interval is determined to be the key in the current time interval.

17. An apparatus for analyzing a chord progression formed by a succession of chords, comprising:

chord progressing providing means for providing a chord progression formed by a succession of chords having associated time intervals; and key determining means for determining a key for each time interval of chord in said chord progression to provide a key structure in music;

said key determining means comprising means for maintaining the key in a current time interval unchanged from a key in a preceding time interval when all members of the chord in the current time interval are included in a scale having the key of the preceding time interval, and means for successively changing a key to related keys when the chord in the current time interval contains a member outside the scale of the key in the preceding time interval wherein a changed key whose scale contains all the members of the chord in the current time interval is determined to be the key in the current time interval.

18. In an automatic composer employing:

chord progression providing means for providing a chord progression formed by a succession of chords having associated time intervals; and melody generator means for generating a melody in accordance with said chord progression;

the improvement comprising:

key determining means for determining a key for each time interval of chord in said chord progression to provide a key structure in music; and said melody generator means including means for selecting a melody tone or tones from a scale having a key determined by said key determining means;

said key determining means comprising means for maintaining the key in a current time interval unchanged from a key in a preceding time interval when all members of the chord in the current time interval are included in a scale having the key of the preceding time interval, and means for successively changing a key to related keys when the chord in the current time interval contains a member outside the scale of the key in the preceding time interval wherein a changed key whose scale contains all the members of the chord in the current time interval is determined to be the key in the current time interval.

19. An apparatus for analyzing a chord progression formed by a succession of chords, comprising:

chord progression providing means for providing a chord progression formed by a succession of chords having associated time intervals; and key determining means for automatically and variably determining from said chord progression a key for each time interval of a chord in said chord progression to provide a key structure in music;

said key determining means comprising means for maintaining the key in a current time interval unchanged from a key in a preceding time interval when all members of the chord in the current time interval are included in a scale having the key of the preceding time interval, and means for successively changing a key to related keys when the chord in the current time interval contains a member outside the scale of the key in the preceding time interval wherein a changed key whose scale contains all the members of the chord in the current time interval is determined to be the key in the current time interval.

20. In an automatic composer having:

chord progression providing means for providing a chord progression formed by a succession of chords having associated time intervals; and melody generator means for generating a melody in accordance with said chord progression;

the improvement comprising:

key determining means for automatically and variably determining from said chord progression a key for each time interval of a chord in said chord progression to provide a key structure in music; and said melody generator means including means for selecting at least one melody tone from a scale having a key determined by said key determining means for said each time interval of the chords in said chord progression;

said key determining means comprising means for maintaining the key in a current time interval unchanged from a key in a preceding time interval when all members of the chord in the current time interval are included in a scale having the key of the preceding time interval, and means for successively changing a key to related keys when the chord in the current time interval contains a member outside the scale of the key in the preceding time interval wherein a changed key whose scale contains all the members of the chord in the current time interval is determined to be the key in the current time interval.

* * * * *